US007986293B2

(12) United States Patent
Yanamoto

(10) Patent No.: US 7,986,293 B2
(45) Date of Patent: Jul. 26, 2011

(54) DRIVING METHOD FOR LIQUID CRYSTAL DISPLAY DEVICE ASSEMBLY

(75) Inventor: Kaoru Yanamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 780 days.

(21) Appl. No.: 11/600,392

(22) Filed: Nov. 16, 2006

(65) Prior Publication Data

US 2007/0120766 A1 May 31, 2007

(30) Foreign Application Priority Data

Nov. 29, 2005 (JP) ..... 2005-343320
Sep. 8, 2006 (JP) ..... 2006-244330

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS 6,888,529 B2 5/2005 Bruning et al.
6,891,672 B2 5/2005 Whitehead et al.
2003/0006978 A1* 1/2003 Fujiyoshi ..... 345/204
2004/0212847 A1* 10/2004 Bliley et al. ..... 358/474
2005/0057484 A1* 3/2005 Diefenbaugh et al. ..... 345/102
2006/0066788 A1* 3/2006 Utsumi et al. ..... 349/120
2006/0092182 A1* 5/2006 Diefenbaugh et al. ..... 345/690

FOREIGN PATENT DOCUMENTS

JP 2004-212503 7/2004
JP 2004-246117 9/2004

* cited by examiner

*Primary Examiner* — Alexander S Beck
*Assistant Examiner* — Jarurat Suteerawongsa
(74) *Attorney, Agent, or Firm* — Wolf, Greenfield & Sacks, P.C.

(57) ABSTRACT

A driving method for a liquid crystal display device assembly that includes a transmissive-type liquid crystal display device, a planar light source device including P×Q planar light source units, and a drive circuit that drives the two devices is disclosed. The driving method includes the step of, when the value of an input signal input into the drive circuit is indicated by x, in each of the display area units, when the value x of the input signal for any of the pixels is greater than or equal to a predetermined value, such a value being indicated by $x_{U\text{-}max}$, controlling the luminance level of the planar light source unit corresponding to the display area unit so that luminance levels of the pixels, assuming that the control signal corresponding to the input signal having a value greater than the value $x_{U\text{-}max}$ is supplied to the pixels, can be obtained.

13 Claims, 29 Drawing Sheets

DISPLAY AREA UNITS AND PLANAR LIGHT SOURCE UNITS THAT ACHIEVE INCREASED LUMINANCE

DISPLAY AREA UNITS AND PLANAR LIGHT SOURCE UNITS THAT DO NOT ACHIEVE INCREASED LUMINANCE

DRIVING METHOD FOR LIQUID CRYSTAL DISPLAY DEVICE ASSEMBLY

CROSS REFERENCES TO RELATED APPLICATIONS

The present invention contains subject matter related to Japanese Patent Application JP 2005-343320 filed in the Japanese Patent Office on Nov. 29, 2005 and Japanese Patent Application JP 2006-244330 filed in the Japanese Patent Office on Sep. 8, 2006 the entire contents of which are incorporated herein by reference.

BACKGROUND OF THE INVENTION

1. Field of the Invention

The present invention relates to a method for driving a liquid crystal display device assembly including a liquid crystal device and a planar light source device.

2. Description of the Related Art

In liquid crystal display devices, a liquid crystal material does not emit light by itself. Instead, a direct-lighting-type planar light source device (backlight) is disposed at the back surface of a liquid crystal display device to emit light. In color liquid crystal display devices, one pixel is formed of three sub-pixels, such as a red (R) light-emitting sub-pixel, a green (G) light-emitting sub-pixel, and a blue (B) light-emitting sub-pixel. Then, by operating a liquid crystal cell forming one pixel or one sub-pixel as one type of optical shutter (light valve), i.e., by controlling the light transmittance (aperture ratio) of each pixel or each sub-pixel, the amount (ratio) of illumination light (for example, white light) emitted from the planar light source device and passing through the pixel or sub-pixel can be controlled so that images can be displayed. With the recent increase in the size of liquid crystal display devices, planar light source devices have also increased in size.

A known planar light source device illuminates the overall display area of a liquid crystal display device with a uniform and constant level of brightness. Another type of planar light source device is also known from, for example, Japanese Unexamined Patent Application Publication Nos. 2004-212503 and 2004-246117. The planar light source device disclosed in such publications includes a plurality of planar light source units corresponding to a plurality of display area units forming the overall display area of a liquid crystal display device, and controls the light emission conditions of the planar light source units to change the distribution of the illuminations in the display area units.

Basically, the above-described planar light source device is controlled according to the following method. It should be noted that a signal is externally input into a drive circuit and, based on this input signal, a control signal is generated for each pixel for controlling the light transmittance of the pixel and is supplied to the pixel from the drive circuit. It is now assumed that the maximum luminance of each planar light source unit forming the planar light source device is indicated by $Y_{max}$, the maximum light transmittance (aperture ratio) (more specifically, for example, 100%) of the pixels forming each display area unit is indicated by $Lt_{max}$, and the light transmittance (aperture ratio) of each pixel for obtaining the luminance of the display area (hereinafter may be referred to as the "display luminance y") when each planar light source unit exhibits the maximum luminance $Y_{max}$ is indicated by Lt.

In this specification, the display luminance y obtained by the light source luminance Y and the light transmittance Lt can be expressed by the following equation (A) using an operator **.

$$y=Y^{**}Lt \tag{A}$$

In this case, the light source luminance Y of each planar light source unit forming the planar light source device should be controlled to satisfy the following equation.

$$Y^{}Lt_{max}=Y_{max}{}^{}Lt$$

The concept of the above-described control method is shown in FIGS. 28A and 28B. In this case, the light source luminance Y of the planar light source unit is changed for each frame for displaying an image (which is referred to as an "image display frame") on the liquid crystal display device.

SUMMARY OF THE INVENTION

The contrast ratio in a color liquid crystal display device (luminance ratio of a full-white display portion to a full-black display portion on the screen surface of the color liquid crystal display device without including external light reflection) is the ratio of the maximum light transmittance to the minimum light transmittance of each pixel. Currently, color liquid crystal display devices that can achieve a contrast ratio of about 1000:1 are considered to be high-performance liquid crystal display devices. In order to further improve the contrast ratio, it is necessary to increase the luminance level of the full-white display portion. One of the approaches to achieving this is to increase the luminance of the planar light source device, as schematically shown in FIG. 29. In this approach, however, the luminance of the full-black display portion is also increased, and the so-called "graying of a black color" phenomenon occurs, which makes the display state on the screen unnatural compared with other types of display devices. In contrast, in cathode ray tubes (CRTs), automatic brightness limitation (ABL) control can be performed to increase the luminance level of only a white display portion so that the brightness of white, which is unique to CRTs, can be obtained. More specifically, the luminance of the white display portion is 500 cd/m$^2$, while the luminance of the other portions is 300 cd/M$^2$. In color liquid crystal display devices, however, as far as the present inventor has investigated, no specific method for increasing the luminance level of a white display portion to a level higher than the luminance levels of the other display portions is known. Additionally, neither of the above-described publications, i.e., Japanese Unexamined Patent Application Publication Nos. 2004-212503 and 2004-246117, discloses or suggests a specific method for further enhancing the contrast ratio or for increasing the luminance level of a white display portion.

It is thus desirable to provide a driving method for a liquid crystal display device assembly that can increase the luminance level of a certain display portion to a level higher than the luminance levels of the other display portions. It is also desirable to provide a driving method for a liquid crystal display device assembly that can further improve the contrast ratio as well as increase the luminance level.

According to an embodiment of the present invention, there is provided a first driving method for a liquid crystal display device assembly that includes (A) a transmissive-type liquid crystal display device including a display area having pixels disposed in a two-dimensional matrix, (B) a planar light source device including P×Q planar light source units corresponding to virtual P×Q display area units, assuming that the display area of the transmissive-type liquid crystal display device is divided into the virtual P×Q display area units, the planar light source device illuminating the display area units corresponding to the planar light source units from a back surface of the display area units, and (C) a drive circuit that drives the planar light source device and the transmissive-type liquid crystal display device, the drive circuit supplying a control signal to each pixel for controlling the light transmittance of the pixel. It is now assumed that the value of an input signal input into the drive circuit for driving the pixels is indicated by x and that the maximum value of the input signals input into the drive circuit for driving the pixels is indicated by $x_{max}$.

Various coefficients described below are set to be in the following ranges.

$k_0$: $0.06 \leqq k_0 \leqq 0.3$ $k_1$: $0.94 \leqq k_1 \leqq 0.99$ $k_2$: $0.35 \leqq k_2 \leqq 0.5$ $\alpha_0$: $0.95 \leqq \alpha_0 \leqq 1.0$ $\alpha_1$: $0.3 \leqq \alpha_1 \leqq 0.8$ $\alpha_2$: $0.01 \leqq \alpha_2 \leqq 0.2$ In the above-described first driving method for the liquid crystal display device assembly, in each of the display area units, when the value x of the input signal for any of the pixels forming the display area unit is greater than or equal to a predetermined value, the value of the input signal being indicated by $x_{U\text{-}max}$, the luminance level of the planar light source unit corresponding to the display area unit is controlled by the drive circuit so that luminance levels of the pixels, assuming that the control signal corresponding to the input signal having a value greater than the value $x_{U\text{-}max}$ is supplied to the pixels, can be obtained. In this case, if necessary, the light transmittance of each pixel forming the display area unit is also controlled.

In the above-described first driving method, when the predetermined value is indicated by $k_1 \cdot x_{max}$, in each of the display area units, when the value x of the input signal for any of the pixels forming the display area unit is greater than or equal to $k_1 \cdot x_{max}$, i.e., $x \geqq k_1 \cdot x_{max}$ (1) , the value of the input signal being indicated by $x_{U\text{-}max}$, the luminance level of the planar light source unit corresponding to the display area unit may be controlled by the drive circuit so that luminance levels of the pixels, assuming that the control signal corresponding to the input signal having a value equal to a value $x_{U\text{-}max}+k_0 \cdot x_{max}$ (2), can be obtained. In this case, if necessary, the light transmittance of each pixel forming the display area unit is also controlled.

In the above-described first driving method, each pixel may include a set of three sub-pixels, which are an R light-emitting sub-pixel, a G light-emitting sub-pixel, and a B light-emitting sub-pixel. It is now assumed that values of the input signals input into the drive circuit for driving the R light-emitting sub-pixel, the G light-emitting sub-pixel, and the B light-emitting diode are indicated by $X_R$, $X_G$, and $X_B$, respectively. When the predetermined value is indicated by $k_1 \cdot x_{max}$, in each of the display area units, when all the values $X_R$, $X_G$, and $X_B$ for any of the pixels forming the display area unit are greater than or equal to $k_1 \cdot x_{max}$, i.e., $x_R \geqq k_1 \quad x_{max}$ (1-1), $x_G \geqq k_1 \cdot x_{max}$ (1-2), and $x_B \geqq k_1 \cdot x_{max}$ (1-3), the values of the input signals being indicated by $x_{U\text{-}max}(R)$, $X_{U\text{-}max}(G)$, and $x_{U\text{-}max}(B)$, respectively, the luminance level of the planar light source unit corresponding to the display area unit may be controlled by the drive circuit so that luminance levels of the R light-emitting sub-pixel, the G light-emitting sub-pixel, and the B light-emitting sub-pixel, assuming that the control signal corresponding to the input signal having a value equal to a value $(X_{U\text{-}max(R)}+x_{U\text{-}max(G)}+x_{U\text{-}max(B)})/3+k_0 \cdot X_{max}$ (2') are supplied to the R light-emitting sub-pixel, the G light-emitting sub-pixel, and the B light-emitting sub-pixel, can be obtained. In this case, if necessary, the light transmittance of each pixel forming the display area unit is also controlled.

According to another embodiment of the present invention, there is provided a second driving method for a liquid crystal display device assembly. The driving method includes the steps of: when the value x of the input signal for any of the pixels forming the display area unit is greater than or equal to a predetermined value, the value of the input signal being indicated by $x_{U\text{-}max}$, controlling the luminance level of the planar light source unit corresponding to the display area unit by the drive circuit so that luminance levels of the pixels, assuming that the control signal corresponding to the input signal having a value greater than the value $x_{U\text{-}max}$ is supplied to the pixels, can be obtained; and in each of the display area units, if the values x of the input signals for all the pixels forming the display area unit are smaller than the predetermined value, when the maximum value of the input signals input into the drive circuit for driving all the pixels forming the display area unit is indicated by $x_{U\text{-}max}$, controlling is the luminance level of the planar light source unit corresponding to the display area unit by the drive circuit so that the luminance levels of the pixels, assuming that the control signal corresponding to the input signal having a value equal to the maximum value $x'_{U\text{-}max}$ is supplied to the pixels, can be obtained. In this case, if necessary, the light transmittance of each pixel forming the display area unit is also controlled. With this configuration, although the image quality may be changed since the gamma (γ) characteristic slightly deviates from a desired characteristic, such a change can be negligible.

In the above-described second driving method, in each of the display area units, when the value x of the input signal for any of the pixels forming the display area unit is greater than or equal to $k_1 \cdot x_{max}$, i.e. $x \geqq k_1 \cdot x_{max}$ (1), the value of the input signal being indicated by $x_{U\text{-}max}$, the luminance level of the planar light source unit corresponding to the display area unit may be controlled by the drive circuit so that luminance levels of the pixels, assuming that the control signal corresponding to the input signal having a value equal to a value $x_{U\text{-}max}+k_0 \cdot x_{max}$ (2) is supplied to the pixels, can be obtained. In each of the display area units, when the value x of the input signal for any of the pixels forming the display area unit is smaller than $k_1 \cdot x_{max}$ and when the maximum value of the input signals input into the drive circuit for driving all the pixels forming the display area unit is indicated by $x'_{U\text{-}max}$, the luminance level of the planar light source unit corresponding to the display area unit may be controlled by the drive circuit so that luminance levels of the pixels, assuming that the control signal corresponding to the input signal having a value equal to the maximum value $x'_{U\text{-}max}$ is supplied to the pixels, can be obtained. In this case, if necessary, the light transmittance of each pixel forming the display area unit is also controlled.

In the above-described second driving method, wherein each pixel may include a set of three sub-pixels, which are an R light-emitting sub-pixel, a G light-emitting sub-pixel, and a B light-emitting sub-pixel. It is now assumed that values of the input signals input into the drive circuit for driving the R light-emitting sub-pixel, the G light-emitting sub-pixel, and the B light-emitting diode are indicated by $X_R$, $X_G$, and $X_B$, respectively. When the predetermined value is indicated by $k_1 \cdot x_{max}$, in each of the display area units, when all the values $X_R$, $X_G$, and $X_B$ for any of the pixels forming the display area unit are greater than or equal to $k_1 \cdot x_{max}$, i.e., $x_R \geqq k_1 \cdot x_{max}$ (1-1), $x_G \geqq k_1 \cdot x_{max}$ (1-2), and $x_B \geqq k_1 \cdot x_{max}$ (1-3), the values of the input signals being indicated by $x_{U\text{-}max(R)}$, $x_{U\text{-}max(G)}$, and $x_{U\text{-}max(B)}$, respectively, the luminance level of the planar light source unit corresponding to the display area unit may be controlled by the drive circuit so that luminance levels of the R light-emitting sub-pixel, the G light-emitting sub-pixel, and the B light-emitting sub-pixel, assuming that the control signal corresponding to the input signal having a value equal to a value $(x_{U\text{-}max(R)}+x_{U\text{-}max(G)}+x_{U\text{-}max(B)})/3+k_0 \cdot x_{max}$ (2') are supplied to the R light-emitting sub-pixel, the G light-emitting sub-pixel, and the B light-emitting sub-pixel, can be obtained. In each of the display area units, when any of the values $X_R$, $X_G$, and $X_B$ for all the pixels forming the display area unit is smaller than $k_1 \cdot x_{max}$ and when the maximum value of the input signals for the R light-emitting sub-pixel, the G light-emitting sub-pixel, and the B light-emitting sub-pixel input into the drive circuit for driving all the pixels forming the display area unit is indicated by $x'_{U\text{-}max}$, the luminance level of the planar light source unit corresponding to the display area unit may be controlled by the drive circuit so that luminance levels of the R light-emitting sub-pixel, the G light-emitting sub-pixel, and the B light-emitting sub-pixel, assuming that the control signal corresponding to the input signal having a value equal to the maximum value $x'_{U\text{-}max}$ is supplied to the R light-emitting sub-pixel, the G light-emitting sub-pixel, and the B light-emitting sub-pixel, can be obtained. In this case, if necessary, the light transmittance of each pixel forming the display area unit is also controlled.

In the above-described first and second driving methods, the planar light source unit may include a light-emitting diode, in which case, the luminance level of the planar light source unit may be increased or decreased by increasing or decreasing a duty ratio used in pulse width modulation (PWM) control for the light-emitting diode forming the planar light source unit. The duty ratio Do that can obtain the luminance levels of the pixels, assuming that the control signal corresponding to the input signal having a value equal to $(1+k_0)x_{max}$ is supplied to the pixels, may be expressed by $D_0=\alpha_0 \cdot D_{max}$ (4), where $D_{max}$ represents the maximum duty ratio. For the sake of convenience, increasing or decreasing the luminance level of the planar light source unit by increasing or decreasing the duty ratio used in PWM control for the light-emitting diode forming the planar light source unit is referred to as the "luminance control method for the planar light source unit based on the duty-ratio increasing/decreasing control". In the second driving method for the liquid crystal display device assembly, when the above-described luminance control method is employed, the duty ratio $D_1$ that can obtain the luminance levels of the pixels, assuming that the control signal corresponding to the input signal having a value equal to $k_1 \cdot x_{max}$ is supplied to the pixels, may be expressed by $D_1=\alpha_1 \cdot D_{max}$ (5) where $D_{max}$ represents the maximum duty ratio.

In the second driving method for the liquid crystal display device assembly, when the maximum value $x'_{U\text{-}max}$ is expressed by $x'_{U\text{-}max} \leqq k_2 \cdot x_{max}$ (3), the luminance level of the planar light source unit corresponding to the display area unit may be controlled by the drive circuit so that luminance levels of the pixels, assuming that the control signal corresponding to the input signal having a value equal to a value $x'_{U\text{-}max}/k_2$ (or $x'_{U\text{-}max}/\{(k_2 \cdot x_{max})/x_{max}\}$) is supplied to the pixels, can be obtained. With this configuration, the desired γ characteristic can be maintained, and the contrast ratio can be increased without changing the image quality. The relationship between $k_1$ and $k_2$ can be expressed by, for example, $0.35 \leqq k_2/k_1 \leqq 0.53$. In this case, the planar light source unit may include a light-emitting diode, and the luminance level of the planar light source unit may be increased or decreased by increasing or decreasing the duty ratio used in pulse width modulation control for the light-emitting diode forming the planar light source unit. The duty ratio Do that can obtain the luminance levels of the pixels, assuming that the control signal corresponding to the input signal having a value equal to $(1+k_0)$ $x_{max}$ is supplied to the pixels may be expressed by $D_0=\alpha_0 \cdot D_{max}$ (4), where $D_{max}$ represents the maximum duty ratio. When the luminance control method for the planar light source unit based on the duty-ratio increasing/decreasing control is employed, the duty ratio $D_1$ that can obtain the luminance levels of the pixels, assuming that the control signal corresponding to the input signal having a value equal to $k_1 \cdot x_{max}$ is supplied to the pixels, is may be expressed by $D_1=\alpha_1 \cdot D_{max}$ (5), where $D_{max}$ represents the maximum duty ratio. The duty ratio $D_2$ that can obtain the luminance levels of the pixels, assuming that the control signal corresponding to the input signal having a value equal to $k_2 \cdot x_{max}$ is supplied to the pixels, may be expressed by $D_2=\alpha_2 \cdot D_{max}$ (6), where $D_{max}$ represents the maximum duty ratio. If the contrast ratio of the liquid crystal display device is $10^3$:1, it is improved to $5\times10^3$:1 when $\alpha_2=0.2$ and is improved to $10^5$:1 when $\alpha_2=0.01$.

In the above-described first and second driving methods, the range of $x'_{U\text{-}max}$ is from 0 to $x_{max}$. The values obtained by multiplying the value x of the input signal and the value X of the control signal with various coefficients should take integers. Accordingly, rounding errors occurring in various calculations should be handled by, for example, desired calculation algorithms.

The number of pixels satisfying expression (1) (or expressions (1-1), (1-2), and (1-3)) in the planar light source unit is not particularly restricted. For example, the number of pixels may be one, or may be in a range from 1% to 25% of the number of pixels forming one display area unit. If the number of pixels is in a range from 1% to 25%, the average of the input signals of the plurality of pixels satisfying expression (1) may be used as the first term in expression (2), or the average of the averages $[(x_{U\text{-}max(R)}+x_{U\text{-}max(G)}+x_{U\text{-}max(B)})/3]$ of the input signals of the plurality of pixels satisfying expressions (1-1), (1-2), and (1-3) may be used as the first term in expression (2'). Alternatively, the maximum value of the input signals of the plurality of pixels satisfying expression (1) may be used as the first term in expression (2), or the maximum value of the averages $[(x_{U\text{-}max(R)}+x_{U\text{-}max(G)}+x_{U\text{-}max(B)})/3]$ of the input signals of the plurality of pixels satisfying expressions (1-1), (1-2), and (1-3) may be used as the first term in expression (2').

The luminance levels of the planar light source units and the duty ratios for obtaining the luminance levels of the pixels when the input signals that can take various values x (or the input signals that can take values $X_R$, $X_G$, and $X_B$ ($X_R=X_G=X_B$) for R light-emitting sub-pixels, G light-emitting sub-pixels, and B light-emitting sub-pixels) are supplied to the pixels are determined beforehand through various tests. It is desirable that various data based on the determined luminance levels and duty ratios be stored in the drive circuit. It is also desirable that various coefficients and parameters, such as $x_{max}$, $k_0$, $k_1$, $k_2$, $\alpha_0$, $\alpha_1$, $\alpha_2$, $D_{max}$, $D_0$, $D_1$, and $D_2$ be stored in the drive circuit.

In each planar light source unit forming the planar light source device, a light source other than a light-emitting diode, such as a cold cathode ray fluorescent lamp, an electroluminescence (EL) device, a cold cathode field electron emission device (FED), a plasma display device, or a regular lamp, may be used. If a light-emitting diode is used as the light source, a set of an R light-emitting diode emitting an R color having a wavelength of, for example, 640 nm, a G light-emitting diode emitting a G color having a wavelength of, for example, 530 nm, and a B light-emitting diode emitting a B color having a wavelength of, for example, 450 nm may be used for obtaining white light, or a light-emitting diode (for example, a combination of an ultraviolet or blue light-emitting diode and fluorescent particles) emitting a white color may be used. Additionally, light-emitting diodes emitting a fourth color, a fifth color, and so on, other than the R, G, and B colors may be provided.

The planar light source units forming the planar light source device may be partitioned by using barriers. In this case, one planar light source unit is surrounded by four barriers, or three barriers and one side of a housing (which is discussed below), or two barriers and two sides of the housing. It is now assumed that the planar light source unit is formed of a light-emitting diode unit (which is a combination of one R light-emitting diode, one G light-emitting diode, and one B light-emitting diode, a combination of one R light-emitting diode, two G light-emitting diodes, and a B light-emitting diode, or a combination of two R light-emitting diodes, two G light-emitting diodes, and one B light-emitting diode) emitting a white color by mixing all the colors. In this case, one planar light source unit is provided with at least one light-emitting diode or at least one white light-emitting diode.

A lens that exhibits a high level of the light intensity in the straight direction, such as a Lambertian lens, or a two-dimensional emitting structure that emits light mainly in the horizontal direction may be attached to the light-emitting portion of the light-emitting diode.

The light-emitting diode may have a so-called "face-up structure" or "flip-chip structure". That is, the light-emitting diode is composed of a substrate and a light-emitting layer formed on the substrate, and light emitting from the light-emitting layer may be output to the outside of the diode, or light emitting from the light-emitting layer may pass through the substrate and output to the outside of the diode. More specifically, the light-emitting diode has a laminated structure including a first clad layer composed of a compound semiconductor layer having a first conductive type (for example, n type) formed on the substrate, an active layer formed on the first clad layer, and a second clad layer composed of a compound semiconductor layer having a second conductive type (for example, p type) formed on the active layer. The light-emitting diode is provided with a first electrode electrically connected to the first clad layer and a second electrode electrically connected to the second clad layer. The layers forming the light-emitting diode may be composed of known compound semiconductor materials by taking the light-emitting wavelengths into consideration.

The planar light source device may include a diffusion plate, a reflection sheet, and an optical function sheet group having a diffusion sheet, a prism sheet, and a polarization conversion sheet.

A transmissive-type liquid crystal display device includes a front panel having a first transparent electrode, a rear pane having second transparent electrodes, and a liquid crystal material disposed between the front panel and the rear panel.

More specifically, the front panel includes a first substrate composed of, for example, a glass substrate or a silicon substrate, the first transparent electrode (also referred to as the "common electrode", composed of, for example, indium tin oxide (ITO)) disposed on the bottom surface of the first substrate, and a polarization film disposed on the top surface of the first substrate. In a transmissive-type color liquid crystal display device, a color filter covered with an overcoat layer composed of an acrylic resin or an epoxy resin is disposed on the bottom surface of the first substrate. The layout pattern of the color filter may be a delta, stripe, diagonal, or rectangular pattern. The first transparent electrode is formed on the overcoat layer. An alignment film is also formed on the first transparent electrode. The rear panel includes a second substrate composed of, for example, a glass substrate or a silicon substrate, switching elements formed on the top surface of the second substrate, the second transparent electrodes (also referred to as the "pixel electrodes" composed of, for example, ITO) whose electrical connection is controlled by the switching elements, and a polarization film disposed on the bottom surface of the second substrate. An alignment film is formed on the overall surface of the switching elements and the second transparent electrodes. Known components and materials can be used for the liquid crystal display devices including the transmissive-type color liquid crystal display devices. As the switching elements, three-terminal elements, such as MOS field effect transistors (FETs) or thin-film transistors (TFTs) formed on a monocrystal silicon semiconductor substrate, or two-terminal devices, such as metal-insulator-metal (MIM) elements, varistor elements, or diodes, can be used.

An area including the liquid crystal cell where the first transparent electrode and the second transparent electrode are overlapped with each other corresponds to one pixel or one sub-pixel. In a transmissive-type color liquid crystal display device, the above-described area and an R color filter transmitting R light form an R light-emitting sub-pixel (R sub-pixel) of each pixel; the above-described area and a G color filter transmitting G light form a G light-emitting sub-pixel (G sub-pixel) of each pixel; and the above-described area and a B color filter transmitting B light form a B light-emitting sub-pixel (B sub-pixel) of each pixel. The arrangement pattern of R sub-pixels, G sub-pixels, and B sub-pixels coincides with the arrangement pattern of the above-described color filters. In addition to the R, G, and B sub-pixels, the pixel may be formed of one or more pixels, such as a sub-pixel emitting white light for improving the luminance, a sub-pixel transmitting complementary color light for enlarging the color reproduction range, a sub-pixel transmitting yellow light for enlarging the color reproduction range, a sub-pixel transmitting yellow and cyan light for enlarging the color reproduction range. In this case, sub-pixels other than the R, G, and B sub-pixels are also subjected to control similar to that performed on the R, G, and B sub-pixels.

When the number of pixels disposed in a two-dimensional matrix is represented by $M_0 \times N_0$ ($M_0$, $N_0$), the specific values of ($M_0$, $N_0$) may be represented by several image display resolution levels, as indicated in Table 1, such as are VGA (640, 480), S-VGA (800, 600), XGA (1024, 768), APRC (1152, 900), S-XGA (1280, 1024), U-XGA (1600, 1200), HD-TV (1920, 1080), Q-XGA (2048, 1536), (1920, 1035), (720, 480), (1280, 960), etc., can be indicated. However, the number of pixels is not restricted to those resolution levels. The relationship between ($M_0$, $N_0$) and (P, Q) (P×Q are the number of display area units) is not restricted, but may be indicated in Table 1. The number of pixels forming one display area unit may be in a range from 20×20 to 320×240, and more preferably, from 50×50 to 200×200. The number of pixels forming one display area unit may be the same or different depending on the display area units.

TABLE 1

| | P | Q |
|---|---|---|
| VGA (640, 480) | 2~32 | 2~24 |
| S-VGA (800, 600) | 3~40 | 2~30 |
| XGA (1024, 768) | 4~50 | 3~39 |
| APRC (1152, 900) | 4~58 | 3~45 |
| S-XGA (1280, 1024) | 4~64 | 4~51 |
| U-XGA (1600, 1200) | 6~80 | 4~60 |
| HD-TV (1920, 1080) | 6~86 | 4~54 |
| Q-XGA (2048, 1536) | 7~102 | 5~77 |
| (1920, 1035) | 7~64 | 4~52 |
| (720, 480) | 3~34 | 2~24 |
| (1280, 960) | 4~64 | 3~48 |

A drive circuit for driving the liquid crystal display device and the planar light source device includes a planar light source device control circuit having an LED drive circuit, a computation circuit, a storage unit (memory), etc., and a liquid crystal display device drive circuit having known circuits, such as a timing controller. The luminance (display luminance) of the display area corresponding to the pixels or sub-pixels or the luminance (light source luminance) of the planar light source units is controlled for each image display frame. The number of image information items transmitted to the drive circuit per second as an electric signal is the frame frequency (frame rate), and the reciprocal of the frame frequency is the frame time (second).

The light transmittance (also referred to as the "aperture ratio") Lt of a pixel or a sub-pixel, the luminance (display luminance) y of a display area corresponding to a pixel or a sub-pixel, and the luminance (light source luminance) Y of the planar light source unit are defined as follows. The maximum value $x_{max}$ of input signals input into the drive circuit for driving the pixels is the maximum value designed for the input signals. The value of a control signal corresponding to the input signal having the value x is represented by X, and the coefficients for the control signal corresponding to the coefficients $k_0$, $k_1$, and $k_2$ for the input signal are represented by $K_0$, $K_1$, and $K_2$, respectively.

$Y_{max}$: maximum light source luminance (constant) in planar light source units $Y_{Std}$: light source luminance (constant) of a known planar light source device illuminating the overall display area of a liquid crystal device with uniform and constant illumination $Y_{Std}<Y_{max}$ $Lt_{max}$: light transmittance (aperture ratio) of a pixel (or a sub-pixel) of a display area unit, assuming that a control signal corresponding to an input signal having the maximum value $Y_{max}$ is supplied to the pixel (or the sub-pixel)

$Y_{max}$: display luminance of a pixel when the light source luminance is $Y_{max}$, assuming that a control signal corresponding to an input signal having a value (for example, $x_{U\text{-}max}+k_0 \cdot x_{max}$) greater than the value $x_{U\text{-}max}$ of the input signal is supplied to the pixel $y'_{max}$: display luminance of a pixel when the light source luminance is $Y_{Std}$, assuming that a control signal corresponding to an input signal having a value $x'_{U\text{-}max}$ is supplied to the pixel $y''_{max}$: display luminance of a pixel when the light source luminance is $Y_{Std}$, assuming that a control signal corresponding to an input signal having a value $k_2 \cdot x_{max}$ is supplied to the pixel Lt $[X/X_{MAX}]$: normalized light transmittance (aperture ratio) of a pixel (or a sub-pixel), assuming that a control signal X corresponding to an input signal having the value x is supplied to the pixel (or the sub-pixel), where $X_{MAX}$ takes $X_{max}$ or $(1+K_0)X_{max}$ by being dependent on X $Y_{Mdfy}$: luminance of a planar light source unit controlled by the drive circuit Y": light source luminance when the display luminance $y''_{max}$ is obtained with $Lt[K_2 \cdot X_{max}/X_{max}]$ It is now assumed that the quantity of light input into a pickup tube is indicated by $y_{in}$, and that the value of an input signal, which is an output signal from the pickup tube, for example, output from a broadcasting station and input into the drive circuit for controlling the light transmittance of pixels is indicated by x, and that the display luminance of a pixel, assuming that a control signal X corresponding to the input signal is supplied to the pixel is indicated by y. In this case, the input signal value x can be represented by a function of the input light quantity Yin with the power of 0.45, i.e., $y_{in}^{0.45}$, and the control signal value X or the display luminance y can be represented by a function of the input signal x with the power of 2.2, i.e., $x^{2.2}$. The relationship between the display luminance y and the function of the input signal x is referred to as the gamma (γ) characteristic, which can be expressed by:

$$y=x^{2.2}=(y_{in}^{0.45})^{2.2}=y_{in}.$$

In this manner, a system from a broadcasting station to a television receiver or from a video playback device to a television receiver is constructed so that an image captured by a pickup tube can be precisely reconstructed. In accordance with the control of the light source luminance of planar light source units, the correction for the light transmittance of the pixels forming the associated display area units may be necessary.

In the following description, for the sake of convenience, a display area unit having a pixel that satisfies expression (1) or simultaneously satisfies expressions (1-1), (1-2), and (1-3) is referred to as a "display luminance unit that achieves increased luminance", and a planar light source unit corresponding to such a display area unit is referred to as a "planar light source unit that achieves increased luminance". In contrast, a display area unit without any pixel that satisfies expression (1) or having a pixel that satisfies only part of expressions (1-1), (1-2), and (1-3) is referred to as a "display area unit that does not achieve increased luminance", and a planar light source unit corresponding such a display area unit is referred to as a "planar light source unit that does not achieve increased luminance".

If $y_{max}$, $y'_{max}$, and $y''_{max}$ are represented based on the above-described equation (A), the following equations hold true.

$$y_{max}=Y_{max}**Lt[(X_{U\text{-}max}+K_0 \cdot X_{max})/\{(1+K_0)X_{max})$$

$$y'_{max}=Y_{Std}**Lt[X'_{U\text{-}max}/X_{max})]$$

$$y''_{max}=Y_{Std}**Lt[K_2 \cdot X_{max})/X_{max})]$$

According to the first or second drive method for the liquid crystal display device assembly, in each of the display area units, when the value x of an input signal for any of the pixels forming the display area unit is greater than or equal to a predetermined value (e.g., $k_1 \cdot x_{max}$), the value of the input signal being indicated by $x_{U\text{-}max}$, the luminance level of the planar light source unit that achieves increased luminance corresponding to the display area unit may be controlled by the drive circuit so that luminance levels of the pixels, assuming that the control signal corresponding to the input signal having a value (e.g., $x_{U\text{-}max}+k_0 X_{max}$) greater than the value $x_{U\text{-}max}$ is supplied to the pixels, can be obtained. In this case, any one of the following three control modes can be employed.

Control Mode 1A

In the control mode 1A, the light source luminance of a planar light source unit that achieves increased luminance is set to be, for example, $Y_{max}$, regardless of the input signal value $x_{U\text{-}max}$. Then, the light transmittance (aperture ratio) $Lt_{Mdfy}$ of the pixel exhibiting the maximum luminance (pixel (A)) to which the control signal corresponding to the input signal value $x_{U\text{-}max}$ is supplied is set to be a value so that the display luminance $y_{max}$ can be obtained. More specifically, although the original light transmittance (aperture ratio) of the pixel is $Lt[X/X_{MAX}]$ when the input signal value is x, in the control mode 1A, it is corrected to $Lt_{Mdfy}$ for each image display frame under the control of the drive circuit. More specifically, when the input signal value is $x_{U\text{-}max}$, the light transmittance of the pixel is set to be:

$$Lt[(x_{U\text{-}max}+K_0 \cdot X_{max})/\{1+K_0)X_{max}\}] \quad (11).$$

Control Mode 1B

In the control mode 1B, the luminance of a planar light source unit that achieves increased luminance is increased in accordance with an increase in the input signal value $x_{U\text{-}max}$. More specifically, the light source luminance $Y_{Mdfy}$ is set to be a value for each image display frame under the control of the drive circuit so that the display luminance $Y_{max}$ can be obtained when the light transmittance is $Lt[X_{U\text{-}max}/X_{max}]$ (see equation (12)).

$$Y_{Mdfy}  Lt\left[\frac{X_{U-max}}{X_{max}}\right] = Y_{max}  Lt\left[\frac{\left(\begin{array}{c} X_{U-max} + \\ K_0 \cdot X_{max} \end{array}\right)}{\{1+K_0)X_{max}\}}\right] \quad (12)$$

In the control mode 1B, although the light source luminance $Y_{Mdfy}$ of the planar light source unit that achieves increased luminance is controlled, the light transmittance (aperture ratio) of the pixels forming the display area unit is not changed or corrected. That is, the light transmittance of the pixel is $Lt[X/X_{max}]$ when the input signal value is x.

Control Mode 1C

In the control mode 1C, the light transmittance (aperture ratio) of the pixel exhibiting the maximum luminance (pixel A) forming a display area unit that achieves increased luminance is set to be constant $Lt_{max}$ regardless of the input signal value $x_{U\text{-}max}$, and a planar light source unit that achieves increased luminance is controlled so that a desired level of the display luminance can be obtained. More specifically, in this case, the light source luminance $Y_{Mdfy}$ is set to be a value for each image display frame under the control of the drive circuit so that the display luminance $Y_{max}$ can be obtained when the light transmittance is $Lt_{max}$ (see equation (13)).

$$Y_{Mdfy}  Lt_{max} = Y_{max}  Lt\left[\left(\begin{array}{c} X_{U-max} + \\ K_0 \cdot X_{max} \end{array}\right) \Big/ \{1+K_0)X_{max}\}\right] \quad (13)$$

In the control mode 1C, the light source luminance $Y_{Mdfy}$ of a planar light source unit that achieves increased luminance is controlled, and the light transmittance (aperture ratio) of the pixels forming a display area unit that achieves increased luminance is also corrected.

In the first driving method for the liquid crystal display device, in each display area unit, if the input signal value x for all the pixels forming the display area unit does not satisfy expression $x \geqq k_1 \cdot x_{max}$ (1), the luminance of all the planar light source units that do not achieve increased luminance corresponding to such display area units is set to be constant. That is, if there are a plurality of display area units that do not achieve increased luminance, the luminance of planar light source units corresponding to the display area units are set to be the same. When controlling the luminance of planar light source units corresponding to display area units that do not achieve increased luminance, the following control mode can be employed.

Control Mode 2A

In the control mode 2A, as in the related art, the light source luminance of planar light source units that do not achieve increased luminance is set to be, for example, $Y_{Std}$, for each image display frame. In the control mode 2A, the light transmittance itself of the pixels forming the display area unit is not changed or corrected in response to the control for the light source luminance $Y_{Std}$ of a planar light source unit that does not achieve increased luminance. The light source luminance $Y_{Std}$ is constant regardless of the input signal value.

In the second driving method for the liquid crystal display device, in each display area unit, if the input signal value x for all the pixels forming the display area unit does not satisfy expression $x \geqq k_1 \cdot x_{max}$ (1), the luminance of the planar light source unit corresponding to the display area unit is controlled by the drive circuit so that the luminance of a pixel, assuming that a control signal corresponding to an input signal having a value equal to $x'_{U\text{-}max}$, which is the maximum value of the input signals input into the drive circuit for driving all the pixels forming the display area unit, is supplied to the pixel, can be obtained. In this case, the following control mode can be employed.

Control Mode 2B

In the control mode 2B, the light transmittance (aperture ratio) of the pixel exhibiting the maximum luminance (pixel B) forming a display area unit that does not achieve increased luminance is set to be constant $Lt_{max}$ regardless of the input signal value $x'_{U\text{-}max}$. The planar light source unit that does not achieve increased luminance is controlled so that a desired level of the display luminance can be obtained in the associated display area unit. More specifically, the light source luminance $Y_{Mdfy}$ is set to be a value for each image display frame under the control of the drive circuit so that the display luminance $Y'_{max}$ can be obtained when the light transmittance is $Lt_{max}$ (see equation (14)).

$$Y_{Mdfy}  Lt_{max} = Y_{Std}  Lt[X'_{U-max} / X_{max}] \quad (14)$$

In the control mode 2B, the light source luminance $Y_{Mdfy}$ of a planar light source unit that does not achieve increased luminance is controlled, and the light transmittance (aperture ratio) of pixels forming the associated display area unit is also corrected.

In the second driving method for the liquid crystal display device, if $x'_{U\text{-}max} \leqq k_2 \cdot x_{max}$ (3) holds true, the following control mode can be employed.

Control Mode 2C

In the control mode 2C, the light source luminance of a planar light source unit that does not achieve increased luminance corresponding to a display area unit that satisfies expression (3) is set to be a constant value Y" regardless of the input signal value $x'_{U\text{-}max}$ of the input signal that satisfies expression (3). In this case, the light transmittance $Lt_{Mdfy}$ of the pixel exhibiting the maximum luminance (pixel B) forming the display area unit is set to be a value so that the display luminance $y''_{max}$ can be obtained. More specifically, when the input signal value is x, the original light transmittance (aperture ratio) of pixels is $Lt\ [X/X_{max}]$. In the control mode 2C, however, the light transmittance of the pixels is corrected to $Lt_{Mdfy}$ for each image display frame under the control of the drive circuit. More specifically, when the input signal value is $x'_{U\text{-}max}$, the light transmittance of the pixels is set to be:

$$Lt[X'_{U\text{-}max}/\{(K_2 \cdot X_{max})/X_{max}\}] \quad (15)$$

Combinations of control modes that can be used in the first and second driving methods are as follows.

First driving method

Control mode 1A and control mode 2A

Control mode 1B and control mode 2A

Control mode 1C and control mode 2A

Second driving method

Control mode 1A and control mode 2B

Control mode 1A, control mode 2B, and control mode 2C

Control mode 1B and control mode 2B

Control mode 1B, control mode 2B, and control mode 2C

Control mode 1C and control mode 2B

Control mode 1C, control mode 2B, and control mode 2C

In the first driving method according to an embodiment of the present invention, for controlling the light transmittance of each pixel forming each display area unit, when the input signal value x input into the drive circuit is greater than or equal to the upper limit threshold $k_1 \cdot x_{max}$, which is obtained by multiplying the input signal maximum value $x_{max}$ with $k_1$ ($k_1<1$), the luminance of a planar light source unit corresponding to the display area unit that achieves increased luminance is controlled (increased) by the drive circuit so that the luminance of a pixel, assuming that a control signal corresponding to an input signal having a value obtained by adding a bias $k_0 \cdot x_{max}$ to the input signal value $x_{U\text{-}max}$ is supplied to the pixel, can be obtained. Accordingly, the luminance of the display area unit including a display portion (also referred to as a "white display portion" including pixels to which a control signal corresponding to an input signal greater than or equal to the upper limit threshold is supplied) can be increased to a level higher than the luminance of other display area units (none of the pixel values X forming such display area units does not exceed the upper limit threshold). As a result, the white brightness similar to that obtained by a CRT can be achieved.

In the second driving method according to another embodiment of the present invention, the white brightness similar to that obtained by a CRT can also be achieved. Additionally, if, in each planar light source unit, the input signal value x for all the pixels does not exceed the upper limit threshold, the luminance of a planar light source unit corresponding to the display area unit that does not achieve increased luminance is increased or decreased by the drive circuit so that the luminance of a pixel, assuming that a control signal corresponding to an input signal having a value equal to the maximum value $x'_{U\text{-}max}$ of the input signals input into the drive circuit for driving all the pixels forming a display area unit that does not achieve increased luminance is supplied to the pixel, can be obtained. As a result, the contrast ratio can further be enhanced.

DESCRIPTION OF THE PREFERRED EMBODIMENTS

Before describing the present invention in detail below with reference to the accompanying drawings through illustration of preferred embodiments, overviews of a transmissive-type color liquid crystal display device, a planar light source device, and a drive circuit that can be suitably used in the embodiments are discussed first with reference to FIGS. 24 through 27.

Figure 24:
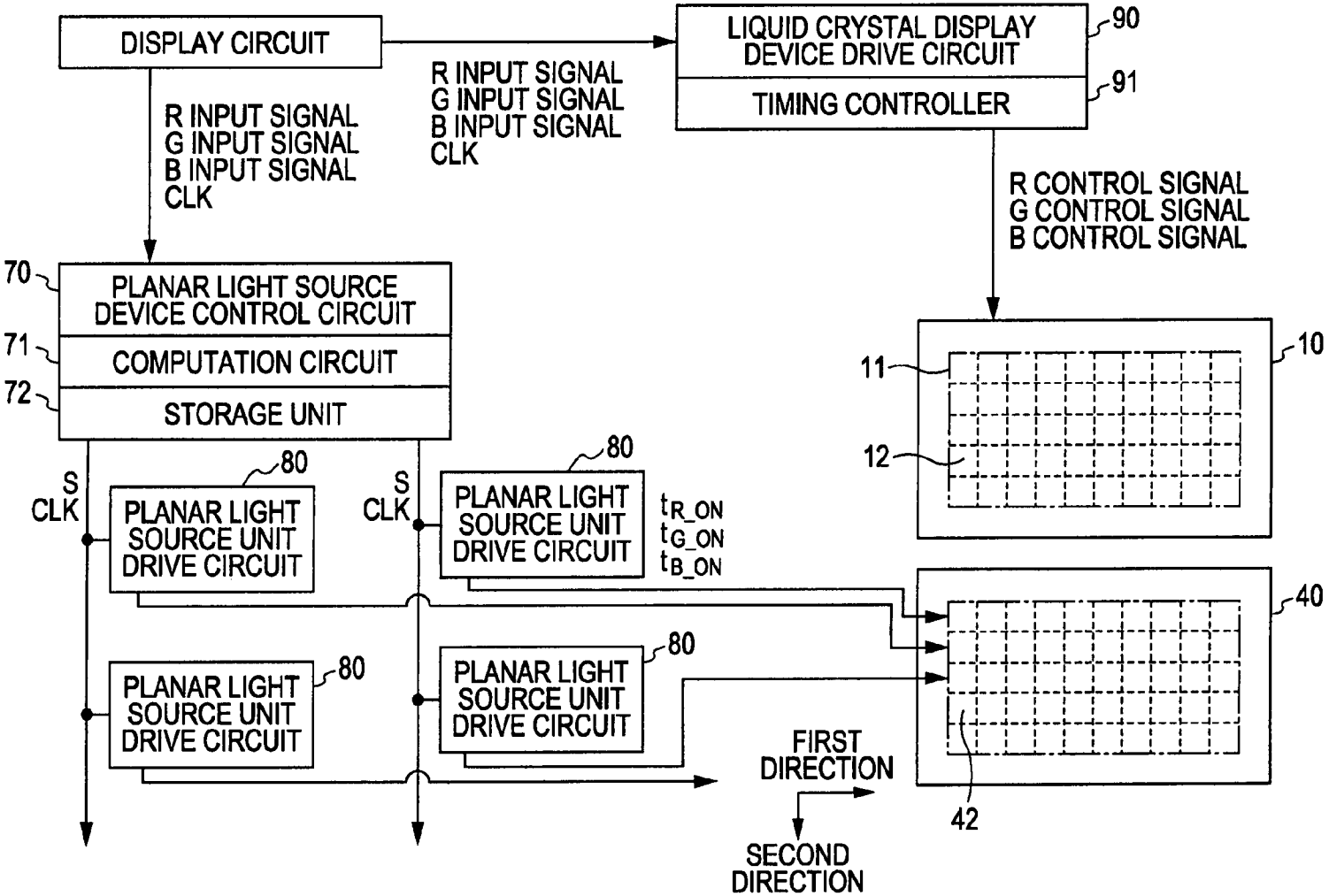
FIG. 24 illustrates the concept of a color liquid crystal display device assembly including a color liquid crystal display device and a planar light source device suitably used in the embodiments.

FIG. 24 illustrates the concept of a color liquid crystal display device 10 used in the embodiments. The color liquid crystal display device 10 includes a display area 11 in which $M_0$ pixels are extended in a first direction and $N_0$ pixels are extended in a second direction, i.e., a total of $M_0 \times N_0$ pixels are two-dimensionally disposed in a matrix. More specifically, the pixels exhibit an image display resolution satisfying high-definition television (HD-TV) standards, and the numbers $M_0$ and $N_0$ of pixels are, for example, 1920 and 1080, respectively. The display area 11, indicated by the one-dot-chain line, including the $M_0 \times N_0$ pixels are divided into P×Q virtual display area units 12, the boundaries of which are indicated by the broken lines. The numbers P and Q are, for example, 19 and 12. For the simplicity of FIG. 24, however, the number of display area units 12 (and the number of planar light source units 42 described below) shown in FIG. 24 is different from 19×12. Each display area unit 12 is formed of a plurality of (M×N) pixels, for example, 10,000 pixels. Each pixel is formed of a plurality of sub-pixels emitting different colors. More specifically, each pixel is formed of three sub-pixels, i.e., a red light-emitting sub-pixel (R sub-pixel), a green light-emitting sub-pixel (G sub-pixel), and a blue light-emitting sub-pixel (B sub-pixel). The transmissive-type color liquid crystal display device 10 is line-sequentially driven. More specifically, the color liquid crystal display device 10 includes scanning electrodes (extending in the first direction) and data electrodes (extending in the second direction) that intersect with each other in a matrix. The color liquid crystal display device 10 inputs scanning signals into the scanning electrodes to select the scanning electrodes and scan the pixels, and then displays an image on the basis of a data signal (corresponding to a control signal) input into the data electrodes, thereby forming one frame.

Figure 27:
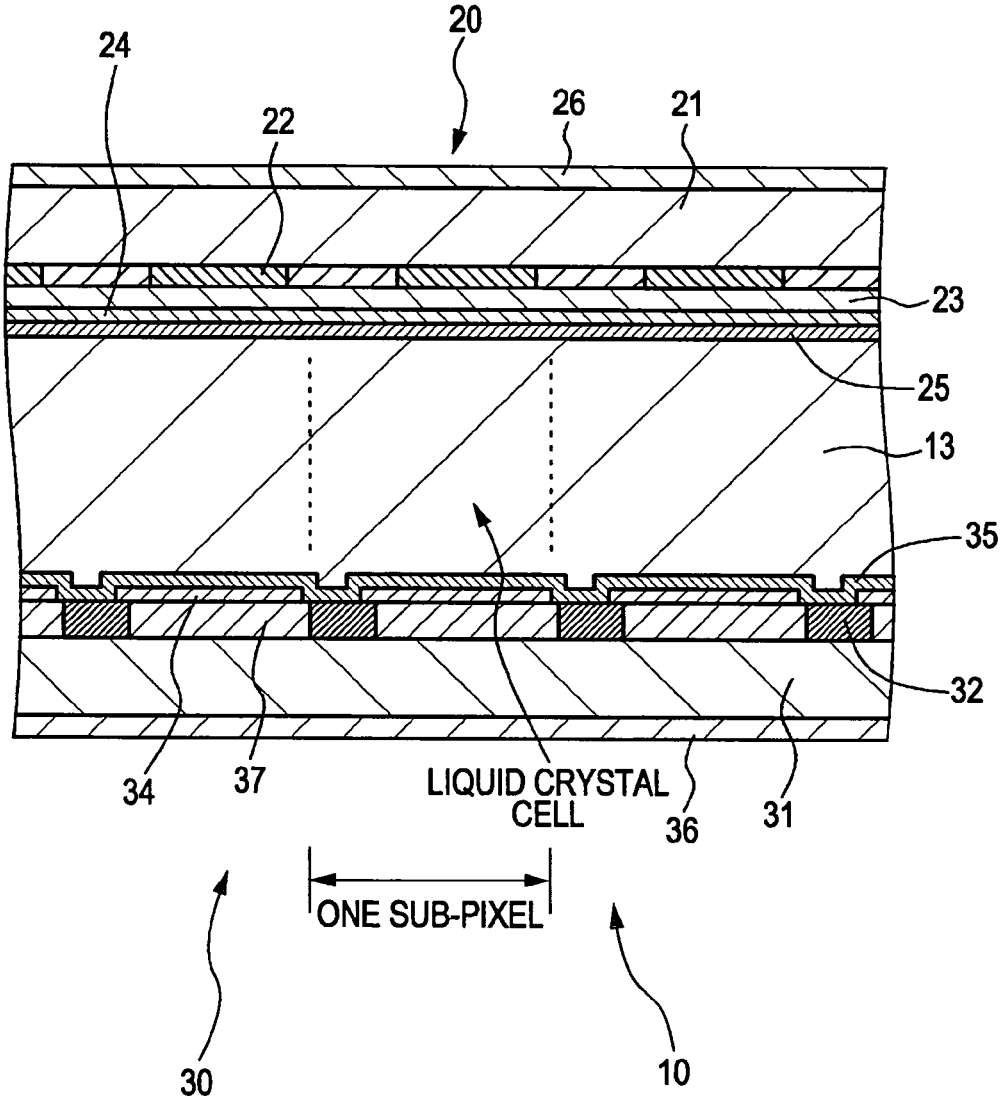
FIG. 27 is a partially sectional view schematically illustrating a color liquid crystal display device.
Figure 28A:
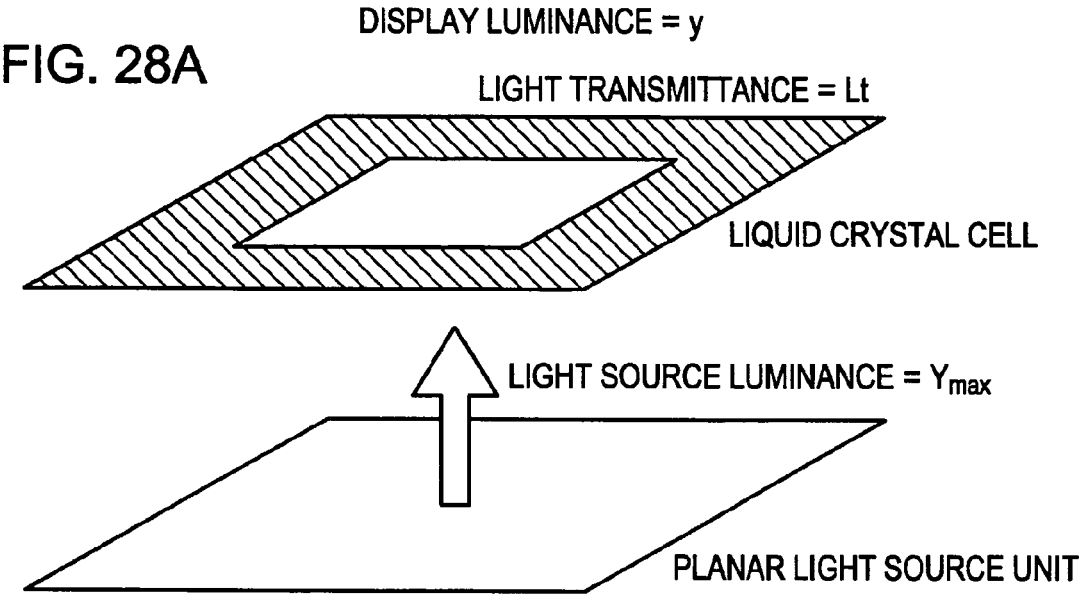
FIGS. 28A and 28B illustrate the concept of the relationship among the light source luminance of a planar light source device, the light transmittance (aperture ratio) of pixels, and the display luminance of a display area in a known color liquid crystal display device assembly.
Figure 28B:
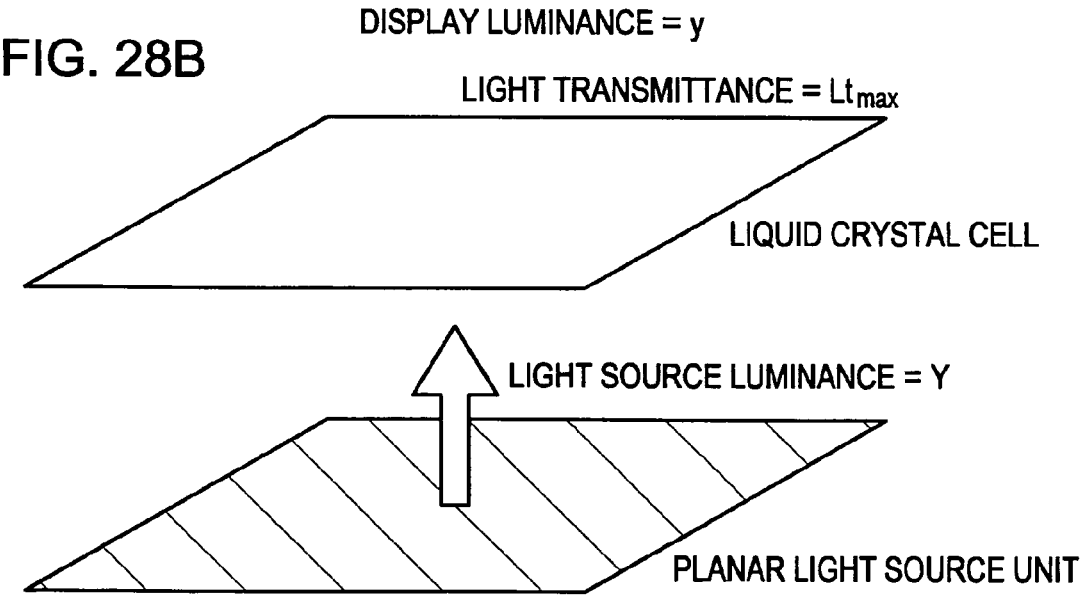
Figure 29:
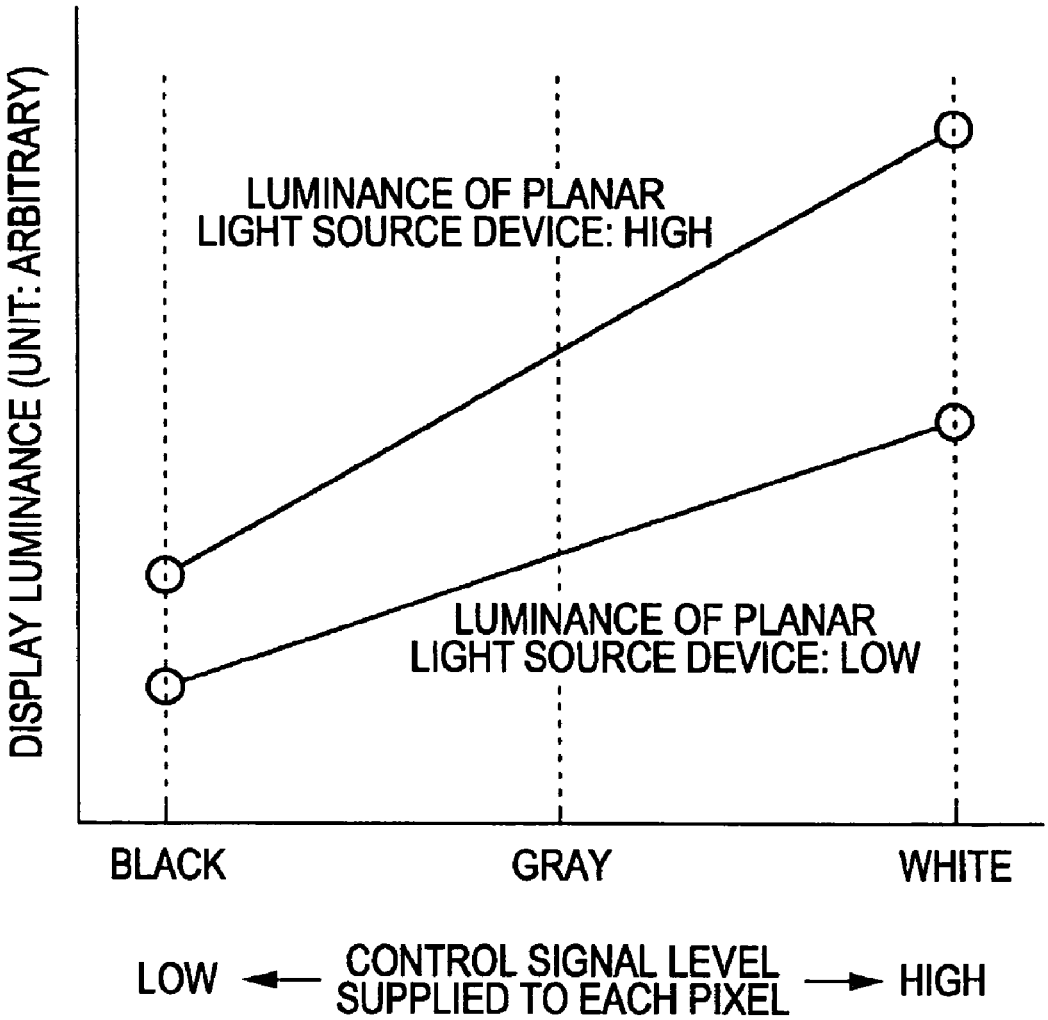
FIG. 29 is a diagram schematically illustrating the relationship between the control signal level and the display luminance, which is the luminance of pixels, in a known color liquid crystal display device assembly.

The color liquid crystal display device 10 includes, as shown in the partially sectional view in FIG. 27, a front panel 20 provided with a first transparent electrode 24, a rear panel 30 provided with second transparent electrodes 34, and a liquid crystal material 13disposed between the front panel 20 and the rear panel 30.

The front panel 20 includes a first substrate 21 composed of, for example, a glass substrate, and a polarization film 26 disposed on the top surface of the first substrate 21. A color filter 22 covered with an overcoat layer 23 composed of, for example, an acrylic resin or an epoxy resin, is disposed on the bottom surface of the first substrate 21. The first transparent electrode (common electrode) 24, which is composed of, for example, indium tin oxide (ITO), is formed under the overcoat layer 23, and an alignment film 25 is formed under the first transparent electrode 24. The rear panel 30 includes a second substrate 31 composed of, for example, a glass substrate, switching elements (more specifically, thin film transistors (TFTs)) 32 formed on the top surface of the second substrate 31, the second transparent electrodes (also referred to as the "pixel electrodes" composed of, for example, ITO) 34 whose electrical connection is controlled by the switching elements 32, and a polarization film 36 disposed on the bottom surface of the second substrate 31. An alignment film 35 is formed on the overall surface of the switching elements 32 and the second transparent electrodes 34. The front panel 20 and the rear panel 30 are bonded to each other with a sealing material (not shown) therebetween at the outer peripheries of the front panel 20 and the rear panel 30. The switching elements 32 are not restricted to TFTs, and may be metal-insulator-metal (MIM) elements. An insulating layer 37 is also formed between the switching elements 32 for insulating them from each other.

Known components and material may be used for forming this transmissive-type color liquid crystal display device 10, and thus, a detailed explanation thereof is omitted here.

Figure 26A:
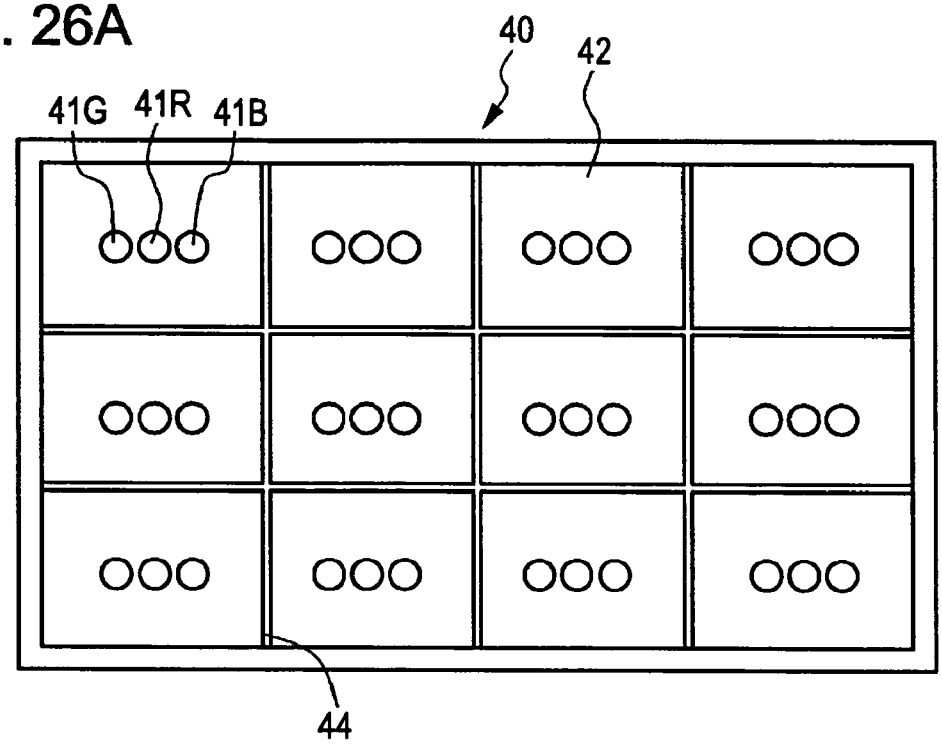
FIG. 26A schematically illustrates the arrangement of light-emitting diodes in the planar light source device.
Figure 26B:
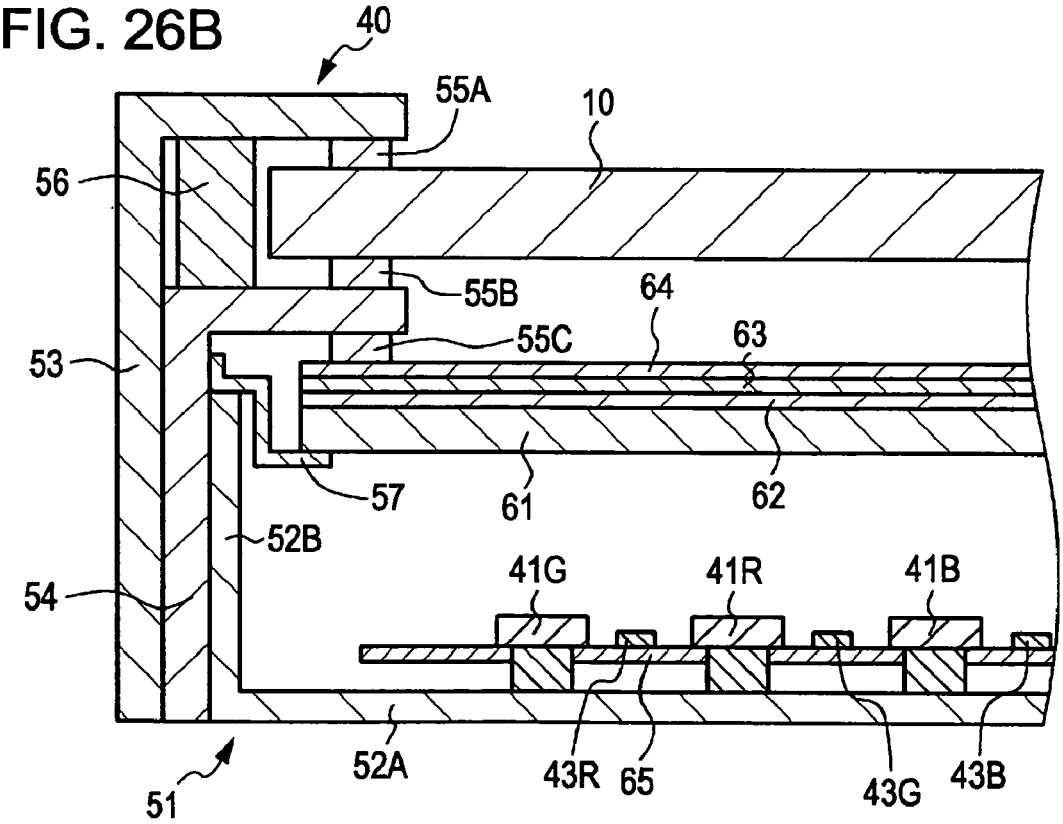
FIG. 26B is a partially sectional view schematically illustrating a color liquid crystal display device assembly including a color liquid crystal display device and a planar light source device.

A direct-lighting-type planar light source device (backlight) 40 includes the P×Q planar light source units 42 corresponding to the P×Q virtual display area units 12, and each planar light source unit 42 illuminates the display area unit 12 associated with the planar light source unit 42 from the back surface. The light sources provided for the planar light source units 42 are individually controlled. In FIG. 24, the color liquid crystal display device 10 and the planar light source device 40 are separately shown, i.e., the planar light source device 40 is disposed below the color liquid crystal display device 10. The arrangement of light-emitting diodes 41 including an R light-emitting diode 41R, a G light-emitting diode 41G, and a B light-emitting diode 41B in the planar light source device 40 is schematically shown in FIG. 26A, and the partially sectional view of a color liquid crystal display device assembly including the planar light source device 40 and the liquid crystal display device 10 is shown in FIG. 26B. The light sources include the light-emitting diodes 41 that are driven according to a pulse width modulation (PWM)

control method. The luminance of the planar light source unit 42 is increased or decreased by increasing or decreasing the duty ratio in the PWM control performed for the light-emitting diodes 41 used in the planar light source unit 42.

The planar light source device 40 is formed of, as shown in the partially sectional view in FIG. 26B, a housing 51 including an outer frame 53 and an inner frame 54. The end of the color liquid crystal display device 10 is held by the outer frame 53 and the inner frame 54 such that it is sandwiched between the outer frame 53 and the inner frame 54 with spacers 55A and 55B therebetween. A guide member 56 is disposed between the outer frame 53 and the inner frame 54 such that the color liquid crystal display device 10 sandwiched between the outer frame 53 and the inner frame 54 is not displaced. Inside the housing 51 and toward the top of the housing 51, a diffusion plate 61 is fixed to the inner frame 54 with a spacer 55C and a bracket member 57 therebetween. An optical function sheet group having a diffusion sheet 62, a prism sheet 63, and a polarization conversion sheet 64, is laminated on the diffusion plate 61.

A reflection sheet 65 is disposed inside the housing 51 and toward the bottom of the housing 51. The reflection sheet 65 is disposed such that its reflection surface opposes the diffusion plate 61, and is fixed to a bottom surface 52A of the housing 51 with a fixing member (not shown). The reflection sheet 65 is formed of, for example, a silver reflection-enhancing film having a structure in which a silver reflection film, a low-refractive-index film, and a high-refractive-index film are sequentially laminated on a sheet substrate. The reflection sheet 65 reflects light emitted from the plurality of light-emitting diodes 41 or light reflected by a side surface 52B of the housing 51 or by barriers 44 shown in FIG. 26A. In this manner, R light, G light, and B light emitted from the R light-emitting diode 41R, the G light-emitting diode 41G, and the B light-emitting diode 41B, respectively, are mixed so that white light having high color purity can be obtained as illumination light. The illumination light passes through the diffusion plate 61 and the optical function sheet group having the diffusion sheet 62, the prism sheet 63, and the polarization conversion sheet 64, and illuminates the color liquid crystal display device 10 from the back surface.

Photodiodes 43R, 43G, and 43B, which are optical sensors, are disposed in the vicinity of the bottom surface 52A of the housing 51. The photodiode 43R is a photodiode provided with an R color filter for measuring the light intensity of R light; the photodiode 43G is a photodiode provided with a G color filter for measuring the light intensity of G light; and the photodiode 43B is a photodiode provided with a B color filter for measuring the light intensity of B light. One set of optical sensors (photodiodes 43R, 43G, and 43B) is disposed in one planar light source unit 42.

The arrangement of the light-emitting diodes 41R, 41G, and 41B is such that a plurality of light-emitting diode units, each unit having the R light-emitting diode 41R emitting R color light having a wavelength of, for example, 640 nm, and the G light-emitting diode 41G emitting G color light having a wavelength of, for example, 530 nm, and the G light-emitting diode 41B emitting B color light having a wavelength of, for example, 450 nm, are disposed in the horizontal direction and in the vertical direction.

The planar light source units 42 can be divided from the planar light source device 40 by the barriers 44 that mask illumination light emitted from the planar light source units 42 (more specifically, light emitted from the light-emitting diodes 41). The luminance of each planar light source unit 42 is not influenced by adjacent planar light source units 42.

Figure 25:
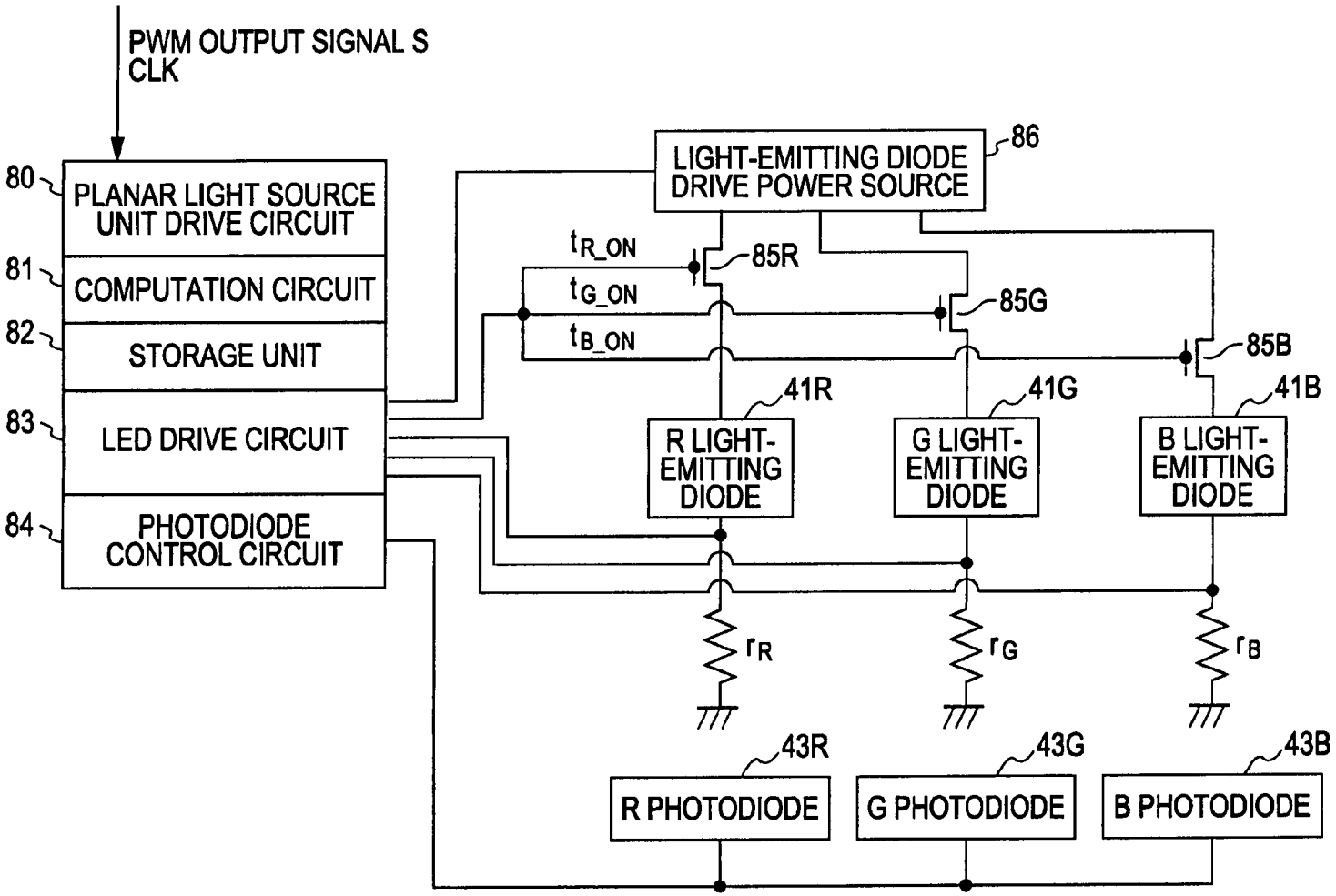
FIG. 25 illustrates the concept of part of a drive circuit suitably used in the embodiments.

A drive circuit for driving the planar light source device 40 and the color liquid crystal display device 10 on the basis of an input signal from an external source (display circuit) includes, as shown in FIGS. 24 and 25, a planar light source device control circuit 70, planar light source unit drive circuits 80, and a liquid crystal display device drive circuit 90. The planar light source device control circuit 70 and the planar light source unit drive circuits 80 perform ON/OFF control on the R light-emitting diodes 41R, the G light-emitting diodes 41G, and the B light-emitting diodes 41B according to the PWM control method. The planar light source device control circuit 70 includes a computation circuit 71 and a storage unit (memory) 72. The planar light source unit drive circuit 80 includes a computation circuit 81, a storage unit (memory) 82, a light-emitting diode (LED) drive circuit 83, a photodiode control circuit 84, switching elements 85R, 85G, and 85B, which are field effect transistors (FETs), and a light-emitting diode drive power source (constant current source) 86. Known circuits can be used as the circuits forming the planar light source device control circuit 70 and the planar light source unit drive circuit 80. The liquid crystal device drive circuit 90 for driving the color liquid crystal display device 10 includes a known circuit, such as a timing controller 91. The color liquid crystal display device 10 is provided with a gate driver and a source driver (neither of them is shown) for driving the switching elements 32, which are TFTs, forming the liquid crystal cells. To control the light emission conditions of the light-emitting diodes 41R, 41G, and 41B, the following feedback mechanism is constructed. The light emission conditions of the light-emitting diodes 41R, 41G, and 41B in a certain image display frame are measured by the photodiodes 43R, 43G, and 43B, respectively, and outputs of the photodiodes 43R, 43G, and 43B are input into the photodiode control circuit 84. Then, the photodiode control circuit 84 and the computation circuit 81 convert the outputs of the photodiodes 43R, 43G, and 43B into data (signal) indicating the luminance and the chromaticity of the light-emitting diodes 41R, 41G, and 41B. The data is then sent to the LED drive circuit 83, and the LED drive circuit 83 controls the light emission conditions of the light-emitting diodes 41R, 41G, and 41B in the subsequent image display frame. Current-detecting resistors $R_R$, $R_G$, and $R_B$ are inserted downstream of the light-emitting diodes 41R, 41G, and 41B, respectively, in series with the light-emitting diodes 41R, 41G, and 41B. The operation of the light-emitting diode drive power source 86 is controlled by the LED drive circuit 83 so that currents flowing in the current-detecting resistors $R_R$, $R_G$, and $R_B$ are converted into voltages and so that voltage drops in the current-detecting resistors $R_R$, $R_G$, and $R_B$ can be predetermined values. Although only one light-emitting diode drive power source (constant current source) 86 is shown in FIG. 25, a plurality of light-emitting diode drive power sources 86 for driving the light-emitting diodes 41R, 41G, and 41B are disposed.

As described above, the display area 11 including two-dimensionally disposed pixels are divided into P×Q display area units 12. If the display state is represented by using rows and columns, the display area 11 is divided into Q-row×P-column display area units 12. Each display area unit 12 includes M×N pixels. If the display state is represented by using rows and columns, the display area unit 12 is divided into N-row×M-column pixels. The R light-emitting sub-pixels (R sub-pixel), the G light-emitting sub-pixels (G sub-pixel), and the B light-emitting sub-pixels (B sub-pixel) may be collectively referred to as the "R, G, and B sub-pixels". An R light-emitting sub-pixel control signal, a G light-emitting sub-pixel control signal, and a B light-emitting sub-pixel control signal for controlling the operations of the R, G, and B sub-pixels (more specifically, controlling the light transmittances (aperture ratio)) may be collectively referred to as the "R, G, and B control signals", and an R light-emitting sub-pixel input signal, a G light-emitting sub-pixel input signal, and a B light-emitting sub-pixel input signal that are externally input into the drive circuit to drive the R, G, and B sub-pixels R, respectively, forming the display area unit 12 may be collectively referred to as the "R, G, and B input signals". As the transmission method for the input signals, a low voltage differential signaling (LVDS) method may be used. In the LVDS method, a parallel signal is converted into a low voltage differential serial signal, and then, the converted serial signal is transmitted. With this method, noise and extraneous emission can be reduced, and the number of transmission lines can also be reduced. However, the signal transmission method is not restricted to the LVDS method, and another method, for example, a low voltage transistor-transistor logic (LVTTL) method, may be employed.

One set of R, G, and B sub-pixels form one pixel. In the following description of the embodiments, the luminance control (grayscale control) for each of R, G, and B sub-pixels is performed by 8-bit control in $2^8$ (0 to 255) steps. Accordingly, each of the R, G, and B input signals $x_R$, $x_G$, and $x_B$ input into the liquid crystal display drive circuit 90 to drive the R, G, and B sub-pixels, respectively, forming each pixel also takes $2^8$ (0 to 255) levels. Each of PWM output signals $S_R$, $S_G$, and $S_B$ for controlling the emission times of the R light-emitting diode 41R, the G light-emitting diode 41G, and the B light-emitting diode 41B, respectively, also takes $2^8$ (0 to 255) levels. However, the control method is not restricted to 8-bit control, and may be 10-bit control in $2^{10}$ (0 to 1023) levels, in which case, 8-bit numeric values can be increased by four times.

A control signal for controlling the light transmittance Lt of each pixel is supplied to the corresponding pixel from the drive circuit. More specifically, R, G, and B control signals for controlling the light transmittances Lt of the R, G, and B sub-pixels are respectively supplied to the R, G, and B sub-pixels from the liquid crystal display device drive circuit 90. That is, the liquid crystal display device drive circuit 90 generates R, G, and B control signals from the R, G, and B input signals, respectively, and supplies (outputs) the generated R, G, and B control signals to the R, G, and B sub-pixels, respectively. If necessary, the light source luminance Y of the planar light source unit 42 is changed for each image display frame. Accordingly, the R, G, and B control signals are equal to values $X_{R\text{-}corr}$, $X_{G\text{-}corr}$, and $X_{B\text{-}corr}$, respectively, obtained by correcting the R, G, and B input signals $x_R$, $x_G$, and $X_B$ with the power of 2.2 (i.e., $x_R^{2.2}$, $x_G^{2.2}$, and $x_B^{2.2}$), respectively, on the basis of a change in the light source luminance Y. Then, the R, G, and B control signals are output to the gate driver and the source driver of the color liquid crystal display device 10 from the timing controller 91 forming the liquid crystal display device drive circuit 90 according to a known method, and then drive the switching elements 32 forming the sub-pixels. As a result, a desired voltage is applied to the first transparent electrode 24 and the second transparent electrode 34 forming the liquid crystal cell so that the light transmittance (aperture ratio) Lt of each sub-pixel can be controlled. In this case, as the values $X_{R\text{-}corr}$, $X_{G\text{-}corr}$, and $X_{B\text{-}corr}$ of the R, G, and B control signals are greater, the light transmittances Lt of the R, G, and B sub-pixels become higher, and the luminance levels (display luminance y) of the display portions corresponding to the R, G, and B sub-pixels become higher. That is, an image (normally, dot-like shape) formed by light passing through such R, G, B sub-pixels is brighter.

The control for the display luminance y and the light source luminance Y is performed for each image display frame in image display of the color liquid crystal display device 10, each display area unit 12, or each planar light source unit 42. The operation of the color liquid crystal display device 10 and the operation of the planar light source device 40 in one image display frame can be synchronized.

First Embodiment

In a first embodiment, a driving method for a liquid crystal display device assembly is described. Specific values of various parameters used in the first through ninth embodiments are defined as follows.

$x_{max}=256$ $k_0=0.125$ $k_1=0.9375$ $k_1 \cdot x_{max}=240$ $k_0 \cdot x_{max}=32$ $k_2=0.485$ $\alpha_0=1.00$ $\alpha_1=0.7$ $\alpha_2=0.1$ $D_{max}$=duty ratio that can obtain 714 cd/M$^2$ in a display area unit in a color liquid crystal display device $D_0=D_{max}$ $D_1$=duty ratio that can obtain 500 cd/M$^2$ in a display area unit in a color liquid crystal display device $D_2$=duty ratio that can obtain 71 cd/M$^2$ in a display area unit in a color liquid crystal display device The relationships of the value X of a control signal supplied to a pixel to the light source luminance Y and the light transmittance (aperture ratio) Lt and the display luminance y of sub-pixels in the first through ninth embodiments are schematically shown in FIGS. 1 through 9. In FIGS. 1 through 9, the solid lines indicate the behaviors of the display area units 12 and the planar light source units 42 that achieve increased luminance levels; the broken lines represent the behaviors of the display area units 12 and the planar light source units 42 that do not achieve luminance levels; and the one-dot-chain lines designate the behaviors common to the display area units 12 and the planar light source units 42 that achieve increased luminance levels and the display area units 12 and the planar light source units 42 that do not achieve increased luminance levels.

Figure 10:
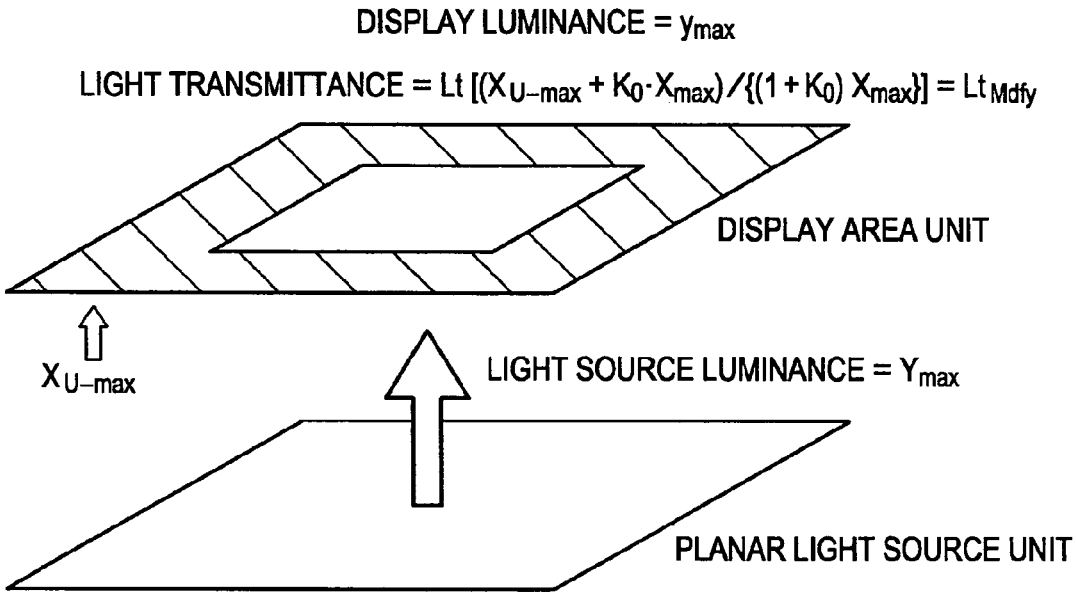
FIG. 10 illustrates the concept of the relationship among the light source luminance of a planar light source device, the light transmittance (aperture ratio) of pixels, and the display luminance of a display area in a control mode 1A.
Figure 15:
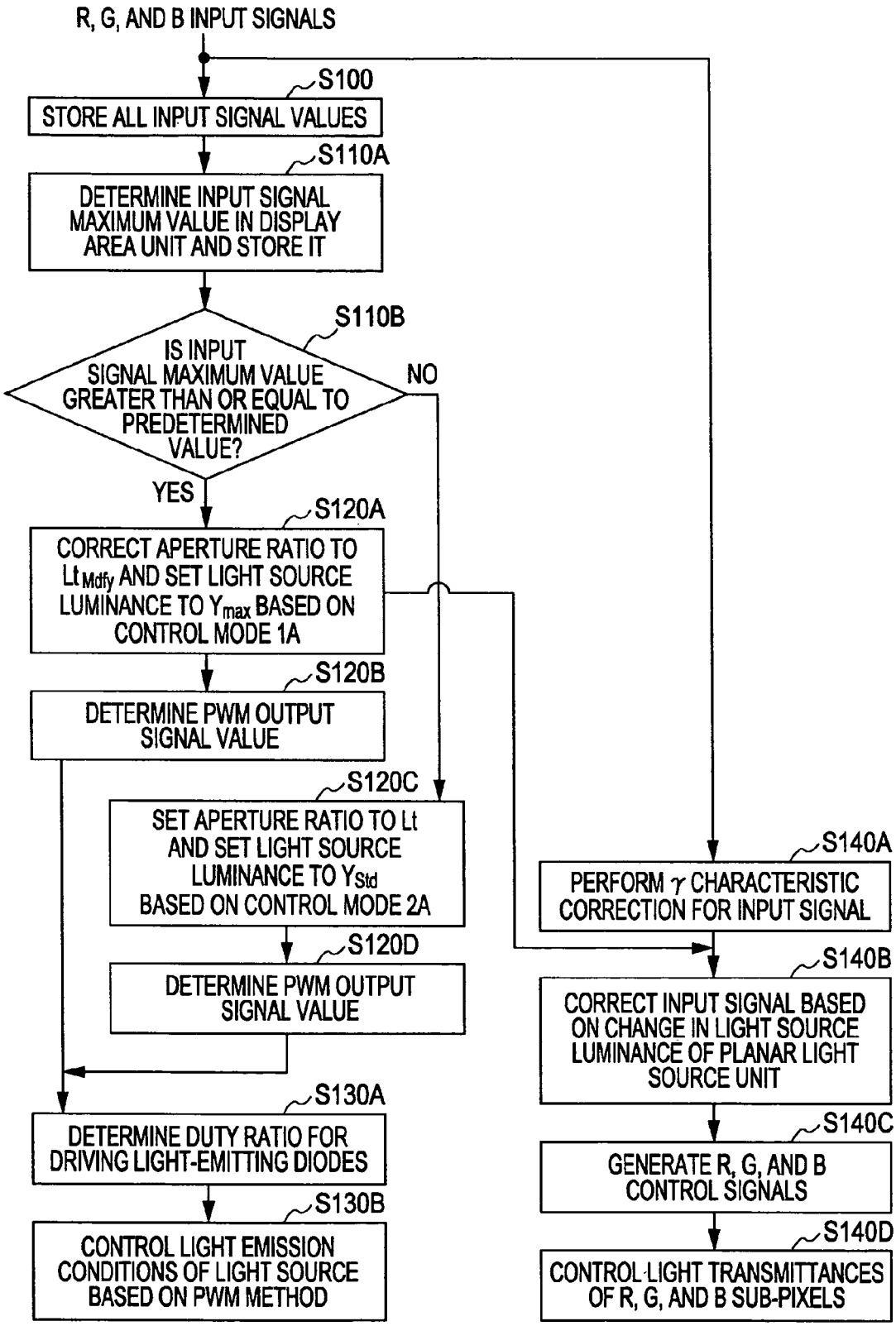
FIG. 15 is a flowchart illustrating a driving method for a liquid crystal display device assembly according to the first embodiment.

In the first embodiment, the control mode 1A and the control mode 2A are employed. A description is now given, with reference to FIGS. 10 and 15, of a driving method for a liquid crystal display device assembly according to the first embodiment. FIG. 10 illustrates the concept of the relationship among the light source luminance Y of the planar light source device 40, the light transmittance (aperture ratio), and the display luminance y of each pixel in the control mode 1A. FIG. 15 is a flowchart illustrating the driving method for the liquid crystal display device assembly.

Step S100 is first executed as follows. Input signals (R, G, and B input signals ($x_R$, $x_G$, and $x_B$)) for one image display frame sent from a known display circuit, such as a scan converter, and a control signal CLK are first input into the planar light source device control circuit 70 and the liquid crystal display device drive circuit 90 (see FIG. 24). Alternatively, the input signals and the control signal are first input into the planar light source device control circuit 70 and are then output to the liquid crystal display device drive circuit 90. The input signals are also referred to as "video signals". The R, G, and B input signals $x_R$, $x_G$, and $x_B$ input into the planar light source device control circuit 70 are temporarily stored in the storage unit (memory) 72. The R, G, and B input signals $x_R$, $x_G$, and $x_B$ input into the liquid crystal display device drive circuit 90 are also temporarily stored in a storage unit (not shown) provided for the liquid crystal display device drive circuit 90. The R, G, and B input signals are signals output from a pickup tube into which light having a quantity Yin is input, for example, output from a broadcasting station, and input into the planar light source device control circuit 70 and the liquid crystal display device drive circuit 90 to control the light transmittances of the corresponding pixels. The input signals can be represented by a function of the input light quantity $y_{in}$ with the power of 0.45, i.e., $y_{in}^{0.45}$.

Then, steps S110A and S110B are executed as follows. In the planar light source device control circuit 70, the computation circuit 71 reads the input signal value x stored in the storage unit (memory) 72. Then, in each display area unit 12, if the input signal value x for any one of the pixels forming the display area unit 12 is higher than or equal to a predetermined value (in the first embodiment, $k_1 \cdot x_{max}$), the luminance of the planar light source unit 42 associated with the display area unit 12 is controlled by the planar light source device control circuit 70 and the planar light source unit drive circuit 80 so that the luminance of the pixel, assuming that the control signal corresponding to the input signal having a value larger than the input signal value $x_{U\text{-}max}$ (more specifically, a value equal to $x_{U\text{-}max}+k_0 \cdot x_{max}$ in the first embodiment) is supplied to the pixel, can be obtained.

More specifically, it is first checked whether the input signal value x for any one of the pixels forming the p-th and q-th (p=1 and q=1 in the first place) display area unit 12 satisfies a condition expressed by $x \geqq k_1 \cdot x_{max}$ (1) More specifically, it is checked whether all the input signal values $x_R$, $x_G$, and $x_B$ for the R, G, and B sub-pixels of any one of the pixels forming the display area unit 12 are larger or equal to the upper limit threshold $k_1 \cdot x_{max}$, i.e., whether the input signal values $x_R$, $x_G$, and $x_B$ respectively satisfy the following conditions:

$$x_R \geqq k_1 \cdot x_{max} \quad (1\text{-}1)$$

$$x_G \geqq k_1 x_{max} \quad (1\text{-}2)$$

$$x_B \geqq k_1 \cdot x_{max} \quad (1\text{-}3).$$

Step S110B is executed on all the M×N pixels forming the display area unit 12 (m=1, 2, . . . , M, and n=1, 2, . . . , N).

Then, steps S120A and S120B are executed as follows. If the condition expressed by $x \geqq k_1 \cdot x_{max}$ (1) is satisfied, the input signal value is set to be $x_{U\text{-}max}$. More specifically, if the conditions $x_R \geqq k_1 \cdot x_{max}$ (1-1), $x_G \geqq k_1 \cdot x_{max}$ (1-2), and $x_B \geqq k_1 \cdot x_{max}$ (1-3) are simultaneously satisfied, the corresponding input values are set to be $x_{U\text{-}max(R)}$, $x_{U\text{-}max(G)}$, and $x_{U\text{-}max(B)}$, respectively. Then, the luminance of the planar light source unit 42 associated with the display area unit 12 that achieves increased luminance is controlled by the planar light source device control circuit 70 and the planar light source unit drive circuit 80 so that the luminance of the pixel, assuming that the control signal corresponding to the input signal having a value equal to $x_{U\text{-}max}+k_0 \cdot x_{max}$ (2) is supplied to the pixel, can be obtained. More specifically, the luminance levels of the planar light source unit 42 associated with the display area unit 12 that achieves increased luminance-are controlled by the planar light source device control circuit 70 and the planar light source unit drive circuit 80 so that the luminance levels of the R, G, and B sub-pixels, assuming that the R, G, and B control signals corresponding to the R, G, and B input signals having a value equal to $(x_{U\text{-}max(R)}+x_{U\text{-}max(G)}+U\text{-}_{max(B)})/3+k_0 \cdot x_{max}$ (2') are supplied to the R, G, and B sub-pixels, can be obtained. That is, the luminance of the planar light source unit 42 is increased. It should be noted that the first term of the right side in expression (2') is an integer, and if the value obtained by dividing the first term by 3 does not becomes an integer, the first place of the decimal is rounded off. It should also be noted that the second term of the right side in expression (2') is an integer, and accordingly, the coefficient $k_0$ should be selected so that $k_0 \cdot x_{max}$ becomes an integer.

That is, since the control mode 1A is employed in the first embodiment, the light source luminance of the planar light source unit 42 is set to be $Y_{max}$ regardless of the input signal value $x_{U\text{-}max}$. Then, the light transmittance (aperture ratio) $Lt_{Mdf}$, of the pixel including the R, G, and B sub-pixels exhibiting the maximum luminance to which the control signal corresponding to the input signal value $x_{U\text{-}max}$ is supplied is set to be a value so that the display luminance $Y_{max}$ can be obtained. More specifically, in the first embodiment, although the original light transmittance (aperture ratio) of the pixel is $Lt[(X/X_{max}]$ when the input signal value is x, it is corrected to $Lt_{Mdf}$, for each image display frame under the control of the drive circuit. More specifically, when the input signal value is $x_{U\text{-}max}$, the light transmittance of the pixel is set to be:

$$Lt[(x_{U\text{-}max}+K_0 \cdot X_{max})/\{1+K_0)X_{max}\}] \quad (11).$$

More specifically, if $X_{U\text{-}max(R)}=240$, $x_{U\text{-}max(G)}=255$, and $x_{U\text{-}max(B)}=250$, $(x_{U\text{-}max(R)}+x_{U\text{-}max(G)}+x_{U\text{-}max(B)})$ is calculated in the computation circuit 71 according to expression (2'). That is, $$x_{U\text{-}max}=(240+255+250)/3+32=248+32=280.$$

Accordingly, the luminance of the planar light source unit 42 associated with the display area unit 12 is controlled by the planar light source device control circuit 70 and the planar light source unit drive circuit 80 SO that the luminance of the pixel, assuming that the R, G, and B control signals corresponding to the R, G, and B input signals having a value equal to $x_{U\text{-}max}=280$ are supplied to the R, G, and B sub-pixels, respectively, can be obtained.

It is now assumed that $Y_{max}$ is 1.125 and $Y_{Std}$ is 1.000. In this case, the luminance $y_{280}$ of the R, G and B sub-pixels, assuming that the R, G, and B control signals corresponding to the R, G, and B input signals having a value equal to $x_{U\text{-}max}=280$ are supplied to the R, G, and B sub-pixels, respectively, can be expressed by according to expression (11):

$$y_{280}=Y_{max}**Lt[280/288]$$

The luminance $Y_{248}$ of the R, G, and B sub-pixels, assuming that the R, G, and B control signals corresponding to the R, G, and B input signals having a value equal to x=248 are supplied to the R, G, and B sub-pixels, respectively, can be expressed by:

$$y_{248}=Y_{Std}**Lt\ [248/256].$$

Accordingly, $y_{280}/Y_{248}=1.129$.

The duty ratio Do that can obtain the luminance of the pixel, assuming that the R, G, and B control signals corresponding to the R, G, and B input signals having a value equal to $(1+k_0)x_{max}=288$ are supplied to the R, G, and B sub-pixels, respectively, can be expressed by:

$$D_0=\alpha_0 \cdot D_{max} \quad (4).$$

More specifically, the computation circuit 71 of the planar light source device control circuit 70 determines the PWM output signal S (the PWM output signal $S_R$ for controlling the light emission time of the R light-emitting diode 41R, the PWM output signal $S_G$ for controlling the light emission time of the G light-emitting diode 41G, and the PWM output signal SB for controlling the light emission time of the B light-emitting diode 41B) for obtaining the luminance $Y_{max}$ Then, the PWM output signals $S_R$, $S_G$, and $S_B$ determined in the computation circuit 71 are output to the storage unit 82 of the planar light source unit drive circuit 80 provided for the planar light source unit 42 and are stored in the storage unit 82. The clock signal CLK is also output to the planar light source unit drive circuit 80 (see FIG. 25).

Then, steps S120C and S120D are executed as follows. If the computation circuit 71 determines that there is no pixel that satisfies expression (1) (or simultaneously satisfies expressions (1-1), (1-2), and (1-3)) in the display area unit 12, the light source luminance of the planar light source unit 42 that does not achieved increased luminance is set to be $Y_{Std}$ for each image display frame, as in the related art, according to the control mode 2A in the first embodiment. The light transmittances (aperture ratios) of the pixels are not changed or corrected. The light source luminance $Y_{Std}$ is constant regardless of the input signal value. More specifically, the PWM output signals S (the PWM output signal $S_R$ for controlling the light emission time of the R light-emitting diode 41R, the PWM output signal $S_G$ for controlling the light emission time of the G light-emitting diode 41G, and the PWM output signal SB for controlling the light emission time of the B light-emitting diode 41B) for obtaining the light source luminance $Y_{Std}$ of the planar light source unit 42 for each image display frame are output to the storage unit 82 of the planar light source unit drive circuit 80 (see FIG. 25) provided for the planar light source unit 42 and are stored in the storage unit 82.

Steps S110A through S120D are repeated from p=1 to p=P and from q=1 to q=Q. Then, one image display frame can be displayed.

Then, step S130A is executed. The computation circuit 81 determines the on-time $t_{R\text{-}ON}$ and the off-time $t_{R\text{-}OFF}$ of the R light-emitting diode 41R, the on-time $t_{G\text{-}ON}$ and the off-time $t_{G\text{-}OFF}$ of the G light-emitting diode 41G, and the on-time $t_{B\text{-}ON}$ and the off-time $t_{B\text{-}OFF}$ of the B light-emitting diode 41B on the basis of the PWM output signals $S_R$, $S_G$, and $S_B$, respectively. The relationship among the on-time and the off-time of the light-emitting diodes 41R, 41G, and 41B can be expressed by the following equations:

$$t_{R\text{-}ON}+t_{R\text{-}OFF}=t_{G\text{-}ON}+t_{G\text{-}OFF}=t_{B\text{-}ON}+t_{B\text{-}OFF}=\text{constant value } t_{const}$$

The duty ratio in the PWM driving for the light-emitting diodes 41R, 41G, and 41B can be expressed by the following equation:

$$t_{ON}/(t_{ON}+t_{OFF})=t_{ON}/t_{Const},$$

Then, step S130B is executed as follows. The signals indicating the on-times $t_{R\text{-}ON}$, $t_{G\text{-}ON}$, and $t_{B\text{-}ON}$ of the R light-emitting diode 41R, the G light-emitting diode 41G, and the B light-emitting diode 41B, respectively, are sent to the LED drive circuit 83. Then, based on the signals indicating the on-times $t_{R\text{-}ON}$, $t_{G\text{-}ON}$, and $t_{B\text{-}ON}$, the switching elements 85R, 85G, and 85B are turned ON by time periods equal to the on-times $t_{R\text{-}ON}$, $t_{G\text{-}ON}$, and $t_{B\text{-}ON}$, respectively, and LED drive currents output from the light-emitting diode drive power source 86 and flow in the light-emitting diodes 41R, 41G, and 41B. Accordingly, the light-emitting diodes 41R, 41G, and 41B emit light by time periods equal to the on-times $t_{R\text{-}ON}$, $T_{G\text{-}ON}$, and $t_{B\text{-}ON}$, respectively, in one image display frame. As a result, the p-th and q-th display area unit 12 is illuminated with a predetermined illumination level so that one image display frame can be displayed. The operation of the liquid crystal device 10 and the operation of the planar light source device 40 in one image display frame are synchronized.

Then, steps S140A through S140D are executed as follows. The R, G, B input signals $x_R$, $x_G$, and $x_B$ input into the liquid crystal display circuit 90 are sent to the timing controller 91, and the timing controller 91 outputs the R, G, and B control signals corresponding to the R, G, and B input signals to the R, G, and B sub-pixels, respectively. The relationships between the R, G, and B control signals $x_R$, $x_G$, and $x_B$ generated in the timing controller 91 and supplied to the R, G, and B sub-pixels and the R, G, and B input signals $x_R$, $x_G$, and $x_B$, respectively, can be expressed by equations (21-1), (21-2), and (21-3), respectively:

$$X_R=f_R(b_{1_R} \cdot x_R^{2.2}+b_{0_R}) \quad (21\text{-}1)$$

$$X_G=f_G(b_{1_G} \cdot x_G^{2.2}+b_{0_G}) \quad (21\text{-}2)$$

$$X_B=f_B(b_{0_G} \cdot x_B^{2.2}+b_{0_B}) \quad (21\text{-}3)$$

where $b_{1_R}$, $b_{0_R}$, $b_{1_G}$, $b_{0_B}$, and $b_{0_B}$ are constants, and $f_R$, $f_G$, and $f_B$ are predetermined functions for correcting the R, G, and B control signals $X_R$, $X_G$, and $X_B$, respectively, on the basis of the control of the light source luminance if necessary.

Figure 1:
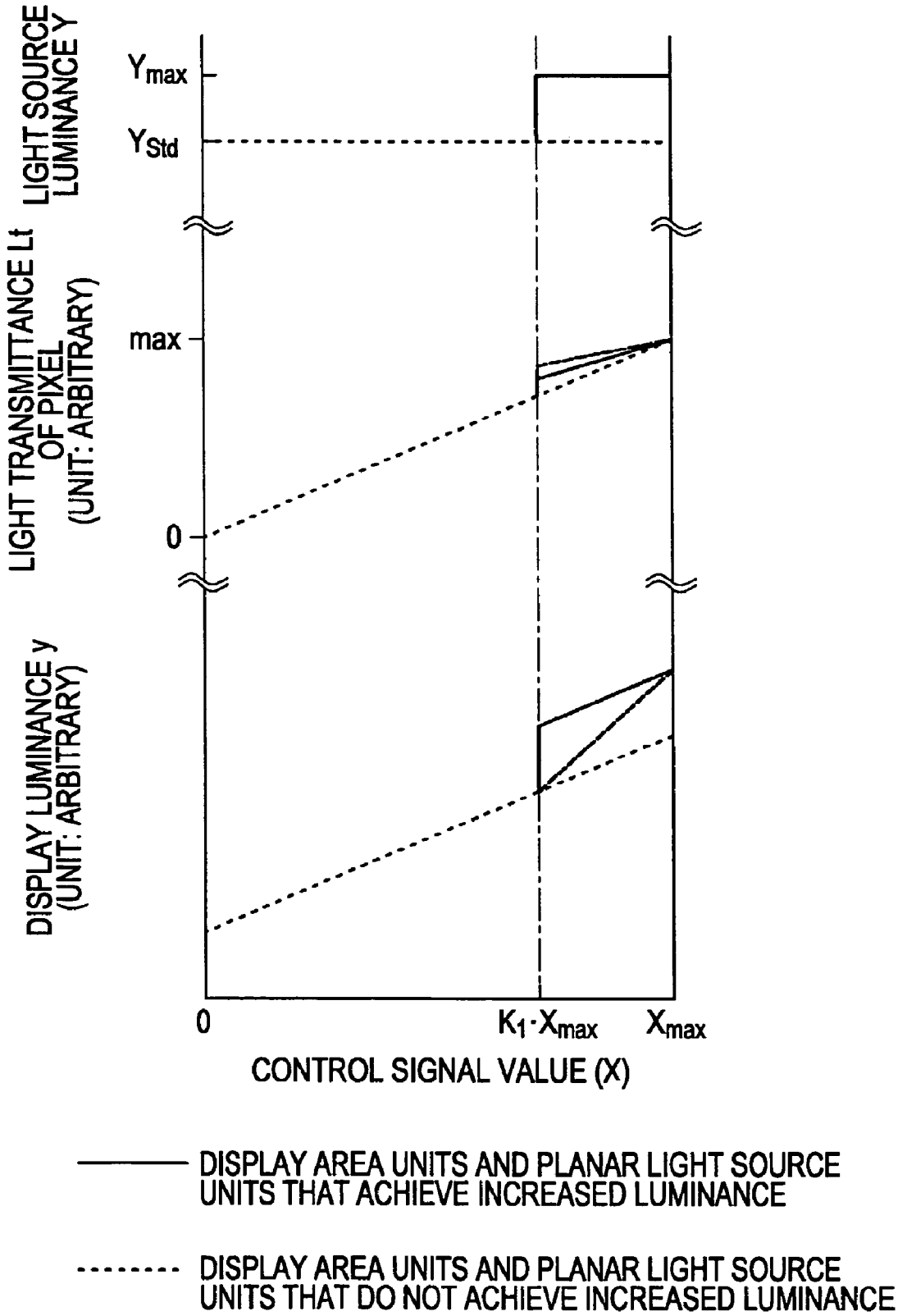
FIG. 1 schematically illustrates the relationships of control signal value X to light source luminance Y and light transmittance Lt and display luminance y of pixels in a first embodiment.

The resulting behaviors of the display area units 12 and the planar light source units 42 are indicated by the solid lines and the broken lines in FIG. 1. It should be noted that, as stated above, the control signal X in FIGS. 1 through 9 is obtained by correcting the value $x^{2.2}$ ($x=x^{2.2}$) of the input signal x input into the liquid crystal display device drive circuit 90 for driving the sub-pixels.

The coefficient $k_0$ in $k_0 \cdot x_{max}$ in the second term of the right side of expression (2) or (2') may be a linear function $F_{_k0}(x_{Ave})$ or a function $F_{_k0}(x_{Ave})$ expressed by a higher-order polynomial equation of the average value of the light emission control signals $[(x_{U\text{-}max(R)}+x_{U\text{-}max(G)}+x_{U\text{-}max(B)})/3=x_{Ave}]$. For example, the function $F_{_k0}(x_{Ave})$ may be a linear function of $x_{Ave}$ expressed by the equation $F_{_k0}(x_{Ave})=k_0 \cdot x_{Ave}/\{(1-k_1) \cdot x_{max})\}-k_0 \cdot k_1/(1-k_1)$. The function $F_{_k0}(x_{Ave})$ is a linear function that indicates 0 when $x_{Ave}=k_1 \cdot x_{max}$, and that indicates $k_0$ when $x_{Ave}=x_{max}$. The same applies to the subsequent embodiments. The relationship of the control signal value X supplied to the pixel to the light transmittance (aperture ratio) Lt and the display luminance y of the sub-pixels is schematically indicated by the broken lines in FIG. 1.

Second Embodiment

Figure 2:
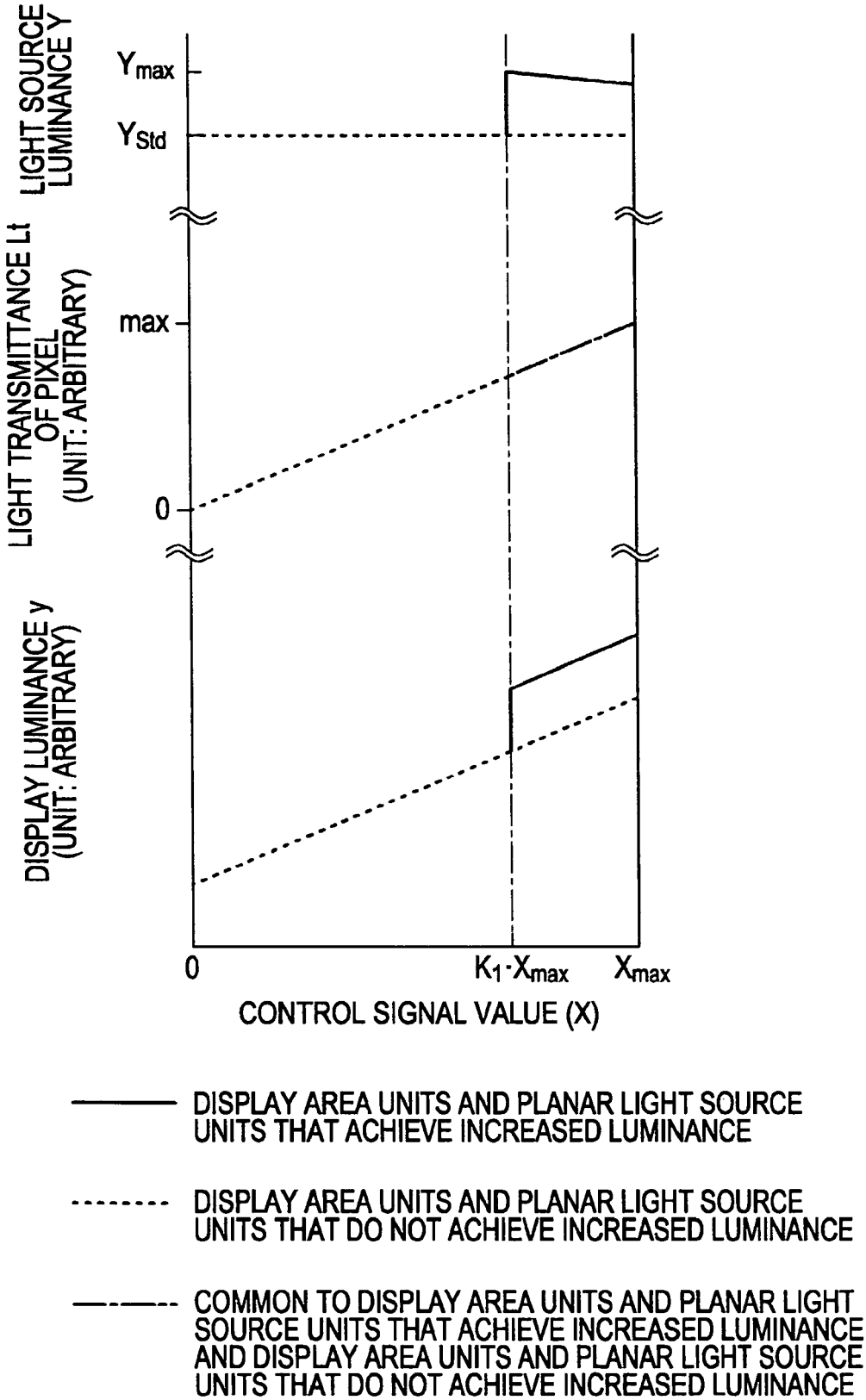
FIG. 2 schematically illustrates the relationships of control signal value X to light source luminance Y and light transmittance Lt and display luminance y of pixels in a second embodiment.
Figure 11A:
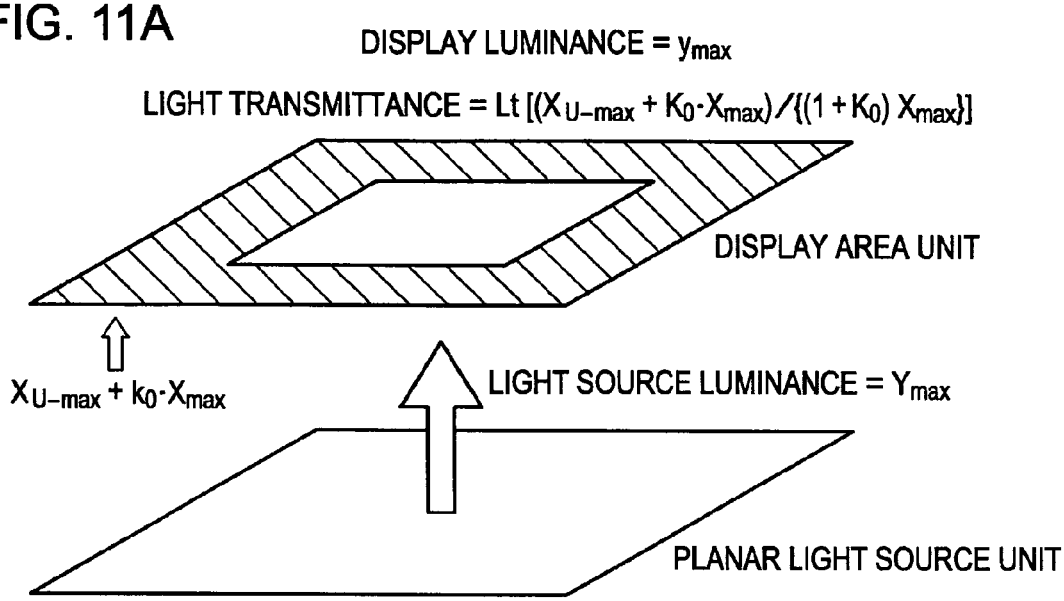
FIGS. 11A and 11B illustrate the concept of the relationship among the light source luminance of the planar light source device, the light transmittance (aperture ratio) of pixels, and the display luminance of a display area in a control mode 1B.
Figure 11B:
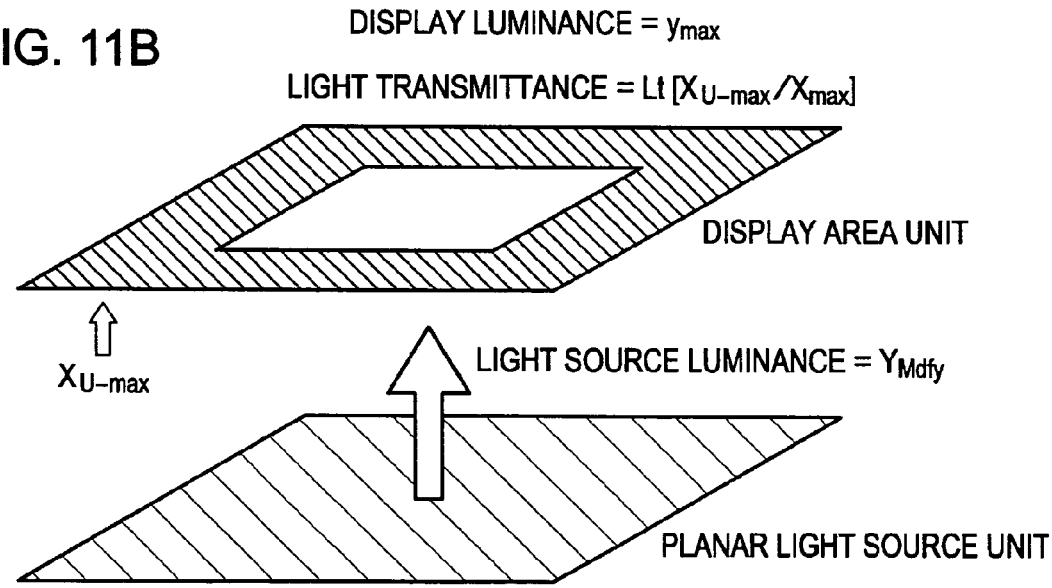

In a second embodiment, which is a modification made to the first embodiment, the control mode 1B and the control mode 2A are employed. That is, in steps S220A and S220B similar to steps S120A and S120B in the first embodiment, control mode 1B is employed. The relationships of the control signal value X to the light source luminance Y and the light transmittance Lt and the display luminance y of sub-pixels in the second embodiment are schematically shown in FIG. 2. A description is now given, with reference to FIGS. 11A and 11B and 16, of a driving method for a liquid crystal display device assembly according to the second embodiment. FIGS.

Figure 16:
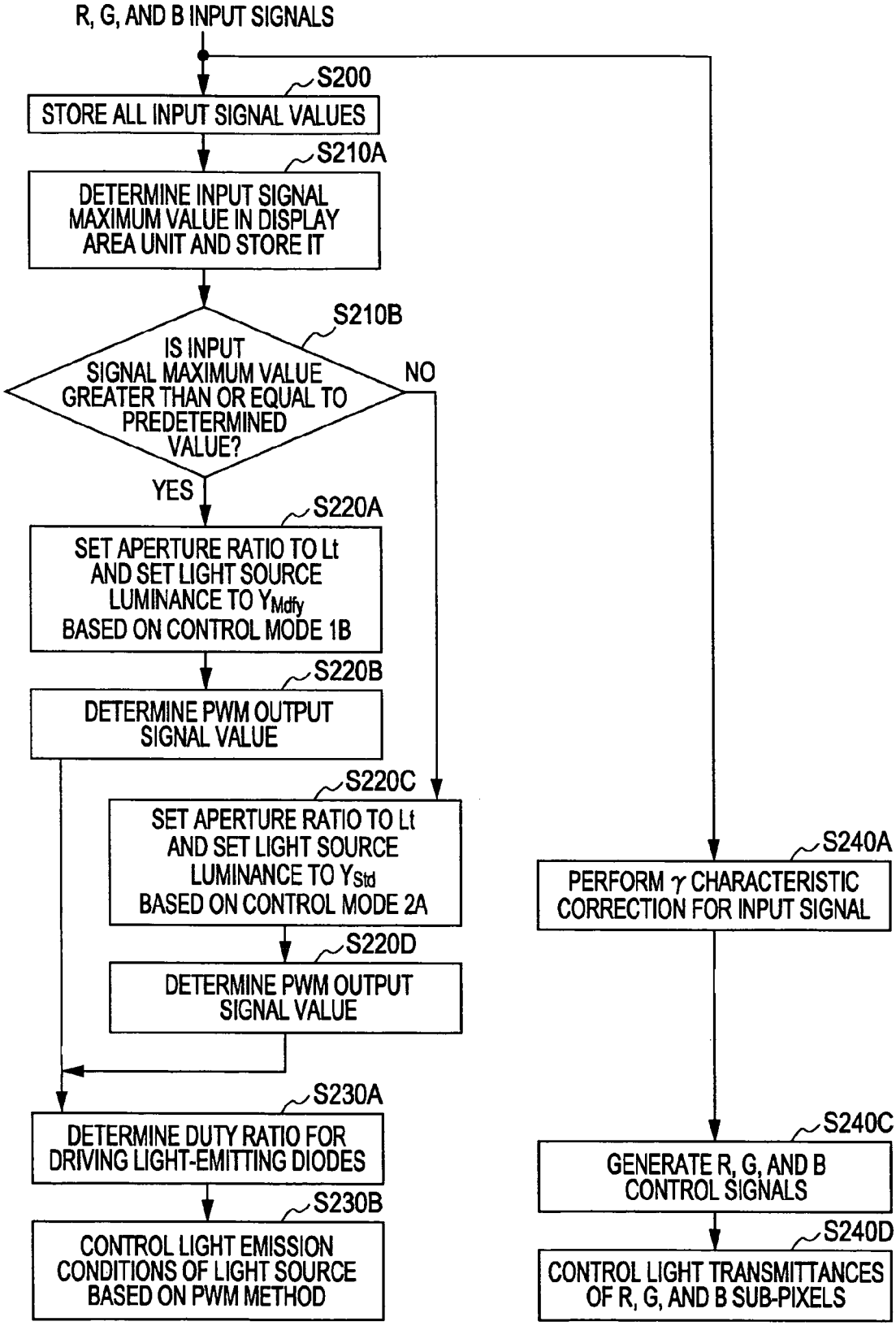
FIG. 16 is a flowchart illustrating a driving method for a liquid crystal display device assembly according to the second embodiment.

11A and 11B illustrate the concept of the relationship among the light source luminance of the planar light source device 40, the light transmittance (aperture ratio), and the display luminance of pixels in the control mode 1B. FIG. 16 is a flowchart illustrating the driving method for the liquid crystal display device assembly.

In step S200, step S100 in the first embodiment is executed. Then, in steps S210A and S210B, steps S110A and S110B are executed.

In the second embodiment, in step S220A and S220B, the luminance of the planar light source units 42 that achieves increased luminance is increased in accordance with an increase in the input signal value $x_{U\text{-}max}$. More specifically, in the second embodiment, the light source luminance $Y_{Mdfy}$ is set to be a value under the control of the planar light source device control circuit 70 and the planar light source unit drive circuit 80 so that the display luminance $y_{max}$ can be obtained for each image display frame when the light transmittance is Lt $[X_{U\text{-}max}/X_{max}]$ (see equation (12)).

$$Y_{Mdfy}  Lt\,[X_{U\text{-}max}/x_{max}] = Y_{max}  Lt[(Xu_{U\text{-}max} + K_0 \cdot X_{max})/\{1+K_0)X_{max}\}] \quad (12)$$

In the second embodiment, although the light source luminance $Y_{Mdfy}$ of the display area unit 12 is controlled, the light transmittance (aperture ratio) of the pixels forming the display area unit 12 is not changed or corrected. That is, the light transmittance of the pixel is $Lt[X/X_{max}]$ when the input signal value is x.

If the computation circuit 71 determines that there is no pixel that satisfies expression (1) (or simultaneously satisfies expressions (1-1), (1-2), and (1-3)) in the display area unit 12, steps S120C and S120D in the first embodiment are executed as steps S220C and S220D.

Then, steps S130A and S130B in the first embodiment are executed as steps S230A and S230B.

Then, steps S140A, S140C, and S140D are executed as steps S240A, S240C, and S240D. In the second embodiment, step S240B, i.e., correction for the value $x^{2.2}$ ($x \equiv x^{2.2}$) of the input signal x input into the liquid crystal display device drive circuit 90 for driving the sub-pixels on the basis of the control for the light source luminance is not necessary.

The configuration and structure of the liquid crystal display device assembly in the second embodiment are similar to those of the first embodiment, and an explanation thereof is thus omitted.

Third Embodiment

Figure 3:
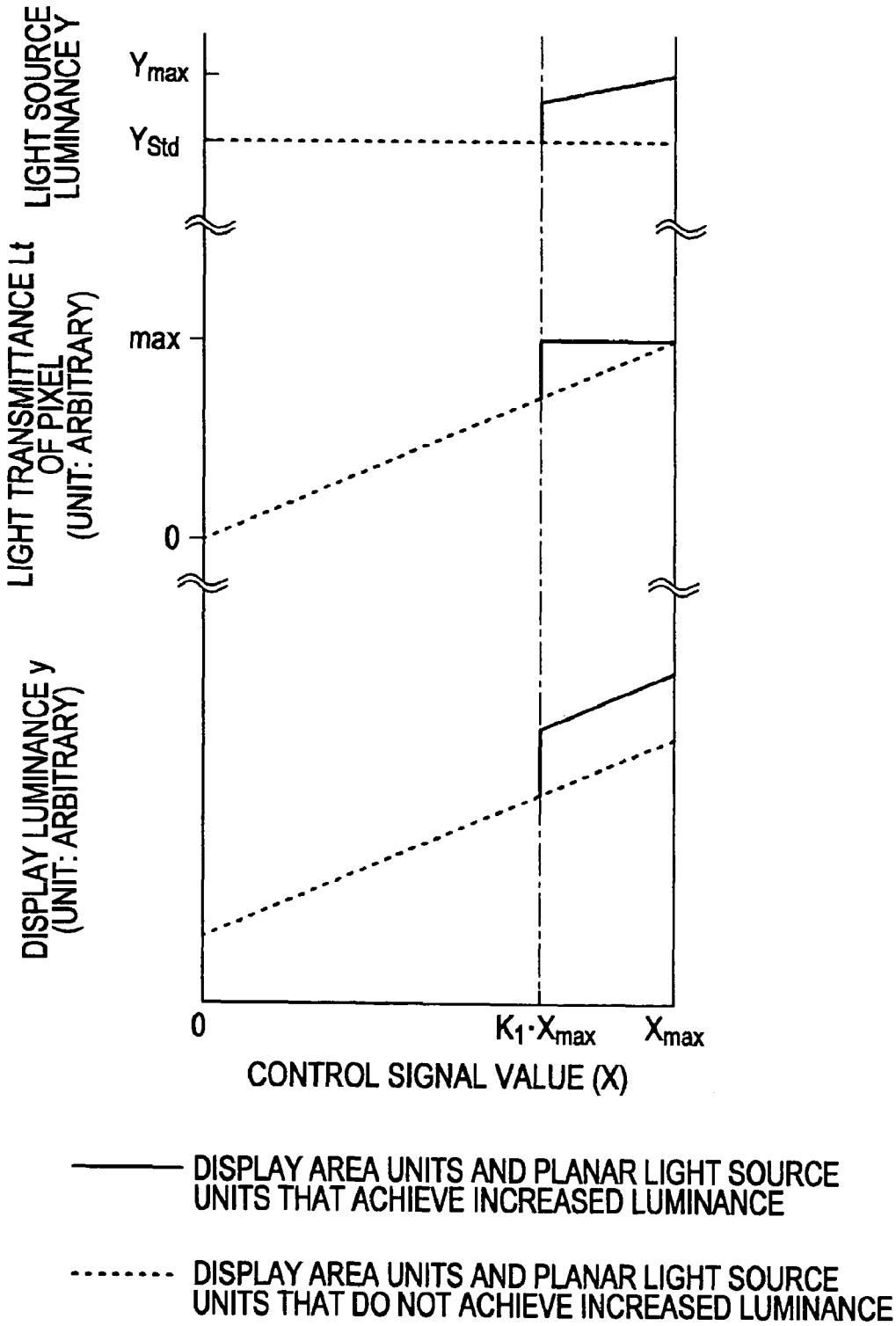
FIG. 3 schematically illustrates the relationships of control signal value X to light source luminance Y and light transmittance Lt and display luminance y of pixels in a third embodiment.
Figure 12A:
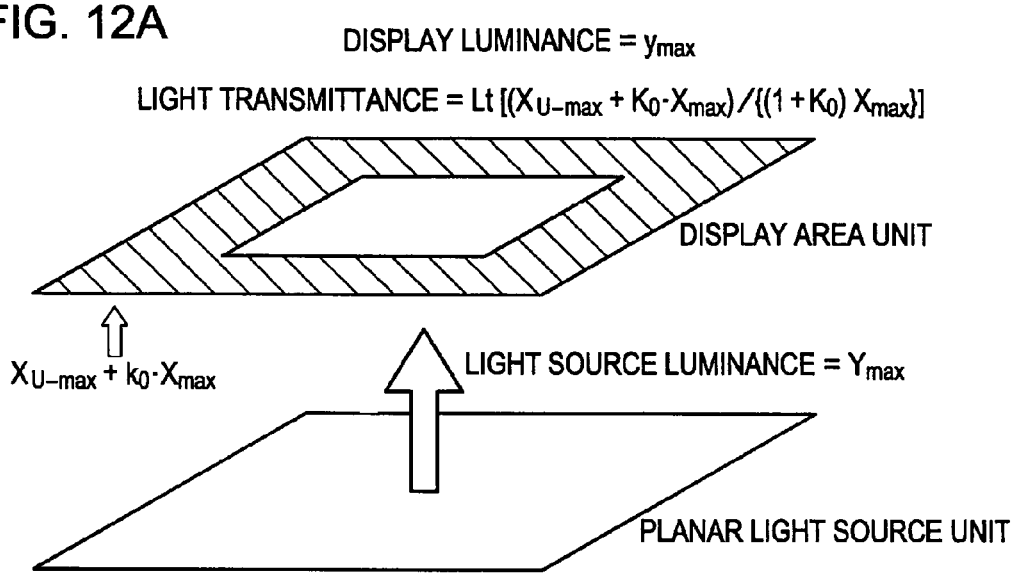
FIGS. 12A and 12B illustrate the concept of the relationship among the light source luminance of the planar light source device, the light transmittance (aperture ratio) of the pixels, and the display luminance of the display area in a control mode 1C.
Figure 12B:
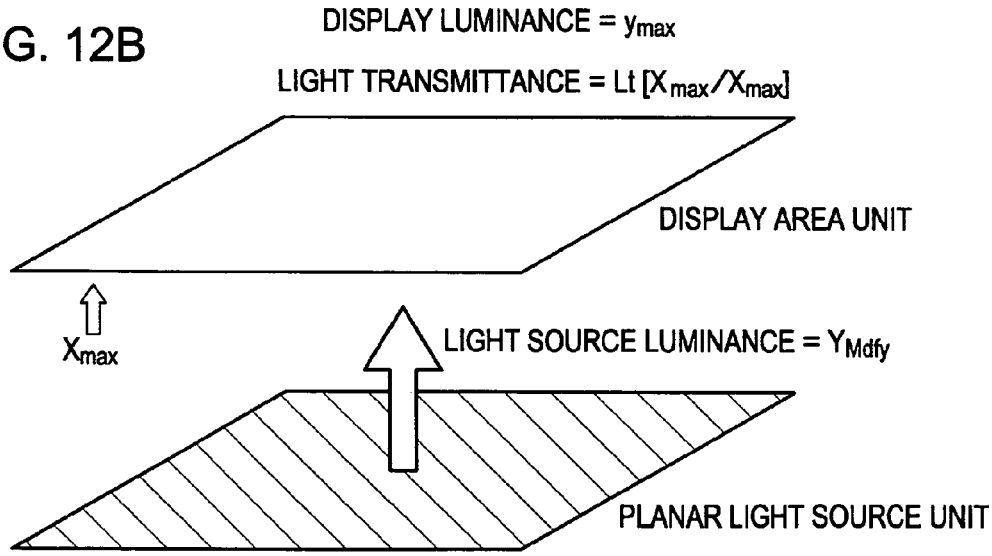
Figure 17:
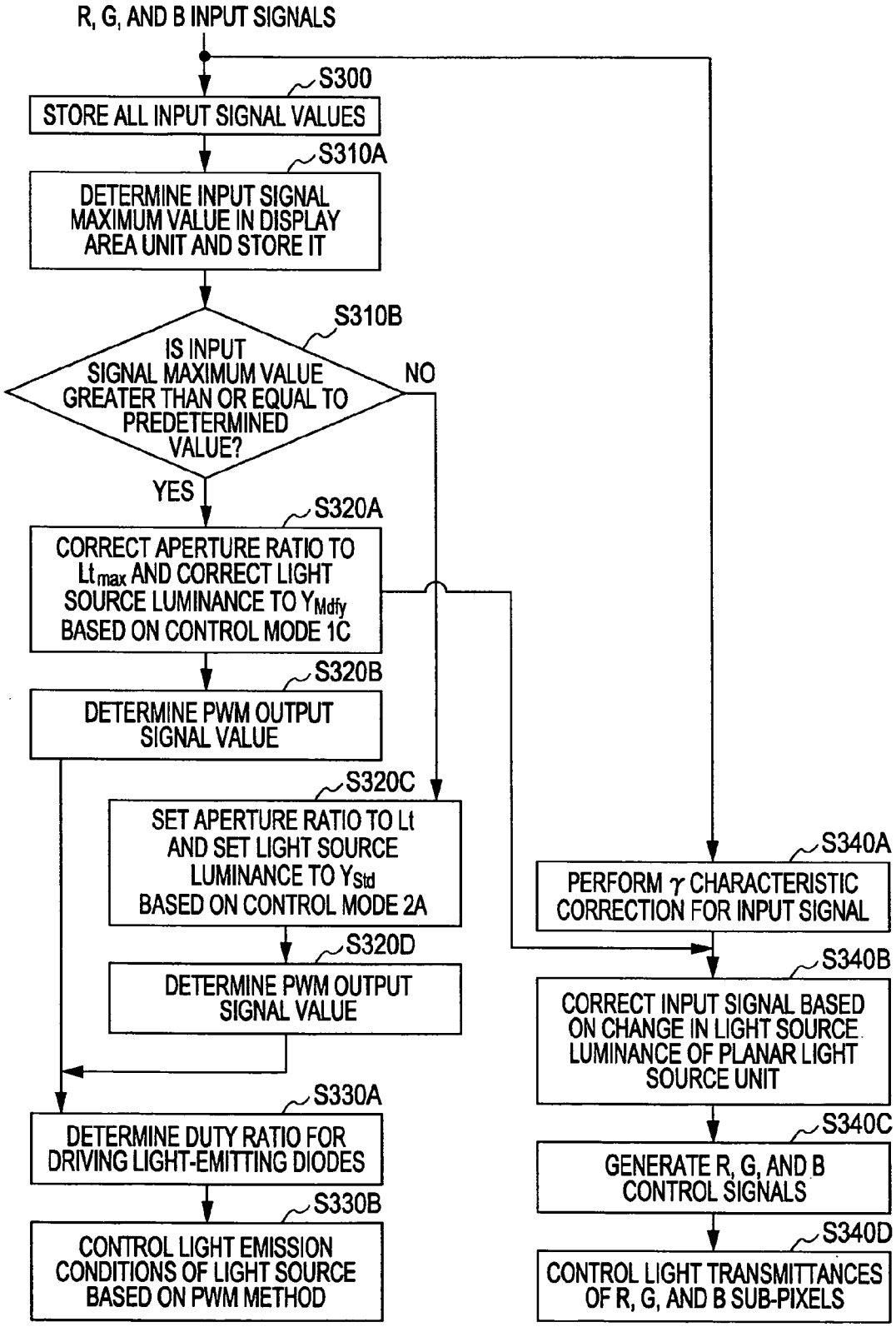
FIG. 17 is a flowchart illustrating a driving method for a liquid crystal display device assembly according to the third embodiment.

In a third embodiment, which is also a modification made to the first embodiment, the control mode 1C and the control mode 2A are employed. That is, in steps S320A and S320B similar to steps S120A and S120B in the first embodiment, control mode 1C is employed. The relationships of the control signal value X to the light source luminance Y and the light transmittance Lt and the display luminance y of sub-pixels in the third embodiment are schematically shown in FIG. 3. A description is now given, with reference to FIGS. 12A and 12B and 17, of a driving method for a liquid crystal display device assembly according to the third embodiment. FIGS. 12A and 12B illustrate the concept of the relationship among the light source luminance of the planar light source device 40 of pixels, and the light transmittance (aperture ratio) and the display luminance y of pixels in the control mode 1C. FIG. 17 is a flowchart illustrating the driving method for the liquid crystal display device assembly.

In step S300, step S100 in the first embodiment is executed. Then, in steps S310A and S310B, steps S110A and S110B are executed.

In the third embodiment, in steps S320A and S320B, the light transmittance (aperture ratio) of the pixel exhibiting the maximum luminance (pixel A) forming the display area unit 12 that achieves increased luminance is set to be constant $Lt_{max}$ regardless of the input signal value $x_{U\text{-}max}$, and the planar light source unit 42 is controlled so that a desired level of the display luminance can be obtained. More specifically, in the third embodiment, the light source luminance $Y_{Mdfy}$ is set to be a value under the control of the planar light source device control circuit 70 and the planar light source unit drive circuit 80 so that the display luminance $Y_{max}$ can be obtained for each image display frame when the light transmittance is $Lt_{max}$ (see equation (13)).

$$Y_{Mdfy}  Lt_{max} = Y_{max}  Lt\left[\left(\begin{matrix} X_{U-max} + \\ K_0 \cdot X_{max} \end{matrix}\right) \Big/ \{1 + K_0)X_{max}\}\right] \quad (13)$$

In the third embodiment, the light source luminance $Y_{Mdfy}$ of the planar light source unit 42 is controlled, and the light transmittance (aperture ratio) of the pixels forming the display area unit 12 is also corrected.

If the computation circuit 71 determines that there is no pixel that satisfies expression (1) (or simultaneously satisfies expressions (1-1), (1-2), and (1-3)) in the display area unit 12, steps S120C and S120D in the first embodiment are executed as steps S320C and S320D.

Then, steps S130A and S130B in the first embodiment are executed as steps S330A and S330B.

Then, steps S140A through S140D are executed as steps S340A through S340D.

The configuration and structure of the liquid crystal display device assembly in the third embodiment are similar to those of the first embodiment, and an explanation thereof is thus omitted.

Fourth Embodiment

Figure 4:
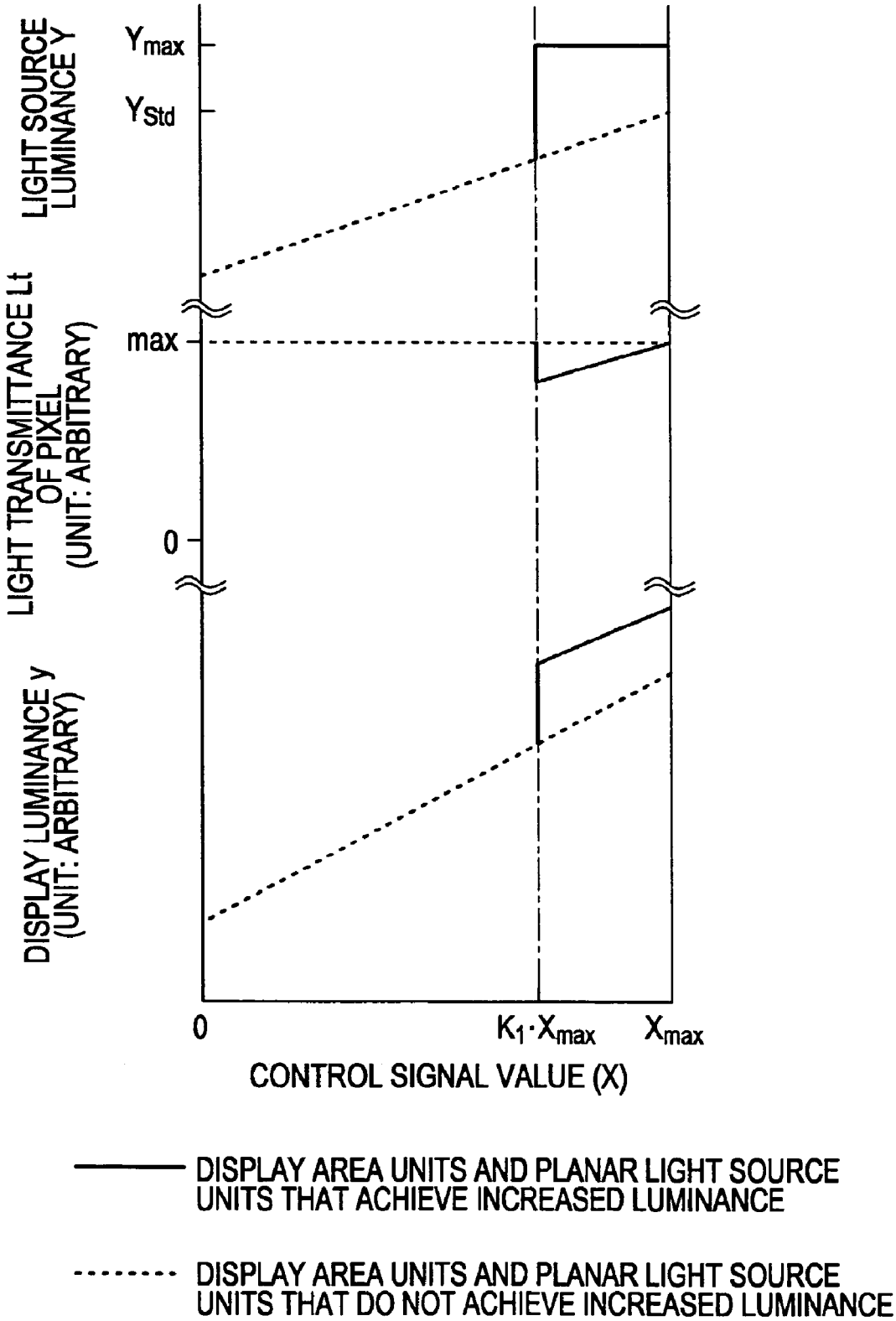
FIG. 4 schematically illustrates the relationships of control signal value X to light source luminance Y and light transmittance Lt and display luminance y of pixels in a fourth embodiment.
Figure 13A:
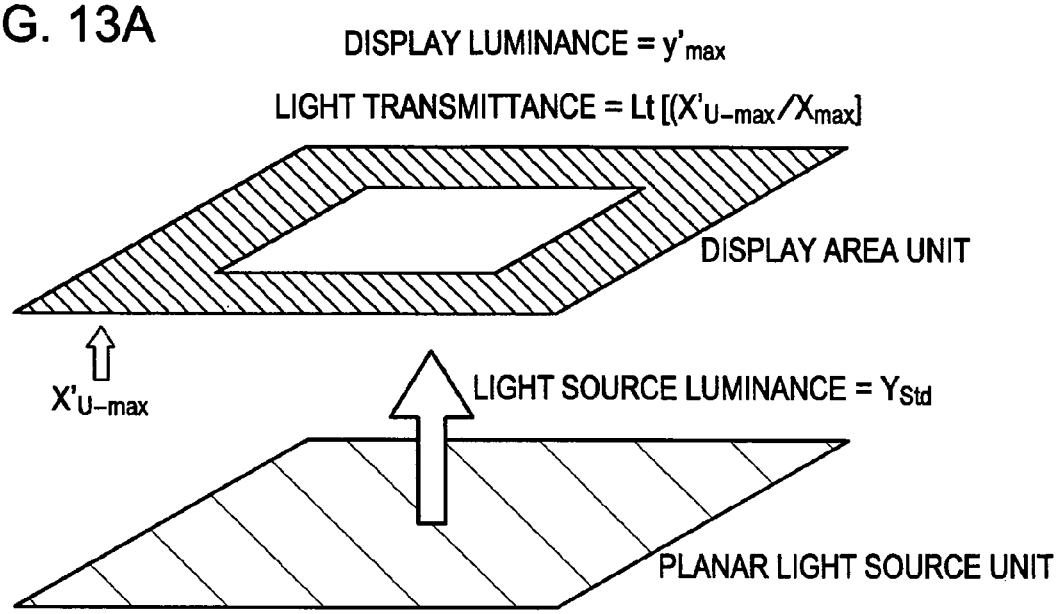
FIGS. 13A and 13B illustrate the concept of the relationship among the light source luminance of the planar light source device, the light transmittance (aperture ratio) of the pixels, and the display luminance of the display area in a control mode 2B.
Figure 13B:
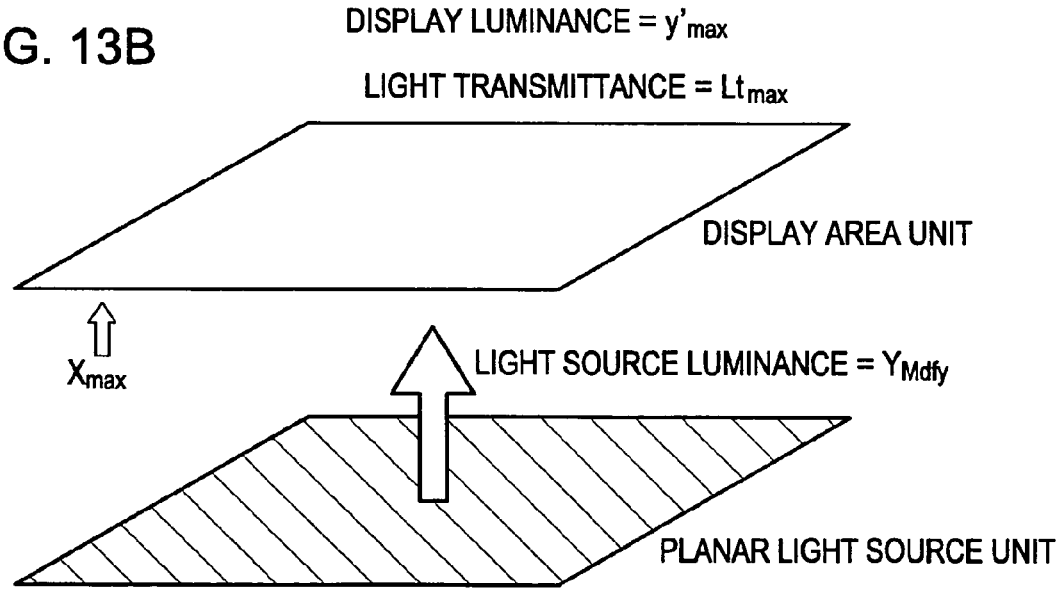
Figure 18:
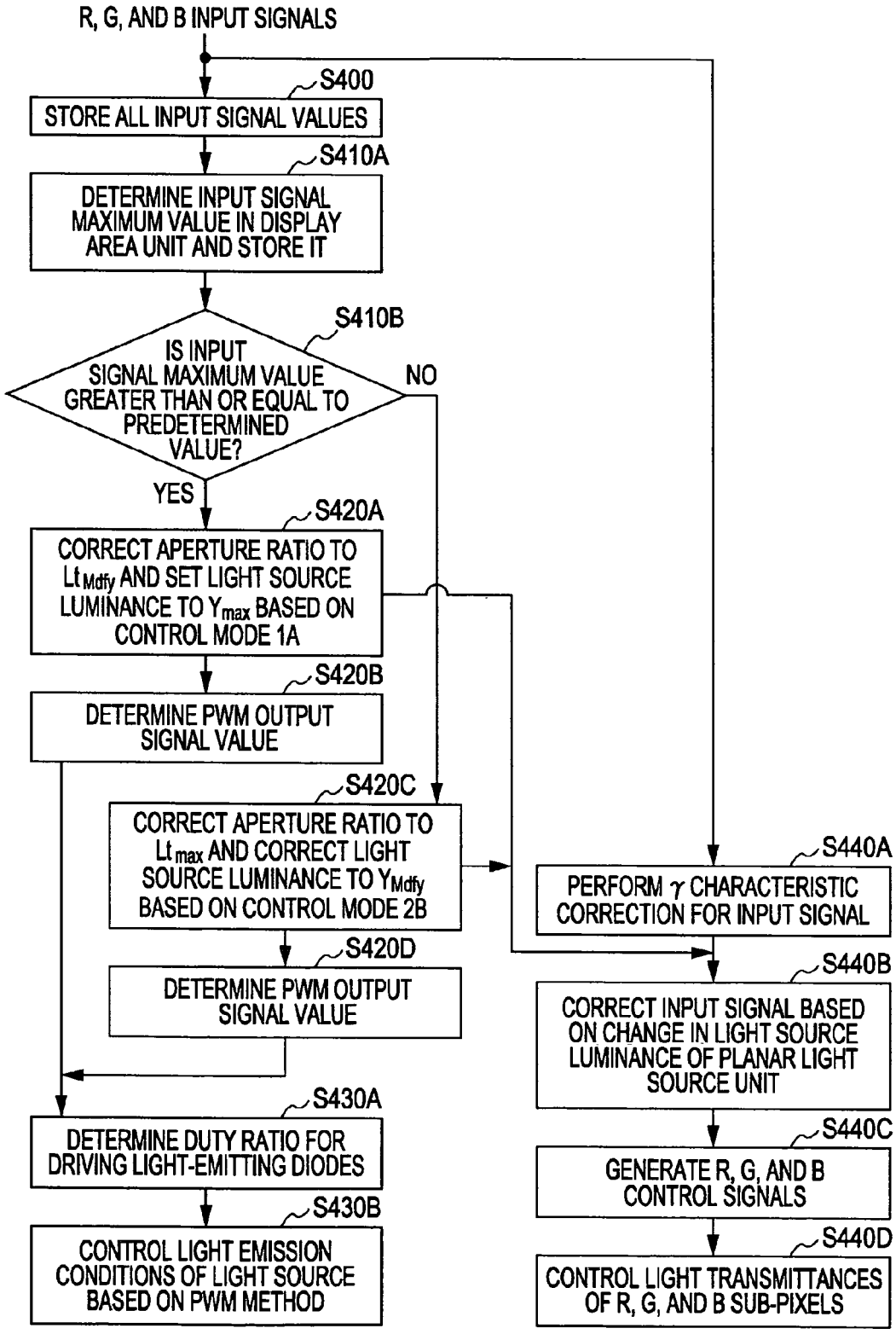
FIG. 18 is a flowchart illustrating a driving method for a liquid crystal display device assembly according to the fourth embodiment.

In a fourth embodiment, another driving method for a color liquid crystal display device assembly is described below. More specifically, in the fourth embodiment, the control mode 1A and the control mode 2B are employed. The relationships of the control signal value X to the light source luminance Y and the light transmittance Lt and the display luminance y of pixels in the fourth embodiment are schematically shown in FIG. 4. A description is now given, with reference to FIGS. 13A and 13B and 18, of a driving method for a liquid crystal display device assembly according to the fourth embodiment. FIGS. 13A and 13B illustrate the concept of the relationship among the light source luminance of the planar light source device 40 and the light transmittance (aperture ratio) and the display luminance of pixels in the control mode 2B. FIG. 18 is a flowchart illustrating the driving method for the liquid crystal display device assembly.

In step S400, step S100 in the first embodiment is executed. Then, in steps S410A and S410B, steps S110A and S110B are executed. Then, in steps S420A and S420B, steps S120A and S120B are executed.

Steps S420C and S420D are different from steps S120C and S120D in the first embodiment. If the computation circuit 71 determines that there is no pixel that satisfies expression (1) (or simultaneously satisfies expressions (1-1), (1-2), and (1-3)) in the display area unit 12, the luminance levels of the display area unit 12 corresponding to the planar light source unit 42 that does not achieve increased luminance are controlled by the planar light source device control circuit 70 and the planar light source unit drive circuit 80 so that the luminance of a pixel, assuming that the control signal corresponding to the input signal having the maximum value $x'_{U\text{-}max}$, which indicates the maximum value of the input signals input into the drive circuit for driving all the pixels forming the display area unit 12, is supplied to the pixel, can be obtained.

More specifically, when any of the input signal values $x_R$, $x_G$, and $x_B$ for all the pixels forming the display area unit 12 is less than a predetermined value $k_1 \cdot x_{max}$, the luminance of the planar light source unit 42 corresponding to the display area unit 12 is controlled by the planar light source device control circuit 70 and the planar light source unit drive circuit 80 so that the luminance levels of R, G, and B sub-pixels, assuming that the control signals corresponding to the input signals having the maximum value $x_{U\text{-}max}$ are supplied to the R, G, and B sub-pixels, can be obtained.

In the fourth embodiment, since the control mode 2B is employed, the light transmittance (aperture ratio) of the pixel exhibiting the maximum luminance (pixel B) forming the display area unit 12 that does not achieve increased luminance is set to be constant $Lt_{max}$ regardless of the input signal value $x'_{U\text{-}max}$, and the planar light source unit 42 is controlled so that a desired level of the display luminance can be obtained. More specifically, in the fourth embodiment, the light source luminance $Y_{Mdfy}$ is set to be a value under the control of the planar light source device control circuit 70 and the planar light source unit drive circuit 80 so that the display luminance $y'_{max}$ can be obtained for each image display frame when the light transmittance is $Lt_{max}$ (see equation (14)).

$$Y_{Mdfy}{}^{}Lt_{max}=Y_{Std}{}^{}Lt\ [X'_{U\text{-}max}/X_{max}] \tag{14}$$

In the fourth embodiment, the light source luminance $Y_{Mdfy}$, of the planar light source unit 42 that does not achieve increased luminance is controlled, and the light transmittance (aperture ratio) of the pixels forming the display area unit 12 that does not achieve increased luminance is also corrected.

More specifically, the PWM output signals S (the PWM output signal $S_R$ for controlling the light emission time of the R light-emitting diode 41R, the PWM output signal $S_G$ for controlling the light emission time of the G light-emitting diode 41G, and the PWM output signal $S_B$ for controlling the light emission time of the B light-emitting diode 41B) for obtaining the light source luminance $Y_{Mdfy}$ of the planar light source unit 42 for each image display frame are sent to the storage unit 82 of the planar light source unit drive circuit 80 provided for the planar light source unit 42 and are stored in the storage unit 82. The clock signal CLK is also output to the planar light source unit drive circuit 80 (see FIG. 25).

For example, when $x_R$=110, $x_G$=150, and $x_B$=50, $x'_{U\text{-}max}$=150. Accordingly, the light source luminance $Y_{Mdfy}$ of the planar light source unit 42 corresponding to the display area unit 12 that does not achieve increased luminance is controlled by the planar light source device control circuit 70 and the planar light source unit drive circuit 80 so that the display luminance $y'_{max}$ of the R, G, and B sub-pixels, assuming that the light transmittance of the R, G, and B sub-pixels is set to be $Lt_{max}$ and that the control signals corresponding to the R, G, and B input signals having a value equal to $x'_{U\text{-}max}$=150 are supplied to the R, G, and B sub-pixels, can be obtained.

In the fourth embodiment, the duty ratio $D_1$ that can obtain the luminance of the pixel, assuming that the R, G, and B control signals corresponding to the R, G, and B input signals having a value equal to $k_1 \cdot x_{max}$ are supplied to the R, G, and B sub-pixels, respectively, is expressed by:

$$D_1=\alpha_1 \cdot D_{max} \tag{5}$$

where $D_{max}$ indicates the maximum duty ratio.

Then, steps S130A and S130B in the first embodiment are executed as steps S430A and S430B.

Then, steps S140A through S140D are executed as steps S440A through S440D.

The configuration and structure of the liquid crystal display device assembly in the fourth embodiment are similar to those of the first embodiment, and an explanation thereof is thus omitted.

Fifth Embodiment

Figure 5:
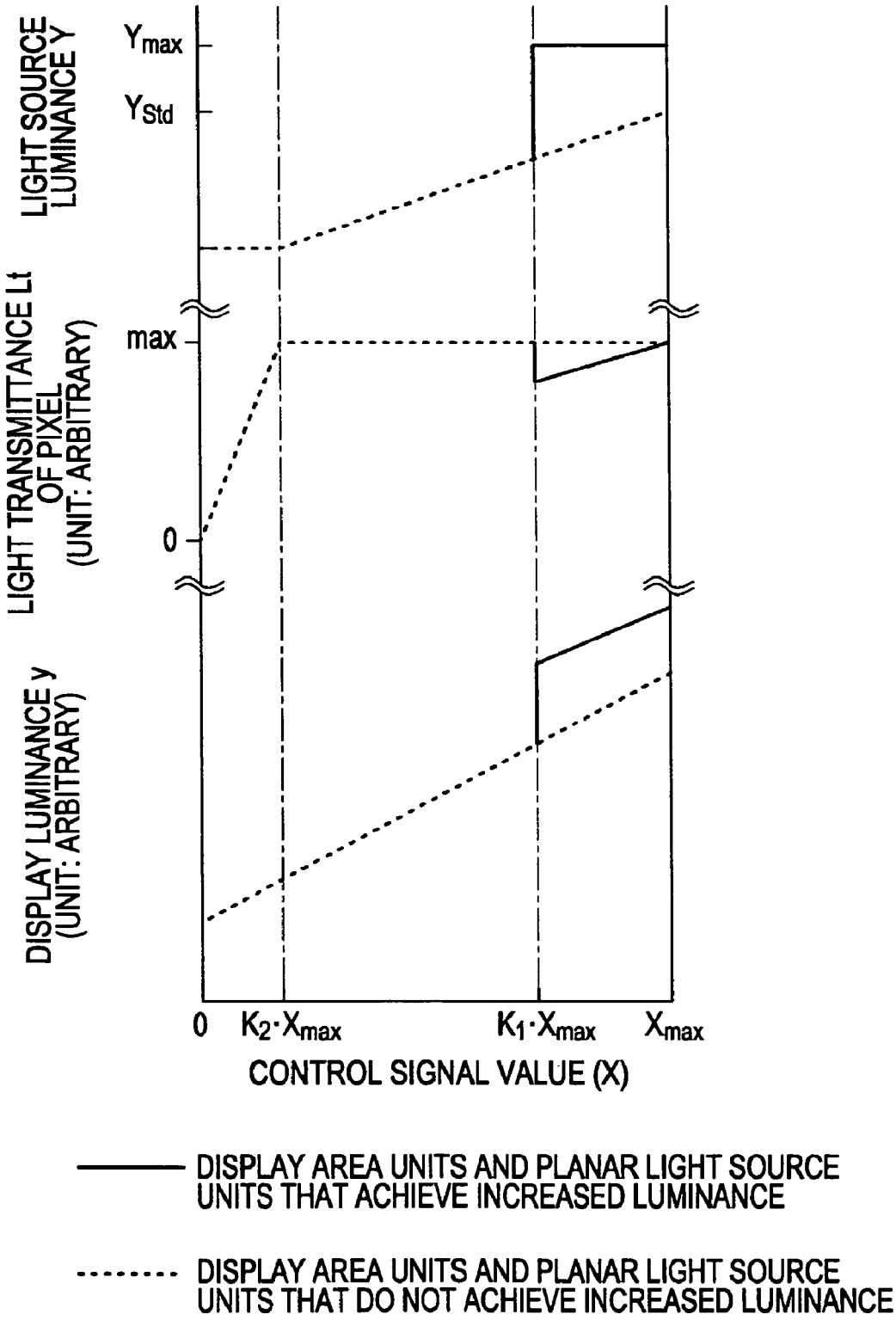
FIG. 5 schematically illustrates the relationships of control signal value X to light source luminance Y and light transmittance Lt and display luminance y of pixels in a fifth embodiment.
Figure 14:
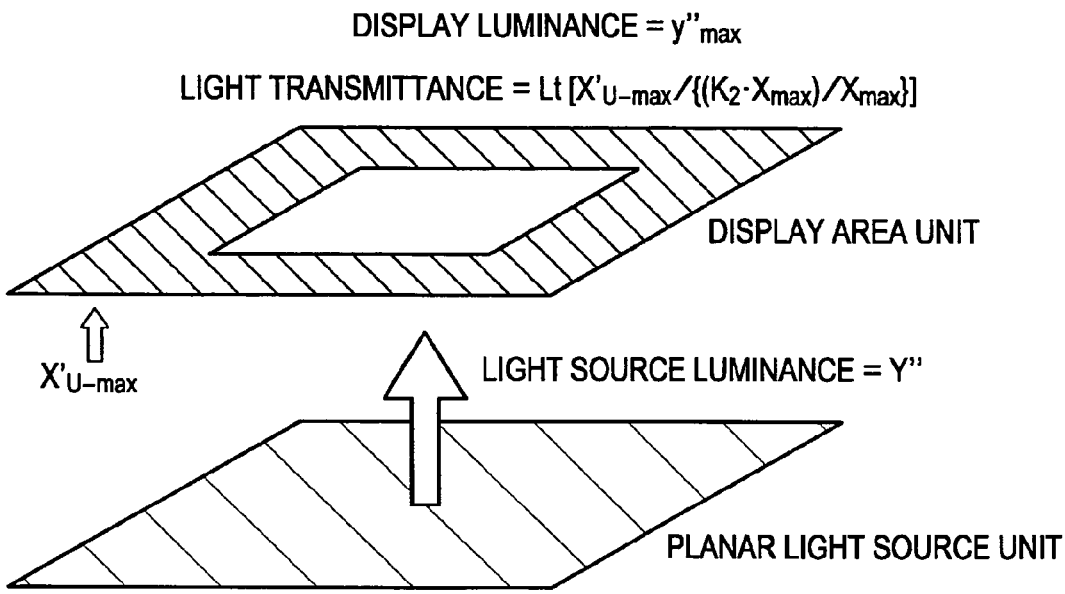
FIG. 14 illustrates the concept of the relationship among the light source luminance of the planar light source device, the light transmittance (aperture ratio) of the pixels, and the display luminance of the display area in a control mode 2C.
Figure 19:
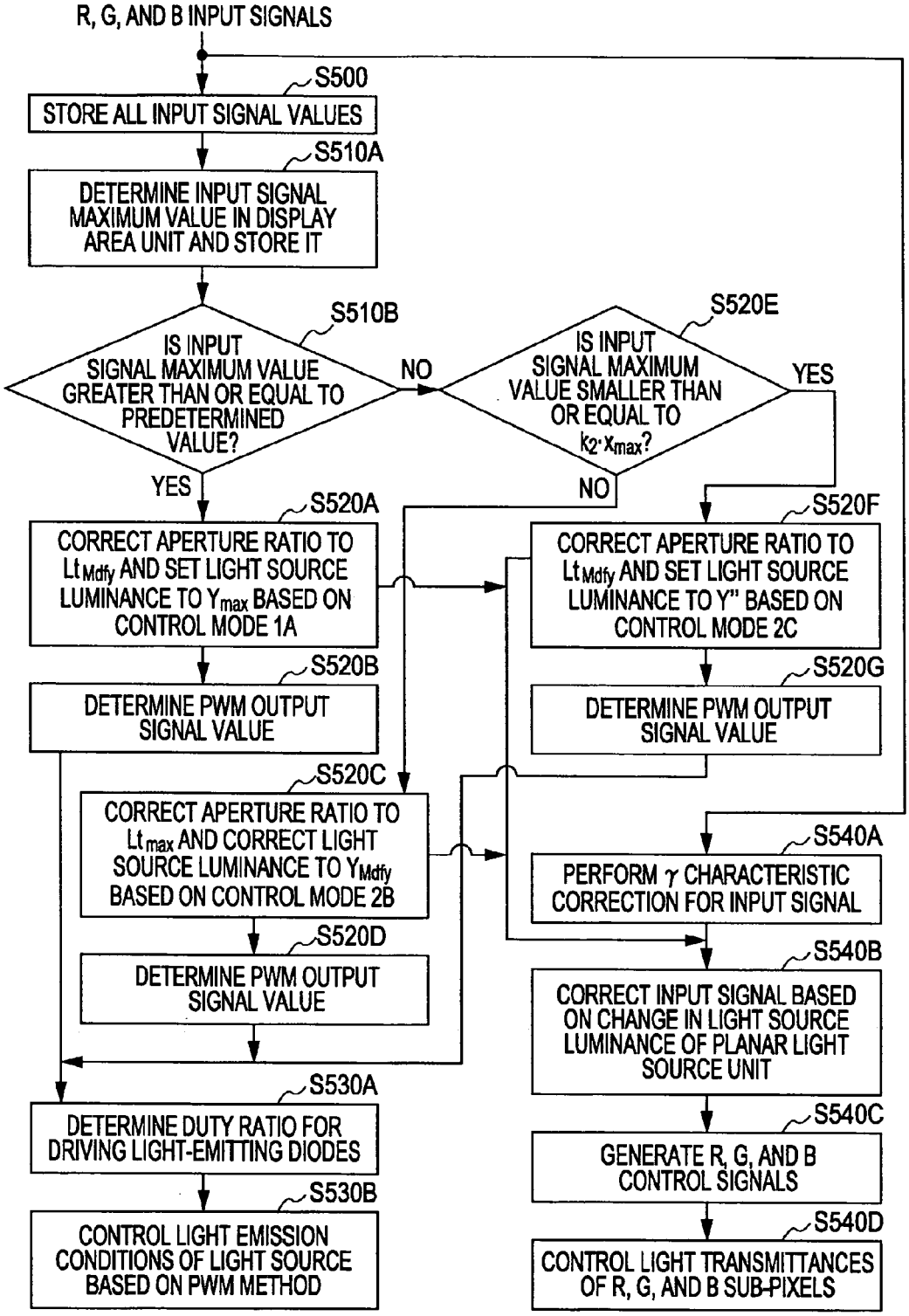
FIG. 19 is a flowchart illustrating a driving method for a liquid crystal display device assembly according to the fifth embodiment.

In a fifth embodiment, which is a modification made to the fourth embodiment, the control mode 1A, the control mode 2B, and the control mode 2C are employed. That is, in steps S520C and S520D, which are similar to steps S420C and S420D, the control mode 2B and the control mode 2C are employed. The relationships of the control signal value X to the light source luminance Y and the light transmittance Lt and the display luminance y of pixels in the fifth embodiment are schematically shown in FIG. 5. A description is now given, with reference to FIGS. 14 and 19, of a driving method for a liquid crystal display device assembly according to the fifth embodiment. FIG. 14 illustrates the concept of the relationship among the light source luminance of the planar light source device 40 and the light transmittance (aperture ratio) and the display luminance of pixels in the control mode 2C. FIG. 19 is a flowchart illustrating the driving method for the liquid crystal display device assembly.

In step S500, step S100 in the first embodiment is executed. Then, in steps S510A and S510B, steps S110A and S110B are executed. Then, in steps S520A and S520B, steps S120A and S120B are executed.

Steps S520C and S520D are different from steps S420C and S420D in the fourth embodiment. If the computation circuit 71 determines that there is no pixel that satisfies expression (1) (or simultaneously satisfies expressions (1-1), (1-2), and (1-3)) in the display area unit 12, the luminance of the planar light source unit 42 corresponding to the display area unit 12 that does not achieve increased luminance are controlled by the planar light source device control circuit 70 and the planar light source unit drive circuit 80 so that the luminance of a pixel, assuming that the control signal corresponding to the input signal having the maximum value $x'_{U\text{-}max}$, which indicates the maximum value of the input signals input into the drive circuit for driving all the pixels forming the display area unit 12 that does not achieve increased luminance, is supplied to the pixel, can be obtained. This processing is the same as that in steps S420C and S420D.

In the fifth embodiment, however, it is determined in step S520E whether the value $x_{U\text{-}max}$ is smaller than or equal to $k_2 \cdot x_{max}$ (i.e., $x'_{U\text{-}max} \leqq k_2 \cdot x_{max}$ (3)). If expression (3) is satisfied, the luminance of the planar light source unit 42 corresponding to the display area unit 12 that does not achieve increased luminance is controlled by the planar light source device control circuit 70 and the planar light source unit drive circuit 80 so that the luminance of a pixel, assuming that the control signal corresponding to the input signal having a value equal to $x'_{U\text{-}max}/k_2$ (or $x'_{U\text{-}max}/\{(k_2 \cdot X_{max})/X_{max}$56 is supplied to the pixel, can be obtained.

In the fifth embodiment, the light source luminance of the planar light source unit 42 corresponding to the display area unit 12 that does not achieve increased luminance and that satisfies expression (3) is set to be a constant value Y" regardless of the input signal value $x'_{U\text{-}max}$ of the input signal that satisfies expression (3). In this case, the light transmittance $Lt_{Mdfy}$ of the pixel exhibiting the maximum luminance (pixel B) forming the display area unit 12 is set to be a value so that the display luminance $y''_{max}$ can be obtained. More specifically, when the input signal value is x, the original light transmittance (aperture ratio) of pixels is $Lt[X/X_{max}]$ .In the fifth embodiment, however, under the control of the planar light source device control circuit 70 and the planar light source unit drive circuit 80, the light transmittance of the pixels is corrected to $Lt_{Mdfy}$, for each image display frame. More specifically, when the input signal value is $x'_{U\text{-}max}$, the light transmittance of the pixels is set to be:

$$Lt\,[X'_{U\text{-}max}/\{(K_2 \cdot X_{max})/X_{max}\}] \tag{15}$$

In the fifth embodiment, the light source luminance of the planar light source unit 42 that does not achieve increased luminance is controlled to be Y", and the light transmittance (aperture ratio) of the pixels forming the display area unit 12 that does not achieve increased luminance is also corrected.

More specifically, the PWM output signals S (the PWM output signal $S_R$ for controlling the light emission time of the R light-emitting diode 41R, the PWM output signal $S_G$ for controlling the light emission time of the G light-emitting diode 41G, and the PWM output signal $S_B$ for controlling the light emission time of the B light-emitting diode 41B) for obtaining the light source luminance Y" of the planar light source unit 42 for each image display frame are sent to the storage unit 82 of the planar light source unit drive circuit 80 provided for the planar light source unit 42 and are stored in the storage unit 82. The clock signal CLK is also output to the planar light source unit drive circuit 80 (see FIG. 25).

For example, when $x_R$=10, $x_G$=15, and $x_B$=5, $x'_{U\text{-}max}$=15. Accordingly, the luminance of the planar light source unit 42 that does not achieve increased luminance is set to be Y", and the light transmittance of the R, G and B sub-pixels is corrected to Lt[15/(0.2×256)/256}].

The duty ratio $D_2$ that can obtain the luminance of the pixel, assuming that the R, G, and B control signals corresponding to the R, G, and B input signals having a value equal to $k_2 \cdot x_{max}$ are supplied to the R, G, and B sub-pixels, is expressed by:

$$D_2 = \alpha_2 \cdot D_{max} \tag{6}$$

where $D_{max}$ indicates the maximum duty ratio.

Then, steps S130A and S130B in the first embodiment are executed as steps S530A and S530B.

Then, steps S140A through S140D are executed as steps S540A through S540D.

The configuration and structure of the liquid crystal display device assembly in the fifth embodiment are similar to those of the first embodiment, and an explanation thereof is thus omitted.

Sixth Embodiment

Figure 6:
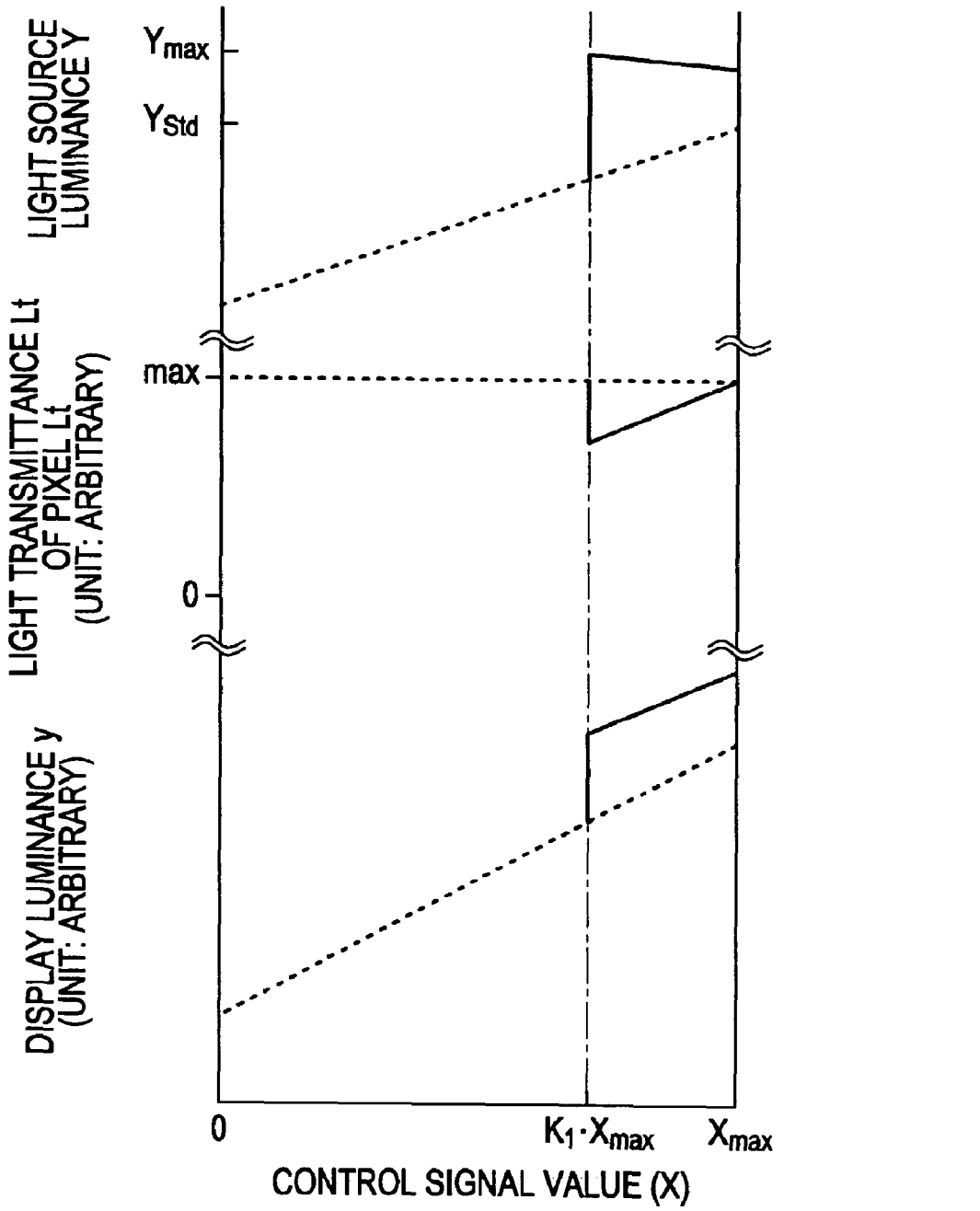
FIG. 6 schematically illustrates the relationships of control signal value X to light source luminance Y and light transmittance Lt and display luminance y of pixels in a sixth embodiment.
Figure 20:
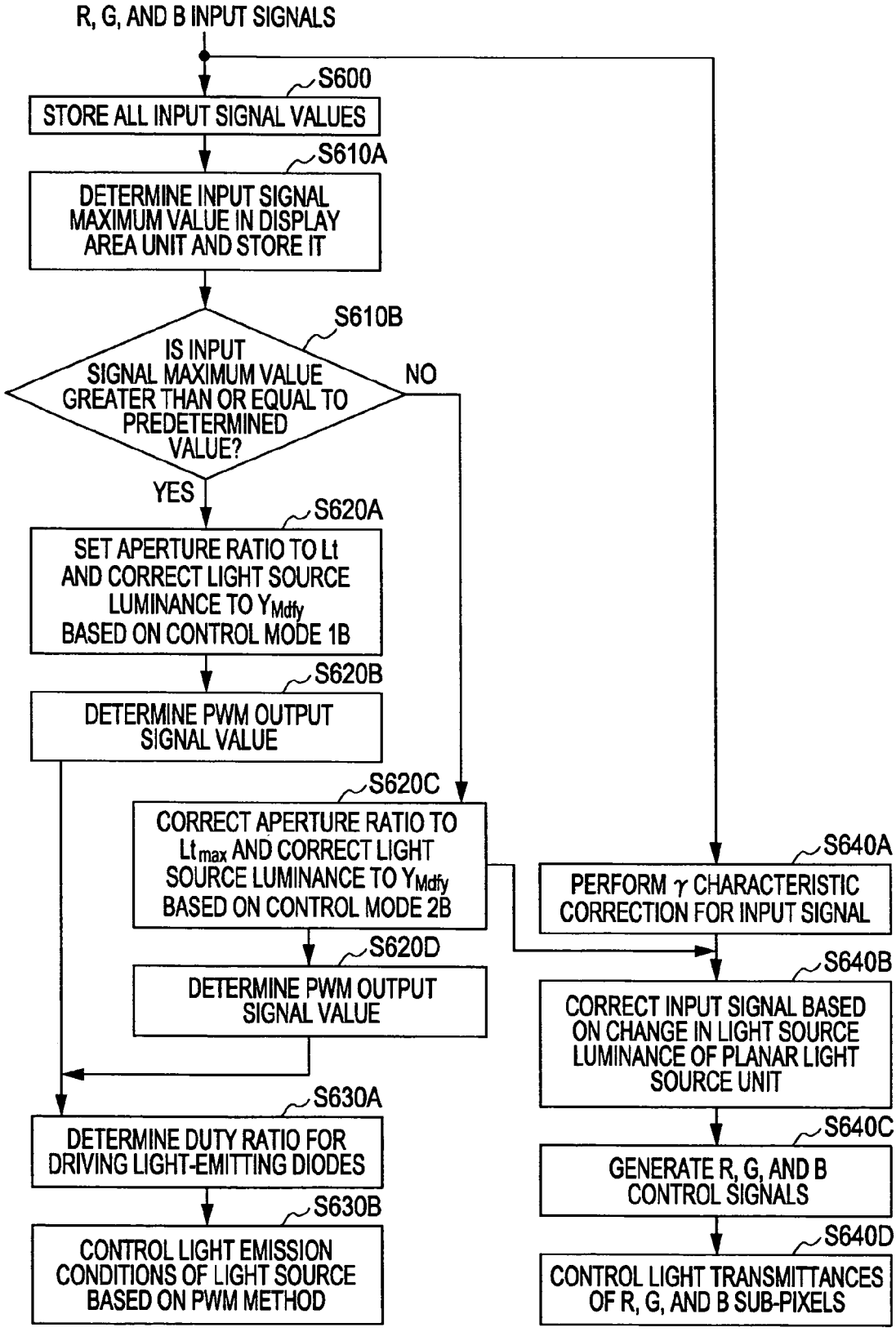
FIG. 20 is a flowchart illustrating a driving method for a liquid crystal display device assembly according to the sixth embodiment.

In a sixth embodiment, which is a modification made to the fourth and second embodiments, the control mode 1B and the control mode 2B are employed. That is, in steps S620A and S620B similar to steps S120A and S120B in the first embodiment, the control mode 1B is employed. The relationships of the control signal value X to the light source luminance Y and the light transmittance Lt and the display luminance y of sub-pixels in the sixth embodiment are schematically shown in FIG. 6. A description is now given, with reference to FIG. 20, of a driving method for a liquid crystal display device assembly according to the sixth embodiment.

In step S600, step S100 in the first embodiment is executed. Then, in steps S610A and S610B, steps S110A and S110B in the first embodiment are executed. Then, in steps S720A and S720B, steps S220A and S220B in the second embodiment are executed.

If the computation circuit 71 determines that there is no pixel that satisfies expression (1) (or simultaneously satisfies expressions (1-1), (1-2), and (1-3)) in the display area unit 12, steps S420C and S420D in the fourth embodiment are executed as steps S620C and S620D.

Then, steps S130A and S130B in the first embodiment are executed as steps S630A and S630B.

Then, steps S140A through S140D in the first embodiment are executed as steps S640A through S640D.

The configuration and structure of the liquid crystal display device assembly in the sixth embodiment are similar to those of the first embodiment, and an explanation thereof is thus omitted.

Seventh Embodiment

Figure 7:
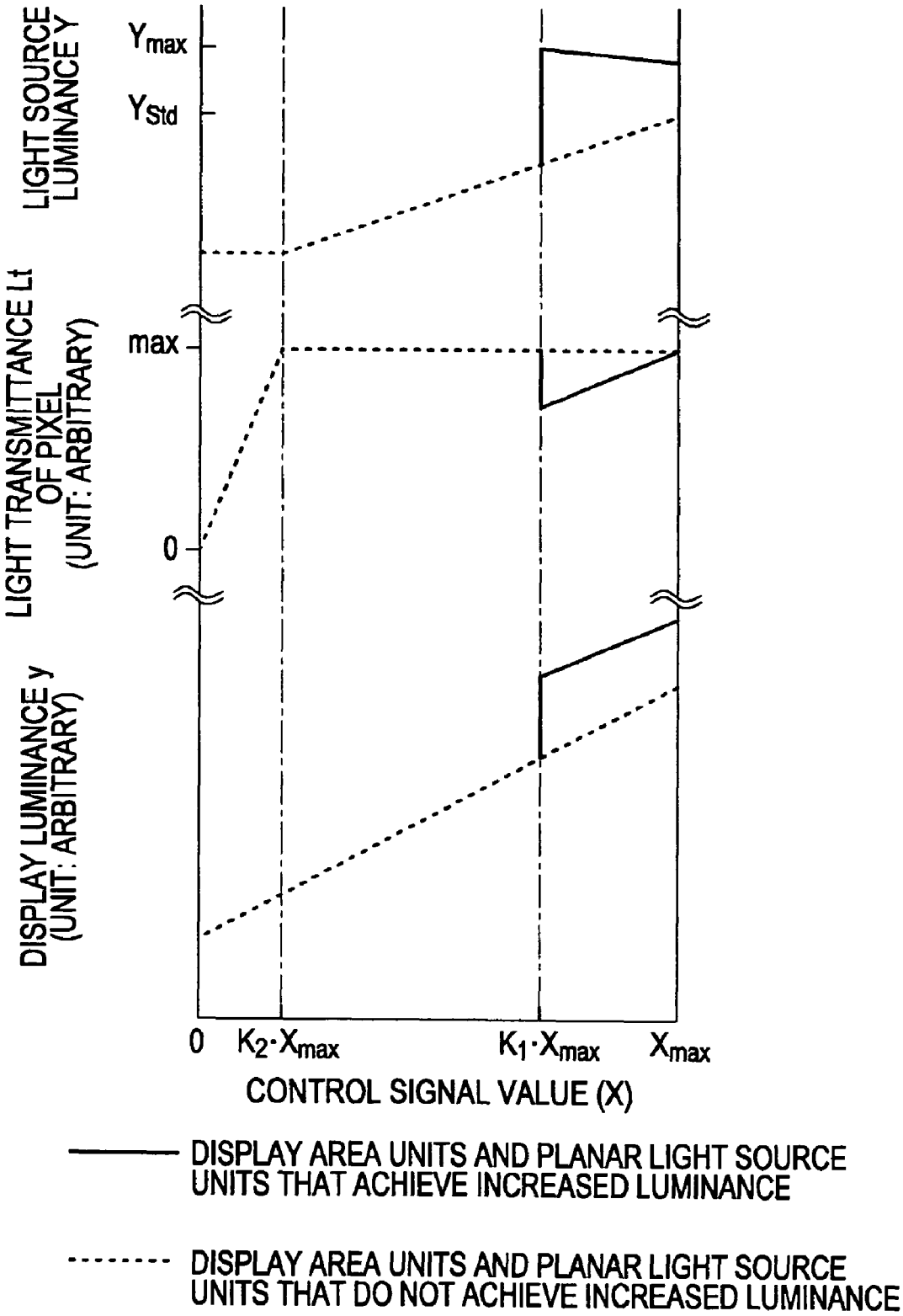
FIG. 7 schematically illustrates the relationships of control signal value X to light source luminance Y and light transmittance Lt and display luminance y of pixels in a seventh embodiment.
Figure 21:
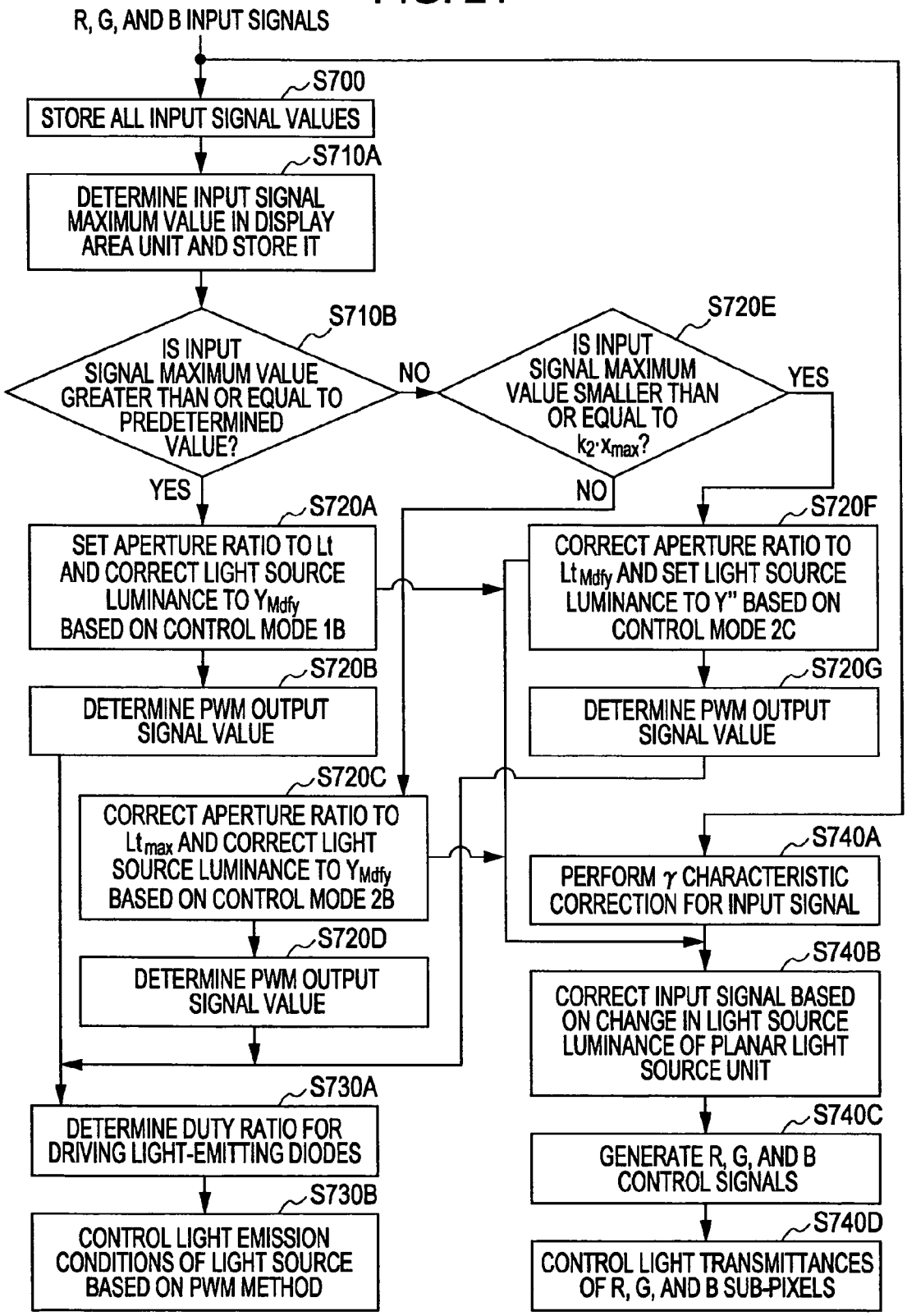
FIG. 21 is a flowchart illustrating a driving method for a liquid crystal display device assembly according to the seventh embodiment.

In a seventh embodiment, which is a modification made to the sixth embodiment, the control mode 1B, the control mode 2B, and the control mode 2C are employed. That is, in steps S720C and S720D similar to steps S420C and S420D in the fourth embodiment, the control mode 2B and the control mode 2C are employed. The relationships of the control signal value X to the light source luminance Y and the light transmittance Lt and the display luminance y of sub-pixels in the seventh embodiment are schematically shown in FIG. 7. A description is now given, with reference to FIG. 21, of a driving method for a liquid crystal display device assembly according to the seventh embodiment.

In step S700, step S100 in the first embodiment is executed. Then, in steps S710A and S710B, steps S110A and S110B in the first embodiment are executed. Then, in steps S720A and S720B, steps S220A and S220B in the second embodiment are executed.

If the computation circuit 71 determines that there is no pixel that satisfies expression (1) (or simultaneously satisfies expressions (1-1), (1-2), and (1-3)) in the display area unit 12, steps S520C through S520G in the fifth embodiment are executed as steps S720C through S720G.

Then, steps S130A and S130B in the first embodiment are executed as steps S730A and S730B.

Then, steps S140A through S140D are executed as steps S740A through S740D.

The configuration and structure of the liquid crystal display device assembly in the seventh embodiment are similar to those of the first embodiment, and an explanation thereof is thus omitted.

Eighth Embodiment

Figure 8:
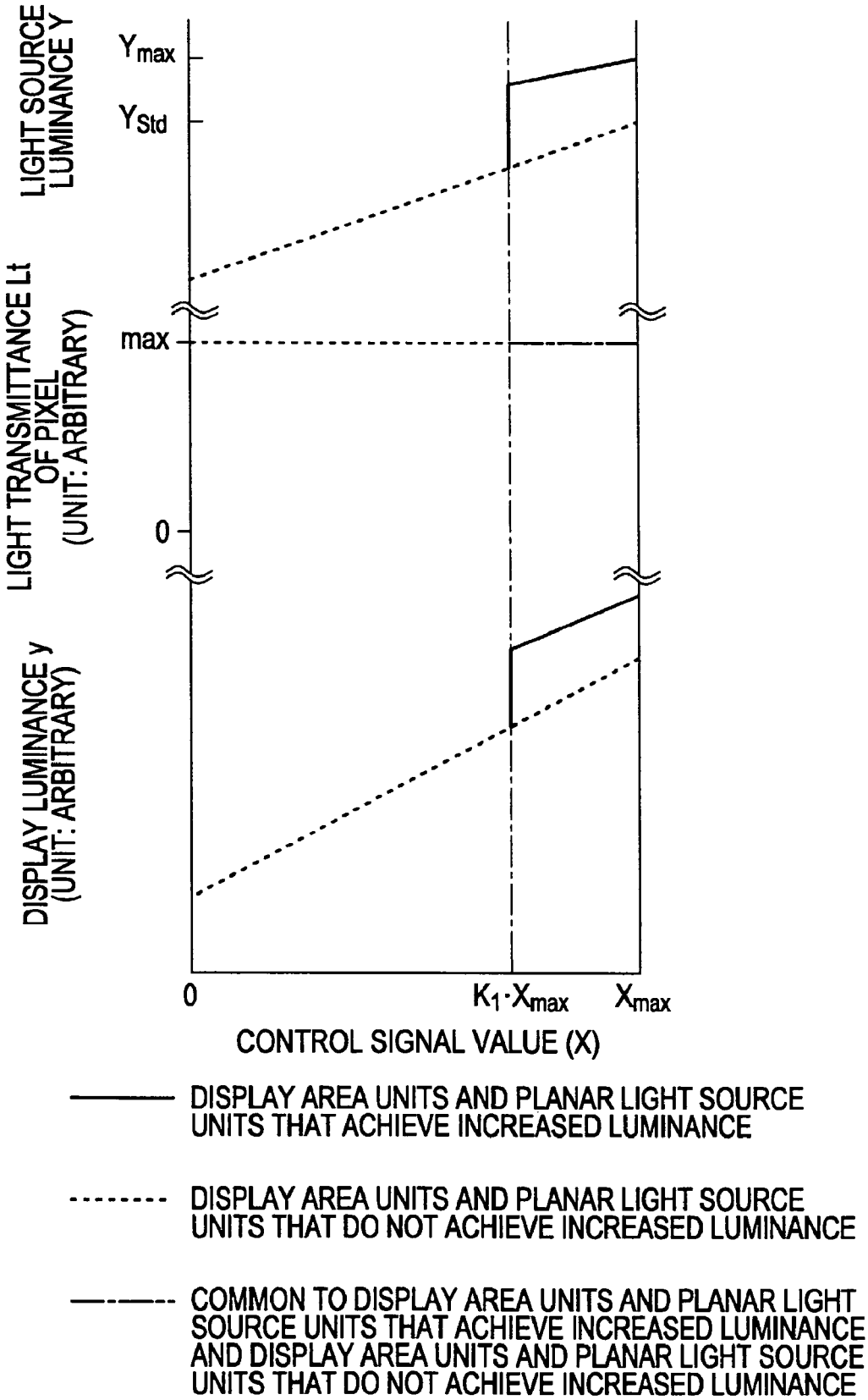
FIG. 8 schematically illustrates the relationships of control signal value X to light source luminance Y and light transmittance Lt and display luminance y of pixels in an eighth embodiment.
Figure 22:
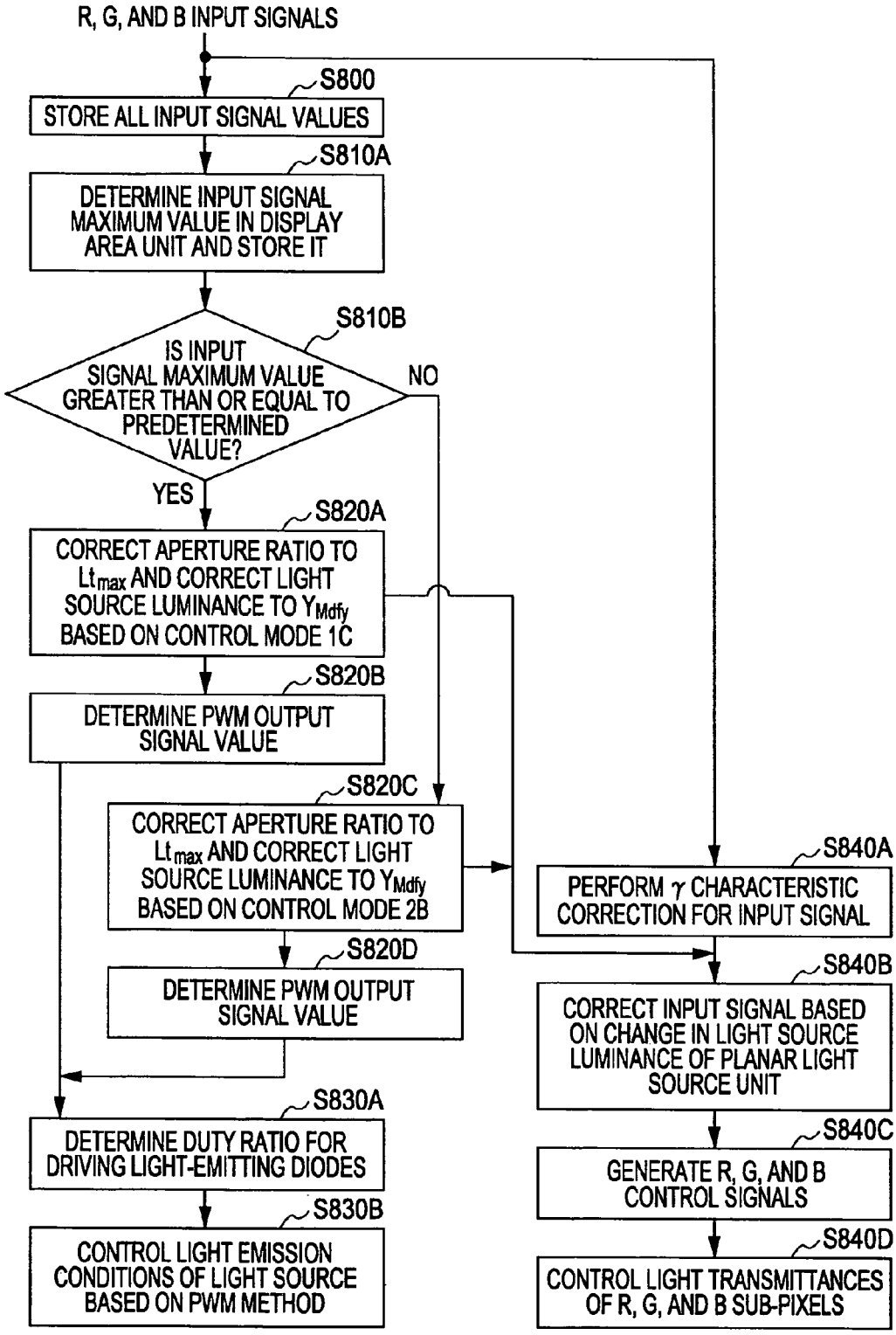
FIG. 22 is a flowchart illustrating a driving method for a liquid crystal display device assembly according to the eighth embodiment.

In an eighth embodiment, which is a modification made to the fourth and third embodiments, the control mode 1C and the control mode 2B are employed. That is, in steps S820A and S820B similar to steps S120A and S120B in the first embodiment, the control mode 1C is employed. The relationships of the control signal value X to the light source luminance Y and the light transmittance Lt and the display luminance y of sub-pixels in the eighth embodiment are schematically shown in FIG. 8. A description is now given, with reference to FIG. 22, of a driving method for a liquid crystal display device assembly according to the eighth embodiment.

In step S800, step S100 in the first embodiment is executed. Then, in steps S810A and S810B, steps S111A and S110B are executed. Then, in steps S 820A and S820B, steps S320A and S320B in the third embodiment are executed.

If the computation circuit 71 determines that there is no pixel that satisfies expression (1) (or simultaneously satisfies expressions (1-1), (1-2), and (1-3)) in the display area unit 12, steps S420C and S420D in the fourth embodiment are executed as steps S820C and S820D.

Then, steps S130A and S130B in the first embodiment are executed as steps S830A and S830B.

Then, steps S140A through S140D in the first embodiment are executed as steps S840A through S840D.

The configuration and structure of the liquid crystal display device assembly in the eighth embodiment are similar to those of the first embodiment, and an explanation thereof is thus omitted.

Ninth Embodiment

Figure 9:
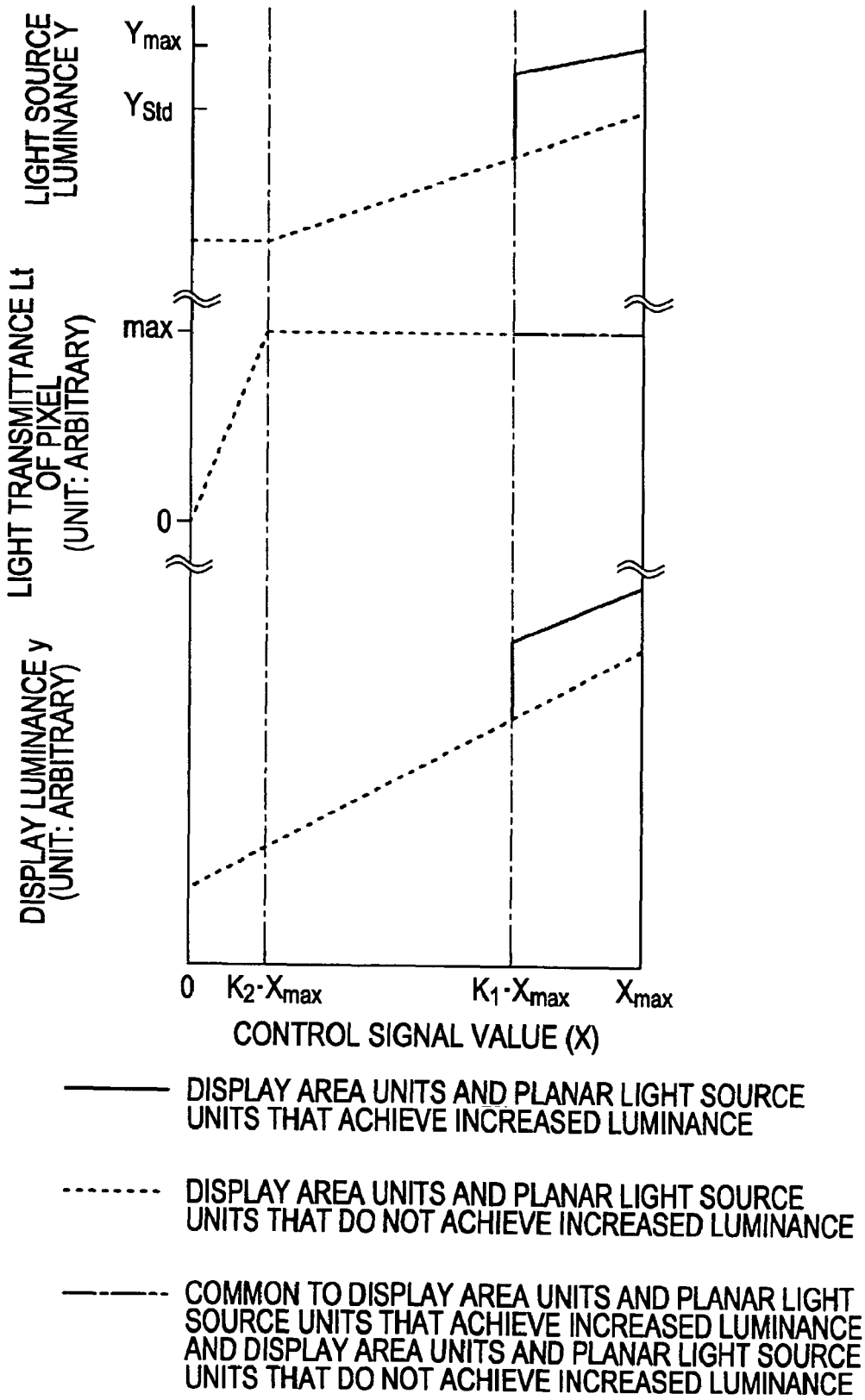
FIG. 9 schematically illustrates the relationships of control signal value X to light source luminance Y and light transmittance Lt and display luminance y of pixels in a ninth embodiment.
Figure 23:
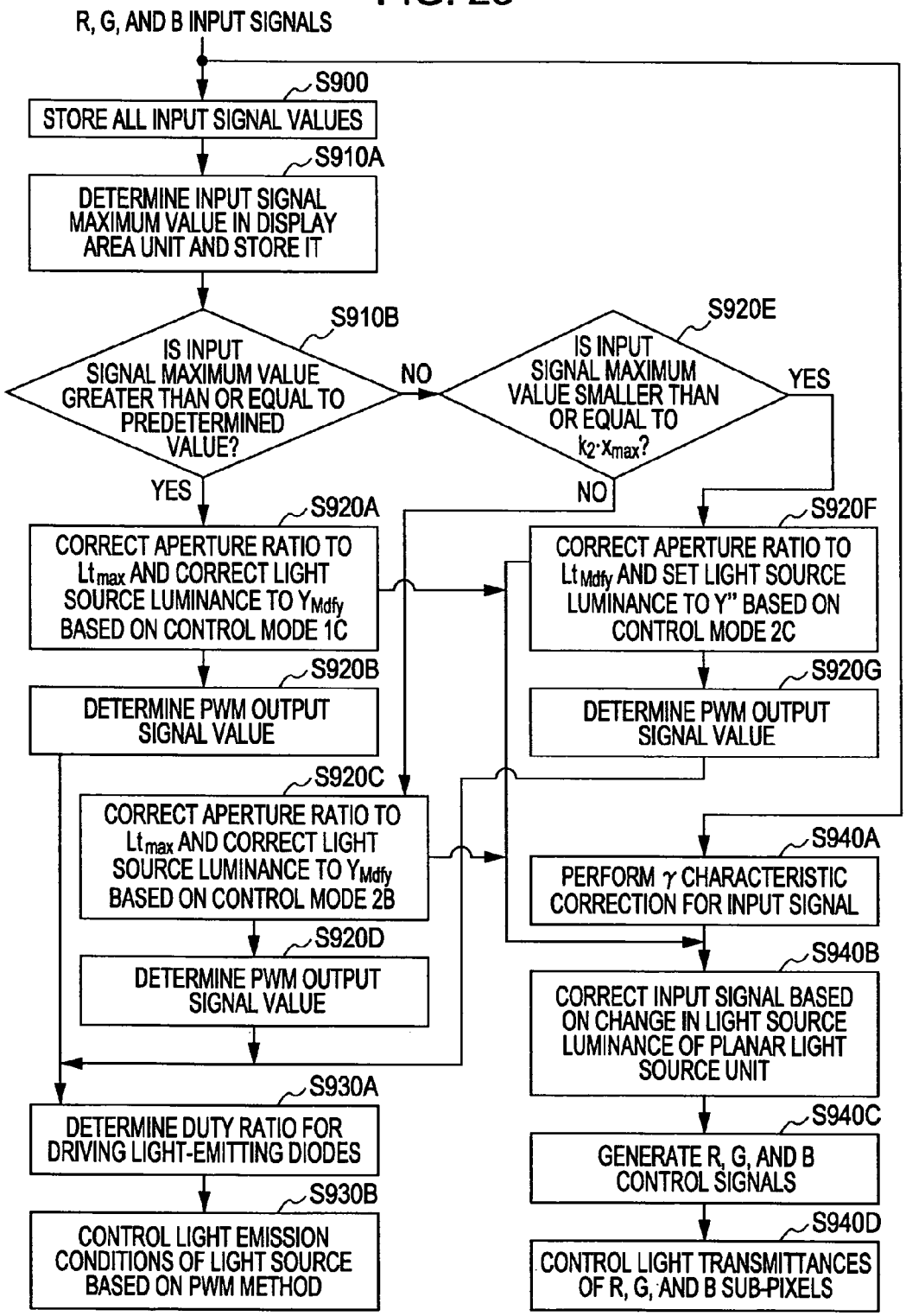
FIG. 23 is a flowchart illustrating a driving method for a liquid crystal display device assembly according to the ninth embodiment.

In a ninth embodiment, which is a modification made to the eighth embodiment, the control mode 1C, the control mode 2B, and the control mode 2C are employed. That is, in steps S920C and S920D similar to steps S420C and S420D in the fourth embodiment, the control mode 2B and the control mode 2C are employed. The relationships of the control signal value X to the light source luminance Y and the light transmittance Lt and the display luminance y of sub-pixels in the ninth embodiment are schematically shown in FIG. 9. A description is now given, with reference to FIG. 23, of a driving method for a liquid crystal display device assembly according to the ninth embodiment.

In step S900, step S100 in the first embodiment is executed. Then, in steps S910A and S910B, steps S110A and S110B in the first embodiment are executed. Then, in steps S920A and S920B, steps S320A and S320B in the third embodiment are executed.

If the computation circuit 71 determines that there is no pixel that satisfies expression (1) (or simultaneously satisfies expressions (1-1), (1-2), and (1-3)) in the display area unit 12, steps S520C through S520G in the fifth embodiment are executed as steps S920C through S920G of the ninth embodiment.

Then, steps S130A and S130B in the first embodiment are executed as steps S930A and S930B.

Then, steps S140A through S140D in the first embodiment are executed as steps S940A through S940D.

The configuration and structure of the liquid crystal display device assembly in the ninth embodiment are similar to those of the first embodiment, and an explanation thereof is thus omitted.

The present invention has been discussed through illustration of preferred embodiments, but the invention is not restricted to the disclosed embodiments. The configurations and structures of the color liquid crystal display device assembly, the transmissive-type color liquid crystal display device, and the planar light source device are examples only, and the components and materials forming such devices are also examples only, and can be suitably changed. For example, the luminance correction or temperature control for the planar light source units may be performed as follows. The light emission condition of the planar light source device is monitored by an optical sensor, and the temperature of the light-emitting diodes is monitored by a temperature sensor, and then, the monitoring results are fed back to the LED drive circuit 83.

Additionally, if $(x_{U\text{-}max(R)}+x_{U\text{-}max(G)}+_{U\text{-}max(B)})/3 \geqq k_1 \cdot x_{max}$ (1") is satisfied instead of expressions (1-1), (1-2), and (1-3), the luminance of the planar light source unit 42 corresponding to the display area unit 12 may be controlled by the drive circuit so that the luminance levels of the R, G, and B sub-pixels, assuming that the control signals corresponding to the input signals having a value equal to $(x_{U\text{-}max(R)}+x_{U\text{-}max(G)}+_{U\text{-}max(B)})/3+k_0 \cdot x_{max}$ ($k_0$ is a coefficient in a range expressed by $0.06 \leqq k_0 0.03$) are supplied to the R, G, and B sub-pixels, can be obtained.

It should be understood by those skilled in the art that various modifications, combinations, sub-combinations and alterations may occur depending on design requirements and other factors insofar as they are within the scope of the appended claims or the equivalents thereof.

What is claimed is:

1. A driving method for a liquid crystal display device assembly that includes (A) a transmissive-type liquid crystal display device including a display area having pixels disposed in a two-dimensional matrix and at least one color filter corresponding to each pixel, the liquid crystal display device including a liquid crystal material disposed between a front alignment film and a rear alignment film, the front and rear alignment films disposed between a front polarization film and a rear polarization film, (B) a planar light source device including P×Q planar light source units corresponding to virtual P×Q display area units, taking the display area of the transmissive-type liquid crystal display device to be divided into the virtual P×Q display area units, the planar light source device illuminating the display area units corresponding to the planar light source units from a back surface of the display area units, and (C) a drive circuit that drives the planar light source device and the transmissive-type liquid crystal display device, the drive circuit supplying a control signal to each pixel for controlling the light transmittance of the pixel, the driving method comprising the step of:

taking a value of an input signal input into the drive circuit for driving the pixels to be indicated by x, the input signal originating from pixels in each of the display area units, when a value x of the input signal for any of the pixels forming the display area unit is greater than or equal to a predetermined value, the value of the input signal being indicated by $x_{U\text{-}max}$, controlling a luminance level of the planar light source unit corresponding to the display area unit by the drive circuit so that luminance levels of the pixels, assuming that the control signal corresponding to the input signal having a value greater than the value $x_{U\text{-}max}$ is supplied to the pixels, can be obtained, and wherein, upon the input signal x for any of the pixels forming the display area unit being greater than or equal to $k_1 \cdot x_{max}$ in each of the display area units, where $k_1$ is a coefficient in a range of $0.94 \leqq k_1 \leqq 0.99$ and $x_{max}$ is a maximum value of the input signals input into the drive circuit for driving the pixels, the luminance level of the planar light source unit corresponding to the display area unit is controlled by the drive circuit and supplied to the pixels so that luminance levels of the pixels having a value equal to $x_{U\text{-}max}+k_0 \cdot x_{max}$ is obtained, where $k_0$ is a coefficient in a range of $0.06 \leqq k_0 \leqq 0.3$, wherein each pixel includes a set of three sub-pixels, which are a red light-emitting sub-pixel, a green light-emitting sub-pixel, and a blue light-emitting sub-pixel, and taking values of the input signals input into the drive circuit for driving the red light-emitting sub-pixel, the green light-emitting sub-pixel, and the blue light-emitting sub-pixel to be indicated by $x_R$, $x_G$, and $x_B$, respectively, and when the maximum value of the input signals input into the drive circuit for driving the pixels is indicated by $x_{max}$ and when the predetermined value is indicated by $k_1 \cdot x_{max}$, and where $k_1$ is a coefficient in a range of $0.94 \leqq k_1 \leqq 0.99$, in each of the display area units, when all the values $x_R$, $x_G$, and $x_B$ for any of the pixels forming the display area unit are greater than or equal to $k_1 \cdot x_{max}$, the values of the input signals being indicated by $x_{U\text{-}max(R)}$, $x_{U\text{-}max(G)}$, and $x_{U\text{-}max(B)}$, respectively, the luminance level of the planar light source unit corresponding to the display area unit is controlled by the drive circuit so that luminance levels of the red light-emitting sub-pixel, the green light-emitting sub-pixel, and the blue light-emitting sub-pixel, taking the control signal corresponding to the input signal to have a value equal to a value $(x_{U\text{-}max(R)}+x_{U\text{-}max(G)}+x_{U\text{-}max(B)})/3+k_0 \cdot x_{max}$, where $k_0$ is a coefficient in a range of $0.06 \leqq k_0 \leqq 0.3$, are supplied to the red light-emitting sub-pixel, the green light-emitting sub-pixel, and the blue light-emitting sub-pixel, are obtained, wherein the light transmittance Lt of the pixel is set to approximately be: $[(x_{U\text{-}max}+k_0 \cdot x_{max})/\{(1+k_0)x_{max}\}]$, and wherein when the maximum value of the input signals input into the drive circuit for driving the pixels is indicated by $x_{max}$, a duty ratio $D_0$ that can obtain the luminance levels of the pixels, taking the control signal corresponding to the input signal to have a value equal to $(1+k_0)x_{max}$, where $k_0$ is a coefficient in a range of $0.06 \leqq k_0 \leqq 0.3$, is supplied to the pixels, is expressed by $D_0=\alpha_0 \cdot D_{max}$, where $\alpha_0$ is a coefficient in a range of $0.95 \leqq \alpha_0 \leqq 1.0$ and $D_{max}$ represents the maximum duty ratio.

2. The driving method according to claim 1, wherein the planar light source unit includes a light-emitting diode.

3. The driving method according to claim 2, wherein the luminance level of the planar light source unit is increased or decreased by increasing or decreasing a duty ratio used in pulse width modulation control for the light-emitting diode forming the planar light source unit.

4. A driving method for a liquid crystal display device assembly that includes (A) a transmissive-type liquid crystal display device including a display area having pixels disposed in a two-dimensional matrix and at least one color filter corresponding to each pixel, the liquid crystal display device including a liquid crystal material disposed between a front alignment film and a rear alignment film, the front and rear alignment films disposed between a front polarization film and a rear polarization film, (B) a planar light source device including P×Q planar light source units corresponding to virtual P×Q display area units, taking the display area of the transmissive-type liquid crystal display device to be divided into the virtual P×Q display area units, the planar light source device illuminating the display area units corresponding to the planar light source units from a back surface of the display area units, and (C) a drive circuit that drives the planar light source device and the transmissive-type liquid crystal display device, the drive circuit supplying a control signal to each pixel for controlling the light transmittance of the pixel, the driving method comprising the steps of:

taking a value of an input signal input into the drive circuit for driving the pixels to be indicated by x, the input signal originating from pixels in each of the display area units, when the value x of the input signal for any of the pixels forming the display area unit is greater than or equal to a predetermined value, the value of the input signal being indicated by $x_{U\text{-}max}$, controlling a luminance level of the planar light source unit corresponding to the display area unit by the drive circuit so that luminance levels of the pixels, taking the control signal corresponding to the input signal to have a value greater than the value $x_{U\text{-}max}$ is supplied to the pixels, is obtained; and in each of the display area units, if the values x of the input signals for all the pixels forming the display area unit are smaller than the predetermined value, when the maximum value of the input signals input into the drive circuit for driving all the pixels forming the display area unit is indicated by $x'_{U\text{-}max}$, controlling the luminance level of the planar light source unit corresponding to the display area unit by the drive circuit so that the luminance levels of the pixels, taking the control signal corresponding to the input signal to have a value equal to the maximum value $x'_{U\text{-}max}$ is supplied to the pixels, is obtained, and wherein, upon the input signal x for any of the pixels forming the display area unit being greater than or equal to $k_1 \cdot x_{max}$ in each of the display area units, where $k_1$ is a coefficient in a range of $0.94 \leqq k_1 \leqq 0.99$and $x_{max}$ is a maximum value of the input signals input into the drive circuit for driving the pixels, the luminance level of the planar light source unit corresponding to the display area unit is controlled by the drive circuit and supplied to the pixels so that luminance levels of the pixels having a value equal to $x_{U\text{-}max}+k_0 \cdot x_{max}$ is obtained, where $k_0$ is a coefficient in a range of $0.06 \leqq k_0 \leqq 0.3$, and for each of the display area units, upon the value x of the input signal for any of the pixels forming the display area unit being smaller than $k_1 \cdot x_{max}$, where the maximum value of the input signals input into the drive circuit for driving all the pixels forming the display area unit is indicated by $x'_{U\text{-}max}$, the luminance level of the planar light source unit corresponding to the display area unit is controlled by the drive circuit so that luminance levels of the pixels having a value equal to the maximum value $x'_{U\text{-}max}$ is obtained, wherein each pixel includes a set of three sub-pixels, which are a red light-emitting sub-pixel, a green light-emitting sub-pixel, and a blue light-emitting sub-pixel, and taking the values of the input signals input into the drive circuit for driving the red light- emitting sub-pixel, the green light-emitting sub-pixel, and the blue light-emitting sub-pixel to be indicated by $x_R$, $x_G$, and $x_B$, respectively, and when the maximum value of the input signals input into the drive circuit for driving the pixels is indicated by $x_{max}$, and when the predetermined value is indicated by $k_1 \cdot x_{max}$, and where $k_1$ is a coefficient in a range of $0.94 \leqq_1 \leqq 0.99$, in each of the display area units, when all the values $x_R$, $x_G$, and $x_B$; for any of the pixels forming the display area unit are greater than or equal to $k_1 \cdot x_{max}$, the values of the input signals being indicated by $x_{U\text{-}max(R)}$, $x_{U\text{-}max(G)}$, and $x_{U\text{-}max(B)}$, respectively, the luminance level of the planar light source unit corresponding to the display area unit is controlled by the drive circuit so that luminance levels of the red light-emitting sub-pixel, the green light-emitting sub-pixel, and the blue light-emitting sub-pixel, taking the control signal corresponding to the input signal to have a value equal to a value $(x_{U\text{-}max(R)}+x_{U\text{-}max\ (G)}+x_{U\text{-}max\ (B)})/3+k_0 \cdot x_{max}$, where $k_0$ is a coefficient in a range of $0.06 \leqq k_0 \leqq 0.3$, are supplied to the red max(B))/$^3$+k0' light-emitting sub-pixel, the green light-emitting sub-pixel, and the blue light-emitting sub-pixel, is obtained, and in each of the display area units, when any of the values $x_R$, $x_G$, and $x_B$ for all the pixels forming the display area unit is smaller than $k_1 \cdot x_{max}$ and when the maximum value of the input signals for the red light-emitting sub-pixel, the green light-emitting sub-pixel, and the blue light-emitting sub-pixel input into the drive circuit for driving all the pixels forming the display area unit is indicated by $x'_{U\text{-}max}$, the luminance level of the planar light source unit corresponding to the display area unit is controlled by the drive circuit so that luminance levels of the red light-emitting sub-pixel, the green light-emitting sub-pixel, and the blue light-emitting sub-pixel, taking the control signal corresponding to the input signal to have a value equal to the maximum value $x'_{U\text{-}max}$ is supplied to the red light-emitting sub-pixel, the green light-emitting sub-pixel, and the blue light-emitting sub-pixel, is obtained, wherein the light transmittance Lt of the pixel is set to approximately be: $[(x_{U\text{-}max}+k_0 \cdot x_{max})/\{(1+k_0)x_{max}\}]$, and wherein, when the maximum value of the input signals input into the drive circuit for driving the pixels is indicated by $x_{max}$, a duty ratio $D_0$ that can obtain the luminance levels of the pixels, taking the control signal corresponding to the input signal to have a value equal to $(1+k_0)x_{max}$, where $k_0$ is a coefficient in a range of $0.06 \leqq k_0 \leqq 0.3$, is supplied to the pixels, is expressed by $D_0=\alpha_0 \cdot D_{max}$, where $\alpha_0$ is a coefficient in a range of $0.95 \leqq \alpha_0 1.0$ and $D_{max}$ represents the maximum duty ratio.

5. The driving method according to claim 4, wherein the planar light source unit includes a light-emitting diode.

6. The driving method according to claim 5, wherein the luminance level of the planar light source unit is increased or decreased by increasing or decreasing a duty ratio used in pulse width modulation control for the light-emitting diode forming the planar light source unit.

7. The driving method according to claim 6, wherein, when the maximum value of the input signals input into the drive circuit for driving the pixels is indicated by $x_{max}$, a duty ratio $D_1$ that can obtain the luminance levels of the pixels, taking the control signal corresponding to the input signal to have a value equal to $k_1 \cdot x_{max}$, where $k_1$ is a coefficient in a range of $0.94 \leqq k_1 \leqq 0.99$, is supplied to the pixels, is expressed by $D_1=\alpha_1 \cdot D_{max}$, where $\alpha_1$ is a coefficient in a range of $0.3 \leqq \alpha_1 \leqq 0.8$ and $D_{max}$ represents the maximum duty ratio.

8. The driving method according to claim 4, wherein, when the maximum value of the input signals input into the drive circuit for driving the pixels is indicated by $x_{max}$, and when the maximum value $x'_{U\text{-}max}$ is expressed by $x'_{U\text{-}max} \leqq k_2 \cdot x_{max}$, and where $k_2$ is a coefficient in a range of $0.35 \leqq k_2 \leqq 0.5$, the luminance level of the planar light source unit corresponding to the display area unit is controlled by the drive circuit so that luminance levels of the pixels, taking the control signal corresponding to the input signal to have a value equal to a value $x'_{U\text{-}max}/k_2$ is supplied to the pixels, is obtained.

9. The driving method according to claim 8, wherein the planar light source unit includes a light-emitting diode.

10. The driving method according to claim 9, wherein the luminance level of the planar light source unit is increased or decreased by increasing or decreasing a duty ratio used in pulse width modulation control for the light-emitting diode forming the planar light source unit.

11. The driving method according to claim 10, wherein a duty ratio $D_0$ that can obtain the luminance levels of the pixels, taking the control signal corresponding to the input signal to have a value equal to $(1+k_0)x_{max}$, where $k_0$is a coefficient in a range of $0.06 \leqq k_0 \leqq 0.3$, is supplied to the pixels, is expressed by $D_0=\alpha_0 \cdot D_{max}$, where $\alpha_0$ is a coefficient in a range of $0.95 \leqq \alpha_0 \leqq 1.0$ and $D_{max}$ represents the maximum duty ratio.

12. The driving method according to claim 10, wherein a duty ratio $D_1$ that can obtain the luminance levels of the pixels, taking the control signal corresponding to the input signal to have a value equal to $k_1 \cdot x_{max}$, where $k_1$ is a coefficient in a range of $0.94 \leqq k_1 \leqq 0.99$, is supplied to the pixels, is expressed by $D_1=\alpha_1 \cdot D_{max}$, where $\alpha_1$ is a coefficient in a range of $0.3 \leqq \alpha_1 \leqq 0.8$ and $D_{max}$ represents the maximum duty ratio.

13. The driving method according to claim 10, wherein a duty ratio $D_2$ that can obtain the luminance levels of the pixels, taking the control signal corresponding to the input signal to have a value equal to $k_2 \cdot x_{max}$ is supplied to the pixels, is expressed by $D_2=\alpha_2 \cdot D_{max}$, where $\alpha_2$ is a coefficient in a range of $0.01 \leqq \alpha_2 \leqq 0.2$ and $D_{max}$ represents the maximum duty ratio.

* * * * *